United States Patent [19]

Sakaki et al.

[11] Patent Number: 4,910,127

[45] Date of Patent: Mar. 20, 1990

[54] SILVER HALIDE PHOTOGRAPHIC LIGHT-SENSITIVE MATERIAL SUITABLE FOR A RAPID PROCESSING AND CAPABLE OF OBTAINING DYE IMAGES EXCELLENT IN FASTNESS AGAINST LIGHT

[75] Inventors: Masao Sakaki; Kaoru Onodera, both of Odawara, Japan

[73] Assignee: Konishiroku Photo Industry Co., Ltd., Tokyo, Japan

[21] Appl. No.: 266,241

[22] Filed: Oct. 28, 1988

Related U.S. Application Data

[63] Continuation of Ser. No. 57,248, Jun. 1, 1987, abandoned.

[30] Foreign Application Priority Data

Jun. 11, 1986 [JP] Japan ..... 61-135144

[51] Int. Cl.[4] ..... G03C 7/38

[52] U.S. Cl. ..... 430/546; 430/551; 430/558

[58] Field of Search ..... 430/558, 551, 546

[56] References Cited

U.S. PATENT DOCUMENTS

| | | | |
|---|---|---|---|
| 4,540,653 | 9/1985 | Nishijima et al. | 430/558 |
| 4,592,991 | 6/1986 | Yoshida et al. | 430/546 |
| 4,609,618 | 9/1986 | Sasaki et al. | 430/546 |
| 4,639,413 | 1/1987 | Kawagishi et al. | 430/546 |
| 4,675,275 | 6/1987 | Nishijima et al. | 430/558 |
| 4,684,603 | 8/1987 | Nishijima et al. | 430/558 |
| 4,728,598 | 3/1988 | Bailey et al. | 430/387 |

FOREIGN PATENT DOCUMENTS 02467 4/1986 PCT Int'l Appl. .

*Primary Examiner*—Paul R. Michl
*Assistant Examiner*—Mark R. Buscher
*Attorney, Agent, or Firm*—Jordan B. Bierman

[57] ABSTRACT

A silver halide color photographic light-sensitive material is disclosed, which has excellent rapid processability and is remarkably improved in spectral absorption characteristics and fastness against light of magnet images. The photographic material comprising a support bearing at least one silver halide emulsion layer thereon, and the silver halide emulsion layer contains silver halide grains each containing silver chloride in an amount of not less than 80 mol %, and at least one couplers selected from the group consisting of the couplers represented by the following General Formulas (a), (b) and (c), respectively, or a polymer coupler comprising said coupler, and an anti-discoloring agent, each dispersed in the silver halide emulsion layer by making use of a high boiling organic solvent, provided that a proportion of said high boiling organic solvent to said coupler is not less than 0.6 by weight.

General Formula (a)

(b)

(c)

11 Claims, No Drawings

SILVER HALIDE PHOTOGRAPHIC LIGHT-SENSITIVE MATERIAL SUITABLE FOR A RAPID PROCESSING AND CAPABLE OF OBTAINING DYE IMAGES EXCELLENT IN FASTNESS AGAINST LIGHT

This application is a continuation of application Ser. No. 057.248, filed 6/1/87, now abandoned.

FIELD OF THE INVENTION

This invention relates to a silver halide photographic light-sensitive material and, more particularly, to a silver halide photographic light-sensitive material suitable for a rapid processing, excellent in spectral absorption characteristics and remarkably improved upon dye-image fastness against light.

BACKGROUND OF THE INVENTION

It has heretofore been well-known that a color image may be formed in such a manner that a silver halide color photographic light-sensitive material is imagewise exposed and color-developed in a coupling reaction of a color forming agent with the oxidized product of an aromatic primary amine type color developing agent through which such a dye as indophenol, indoaniline, indamine, azomethine, phenoxazine, phenazine and the similar dyes thereto may be produced. Normally, this kind of photographic systems has so far adopted a subtractive color reproduction process and used a silver halide color photographic light-sensitive material containing, in the blue-sensitive, green-sensitive and red-sensitive silver halide light-sensitive emulsion layers thereof, color forming agents in the complementary color relation, respectively, that is, the couplers capable of producing colors in yellow, magenta and cyan, respectively.

It has been well-known that the above-mentioned couplers to be used for forming yellow color images include, for example, acylacetanilide type couplers; the couplers for forming magenta color images include, for example, those of the pyrazolone, pyrazolobenzimidazole, pyrazolotriazole or indazolone type; and the couplers for forming cyan color images include, for example, those of the phenol or naphthol type; and they have popularly been used.

It has been requested that such a dye image should neither be discolored nor faded even if it is exposed to light for a long time or stored under the conditions of high temperature and humidity. It has also been requested that any of the non-color image formed areas of a silver halide color photographic light-sensitive material (hereinafter called a color photographic material) should not be stained into yellow (hereinafter called a Y-stain) by light, heat and/or moisture.

In the case of magenta couplers, however, there has often raised such a serious problem that Y-stains produced in non-color image formed areas by light, heat and/or moisture have been more serious than in the cases of yellow or cyan couplers.

One of the typical couplers having popularly been used for forming such magenta dyes is a 5-pyrazolone. The dyes each formed from the magenta couplers of the 5-pyrazolone type have such a serious problem that a subabsorption is in around 430 nm, beside the main absorption is in around 550 nm. To solve this problem, various studies and researches have so far been made.

They are the magenta couplers having so far been proposed, such a pyrazolonebenzimidazole as described in British Pat. No. 1,047,612, such an indazolone as described in U.S. Pat. No. 3,770,447, such a pyrazolotriazole as described in U.S. Pat. No. 3,725,067 and British Pat. Nos. 1,252,418 and 1,334,515, and so forth. Among them, the dyes formed from 1H-pyrazolo[3,2-C]-s-triazole type magenta couplers described in U.S. Pat. No. 3,725,067 and British Pat. Nos. 1,252,418 and 1,334,515, each of which has the preferable advantages that the subabsorption in around 430 nm is substantially less and Y-stains produced in non-color image formed areas by light, heat and moisture are also substantially less.

As for the dyes each formed from the above-mentioned magenta couplers having a substantially less subabsorption in around 430 μm, there have similarly been proposed those of pyrazolobenzimidazoles described in British Pat. No. 1,047,612, imidazolones described in U.S. Pat. No. 3,770,447, 1H-pyrazolo[5,1-c]-1,2,4-triazoles described in U.S. Pat. No. 3,725,067 and British Pat. Nos. 1,252,418 and 1,334,515, 1H-pyrazolo[1,5-b]-1,2,4-triazoles described in Japanese Patent Publication Open to Public Inspection (hereinafter called Japanese Patent O.P.I. Publication) No. 171956/1984 and Research Disclosure No. 24531, 1H-pyrazolo[1,5-c]-1,2,3-triazoles described in Research Disclosure No. 24626, 1H-imidazo[1,2-b]pyrazoles described in Japanese Patent O.P.I. Publication No. 162548/1984 and Research Disclosure No. 24531, 1H-pyrazolo[1,5-b]pyrazoles described in Japanese Patent O.P.I. Publication No. 43659/1985 and Research Disclosure No. 24230, 1H-pyrazolo[1,5-d]tetrazoles described in Japanese Patent O.P.I. Publication No. 33552/1985 and Research Disclosure No. 24220, and so forth.

However, some of these azole type ones have had the problems on color developability.

Besides the above, International Patent Publication (WO) No. 86/02467 proposes a magenta coupler relatively less in subabsorption and excellent in spectral absorption characteristics and in dissolution/dispersion characteristics and color developability of the couplers, similar to the above-given couplers.

The magenta coupler proposed therein are relatively excellent in dissolution/dispersion characteristics and color developability rather than the conventional azole type couplers, however, they still have a defect in their fastness against light.

In the recent photographic industry, on the other hand, when reproducing the above-mentioned dye images, a high temperature process and a processing simplification have generally been tried with the purpose of economizing a time consumption required for various processing steps. Particularly, it is essential to improve the processing rate of a color developing process so as to shorten a processing time having been required in high temperature processes.

It has been well-known that the processing rate of a color process depends greatly upon the configurations, sizes and compositions of silver halide grains which are to be contained in silver halide emulsion. It has particularly been well-known that silver chloride grains may be able to display a substantially high processing rate if they are under specific conditions, so that they may be able to preferably contribute to shortening a procesing time, as described in Japanese Patent O.P.I. Publication No. 232342/1984.

Accordingly, the present inventors have tried their experiments by making use of the coupler described in the above-mentioned International Patent Publication (WO) No. 86/02467 and further the silver halide grains each having a relatively high silver chloride content and, resultingly, they have succeeded to raise the processing rate and to achieve more improvements in color developability, as compared with the conventional azole type magenta couplers. However, the fastness against light thereof still remained unimproved similar to the case of the conventional azole type couplers. Therefore, the inventors have tried to use therein an anti-discoloring agent in combination, however, any fastness against light has not been improved with keeping a rapid processing compatibility, because the color developability has seriously been deteriorated, though the fastness against light has been improved to some extent.

Accordingly, the inventors have improved the fastness against light of dye images formed from the above-mentioned couplers having the excellent advantages in dissolution/dispersion characteristics and in color developing characteristics and, further, studied on light-sensitive materials each suitable for rapid processing. Resultingly, the inventors have found that such fastness against light can be improved without deterioration of color developability in a rapid processes, when using silver halide grains each containing silver chloride in an amount of not less than 80 mol % and a high boiling organic solvent in a specific proportion to couplers used, so as to serve as the dispersion medium of both couplers and anti-discoloring agent used therein.

In addition to the above, the inventors have similarly studied on not only the coupler described in the International Patent Publication (WO) No. 86/02467, but also the couplers similar to the above-mentioned coupler, so that the inventors have finally achieved this invention.

SUMMARY OF THE INVENTION

It is, therefore, an object of the invention to provide a silver halide photographic light-sensitive material which is excellent in spectral absorption characteristics and is remarkably improved in fastness of dye images against light.

Another object of the invention is to provide a silver halide photographic light-sensitive material which is excellent in color image developability that is suitable for rapid processes.

A further object of the invention is to provide a silver halide photographic light-sensitive material which is improved in color image developability, fastness of dye images against light and rapid processing compatibility, altogether.

The objects of the invention can be achieved with a silver halide photographic light-sensitive material comprising a support bearing at least one of silver halide emulsion layers thereon, wherein (1) the above-mentioned silver halide emulsion layers contains (A) silver halide grains each containing silver chloride in an amount of not less than 80 mol %, and (B) at least one coupler selected from the group consisting of the couplers represented by the following general formulas (a), (b) and (c), respectively, and an anti-discoloring agent, each dispersed by making use of a high boiling organic solvent, provided that a proportion of said high boiling organic solvent to said couplers is not less than 0.6 by weight.

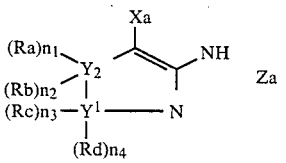

General Formula (a)

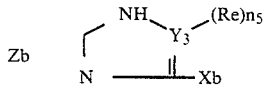

General Formula (b)

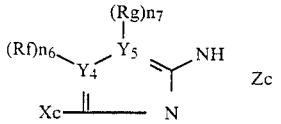

General Formula (c)

[In the above-given general formulas (a), (b) and (c), Za, Zb and Zc represent each a group of non-metal atoms necessary for completing a nitrogen-containing heterocyclic ring, respectively;

Xa, Xb and Xc represent each a hydrogen atom or a group capable of splitting off upon the reaction thereof with the oxidized products of a color developing agent;

Ra, Rb, Rc, Rd, Re, Rf and Rg represent each a hydrogen atom or a substituent, respectively, provided however that Rg represents a substituent incapable of splitting off upon the reaction of the couplers each represented by the general Formula (c) with the oxidized products of the color developing agent;

$Y_1$ represents a carbon atom or a nitrogen atom;

$Y_2$ represents a carbon atom or a hetero atom;

means that the bonding between $Y_1$ and $Y_2$ may be either a single bond or a double bond, provided however that, in the case that $Y_1$ is a carbon atom and the bonding between $Y_1$ and $Y_2$ is a double bond, $n_3$ is 1 and $n_4$ is 0 and Rc is a group incapable of splitting off upon the reaction of the couplers each represented by general formula (a) with the oxidized products of a color developing agent; in the case that $Y_1$ is a carbon atom and the bonding between $Y_1$ and $Y_2$ is a single bond, $n_3$ and $n_4$ are each 1; in the case that $Y_1$ is a nitrogen atom and the bonding between $Y_1$ and $Y_2$ is a double bond, $n_3$ and $n_4$ are each 0; and $Y_2$ is a hetero atom, in the case that $Y_1$ is a nitrogen atom and the bonding between $Y_1$ and $Y_2$ is a single bond, $n_3$ is 1 and $n_4$ is 0; and the couplers represented by general formulas (a), (b) and (c) may be able to couple to the oxidized products of a color developing agent only in the positions where Xa, Xb and Xc are bonded, respectively.]

DETAILED DESCRIPTION OF THE INVENTION

In the silver halide photographic light-sensitive materials, at least one kind of the couplers selected from the group consisting of the couplers represented by the general formulas (a), (b) and (c), respectively, and/or the polymer couplers each induced from the above-mentioned couplers are used.

The couplers of the invention will now be described in detail.

In the magenta couplers represented by the above-given general formulas (a), (b) and (c),

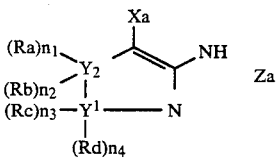

General Formula (a)

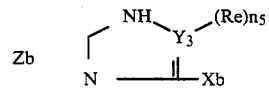

General Formula (b)

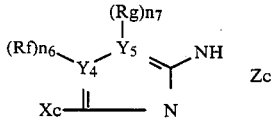

General Formula (c)

Za, Zb and Zc represent each a group of non-metal atoms necessary for completing a nitrogen-containing heterocyclic ring, respectively;

Xa, Xb and Xc represent each a hydrogen atom or a group capable of splitting off upon the reaction thereof with the oxidized products of a color developing agent;

Ra, Rb, Rc, Rd, Re, Rf and Rg represent each a hydrogen atom or a substituent, respectively, provided however that Rg represents a substituent incapable of splitting off upon the reaction of the couplers each represented by the general Formula (c) with the oxidized products of the color developing agent;

$Y_1$ represents a carbon atom or a nitrogen atom;

$Y_2$ represents a carbon atom or a hetero atom;

means that the bonding between $Y_1$ and $Y_2$ may be either a single bond or a double bond, provided however that, in the case that $Y_1$ is a carbon atom and the bonding between $Y_1$ and $Y_2$ is a double bond, $n_3$ is 1 and $n_4$ is 0 and Rc is a group incapable of splitting off upon the reaction of the couplers each represented by general formula (a) with the oxidized products of a color developing agent; in the case that $Y_1$ is a carbon atom and the bonding between $Y_1$ and $Y_2$ is a single bond, $n_3$ and $n_4$ are each 1; in the case that $Y_1$ is a nitrogen atom and the bonding between $Y_1$ and $Y_2$ is a double bond, $n_3$ and $n_4$ are each 0, and $Y_2$ is a hetero atom; and in the case that $Y_1$ is a nitrogen atom and the bonding between $Y_1$ and $Y_2$ is a single bond, $n_3$ is 1 and $n_4$ is 0; and the couplers represented by general formulas (a), (b) and (c) may be able to couple to the oxidized products of a color developing agent only in the positions where Xa, Xb and Xc are bonded, respectively.

The substituents each represented by the above-mentioned Ra, Rb, Rc, Rd, Re or Rf include, for example, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro-compound residual group, a bridged hydrocarbon-compound residual group, an alkoxy group, an aryloxy group, a heterocyclic oxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclic thio group.

The halogen atoms include, for example, a chlorine atom and a bromine atom and, more preferably, the chlorine atom.

The alkyl groups each represented by Ra, Rb, Rc, Rd, Re or Rf include those each having 1 to 32 carbon atoms; the alkenyl and alkinyl groups include those each having 2 to 32 carbon atoms; the cycloalkyl and cycloalkenyl groups include those each having 3 to 12 carbon atoms and, more preferably, those each having 5 to 7 carbon atoms; and the alkyl, alkenyl and alkinyl groups may be either normal-chained or branched.

The above-mentioned alkyl, alkenyl, alkinyl, cycloalkyl and cycloalkenyl groups are allowed to have a substituent [including, for example, an aryl group, a cyano group, a halogen atom, a heterocyclic group, a cycloalkyl group, a cycloalkenyl group, a spiro-compound residual group and a bridged hydrocarbon-compound residual group and, besides the above, the groups each substituting through a carbonyl group, such as an acyl group, a carboxy group, a carbamoyl group, an alkoxycarbonyl group and an aryloxycarbonyl group; the groups each substituting through a hetero atom {including, more typically, those each substituting through an oxygen atom, such as a hydroxy group, an alkoxy group, an aryloxy group, a heterocyclic oxy group, a siloxy group, an acyloxy group, a carbamoyloxy group and so forth; those each substituting through a nitrogen atom, such as a nitro group, an amino group (including a dialkylamino group), a sulfamoylamino group, an alkoxycarbonylamino group, an aryloxycarbonylamino group, an acylamino group, a sulfonamido group, an imido group, a ureido group and so forth; those each substituting through a sulfur atom, such as an alkylthio group, an arylthio group, a heterocyclic thio group, a sulfonyl group, a sulfinyl group, a sulfamoyl group and so forth; those each substituting through a phosphorus atom, such as a phosphonyl group and so forth; and the like.}].

To be more concrete, they include, for example, a methyl group, an ethyl group, an isopropyl group, a t-butyl group, a pentadecyl group, a heptadecyl group, a 1-hexylnonyl group, a 1,1'-dipentylnonyl group, a 2-chloro-t-butyl group, a trifluoromethyl group, a 1-ethoxytridecyl group, a 1-methoxyisopropyl group, a methanesulfonylethyl group, a 2,4-di-t-amylphenoxymethyl group, an anilino group, a 1-phenylisopropyl group, a 3-m-butanesulfonaminophenoxypropyl group, a 3-4'-{α-[4''(p-hydroxybenzenesulfonyl)phenoxy]-dodecanoylamino}phenylpropyl group, a 3-{4'-[α-(2'',4''-di-t-amylphenoxy)butanamido]phenyl}-propyl group, a 4-[α-(o-chlorphenoxy)tetradecaneamido-phenoxy]propyl group, an allyl group, a cyclopentyl group, a cyclohexyl group and so forth.

The aryl groups each represented by Ra, Rb, Rc, Rd, Re or Rf preferably include, for example a phenyl group, and they are allowed to have a substituent such as an alkyl group, an alkoxy group, an acylamino group and so forth.

To be more concrete, they include, for example, a phenyl group, a 4-t-butylphenyl group, a 2,4-di-t-amylphenyl group, a 4-tetradecanamidophenyl group, a hexadesiloxyphenyl group, a 4'-[α-(4''-t-butylphenoxy)tetradecanamido]phenyl group, and so forth.

The heterocyclic groups each represented by Ra, Rb, Rc, Rd, Re or Rf preferably include, for example, those each having a 5-membered to 6-membered ring and they are allowed to be either substituted or condensed. To be more concrete, they include, for example, a 2-furyl group, a 2-thienyl group, a 2-pyrimidinyl group, a 2-benzothiazolyl group and so forth.

The acyl groups each represented by Ra, Rb, Rc, Rd, Re or Rf include, for example, alkylcarbonyl groups such as an acetyl group, a phenylacetyl group, a dodecanoyl group and an α-2,4-di-t-amylphenoxybutanoyl group; arylcarbonyl groups such as a benzoyl group, a 3-pentadecyloxybenzoyl group, and a p-chlorobenzoyl group; and so forth.

The sulfonyl groups each represented by Ra, Rb, Rc, Rd, Re or Rf include, for example, alkylsulfonyl groups such as a methylsulfonyl group and a dodecylsulfonyl group; arylsulfonyl groups such as a benzenesulfonyl group and a p-toluenesulfonyl group; and so forth.

The sulfinyl groups each represented by Ra, Rb, Rc, Rd, Re or Rf include, for example, alkylsulfinyl groups such as an ethylsulfinyl group, an octylsulfinyl group and a 3-phenoxybutylsulfinyl group; arylsulfinyl groups such as a phenylsulfinyl group and a pentadecylphenylsulfinyl group; and so forth.

The phosphonyl groups each represented by Ra, Rb, Rc, Rd, Re or Rf include, for example, alkylphosphonyl groups such as a butyloctylphosphonyl group; alkoxyphosphonyl groups such as an octyloxyphosphonyl group; aryloxyphosphonyl groups such as a phenoxyphosphonyl group; arylphosphonyl groups such as a phenylphosphonyl group; and so forth.

The carbamoyl groups each represented by Ra, Rb, Rc, Rd, Re or Rf may be substituted by an alkyl group, an aryl group including, preferably, a phenyl group or the like, and they include, for example, an N-methylcarbamoyl group, an N,N-dibutylcarbamoyl group, an N-(2-pentadecyloctylethyl)carbamoyl group, an N-ethyl-N-dodecylcarbamoyl group, an N-{3-(2,4-di-t-amylphenoxy)propyl}carbamoyl group and so forth.

The sulfamoyl groups each represented by Ra, Rb, Rc, Rd, Re or Rf may be substituted by an alkyl group, an aryl group including, preferably, a phenyl group or the like, and they include, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group and so forth.

The spiro-compound residual groups each represented by Ra, Rb, Rc, Rd, Re or Rf include, for example, a spiro[3.3]heptane-1-yl and so forth.

The bridged hydrocarbon-compound residual groups each represented by Ra, Rb, Rc, Rd, Re or Rf include, for example, a bicyclo[2.2.1]-heptane-1-yl, a tricyclo[3.3.1.1$^{3,7}$]decane-1-yl, a 7,7-dimethyl-bicyclo[2.2.1-]heptane-1-yl and so forth.

The alkoxy groups each represented by Ra, Rb, Rc, Rd, Re or Rf may be substituted by any of the substituents having been given to the above-mentioned alkyl groups, and they include, for example, a methoxy group, a propoxy group, a 2-ethoxyethoxy group, a pentadecyloxy group, a 2-dodecyloxyethoxy group, a phenethyloxyethoxy group and so forth.

The aryloxy groups each represented by Ra, Rb, Rc, Rd, Re or Rf include, preferably, a phenyloxy group and each of the aryl nuclei thereof may also be substituted by any of the substituents or the atoms having been given to the above-mentioned aryl groups and they include, for example, a phenoxy group, a p-t-butylphenoxy group, a m-pentadecylphenoxy group and so forth.

The heterocyclic oxy groups each represented by Ra, Rb, Rc, Rd, Re or Rf include, preferably, those each having a 5-membered to 7-membered heterocyclic ring and such heterocyclic rings are also allowed to have substituents. They include, for example, a 3,4,5,6-tetrahydropyranyl-2-oxy group and an 1-phenyltetrazole-5-oxy group.

The siloxy groups each represented by Ra, Rb, Rc, Rd, Re or Rf may further be substituted by an alkyl group or the like. They include, for example, a trimethylsiloxy group, a triethylsiloxy group, a dimethylbutylsiloxy group and so forth.

The acyloxy groups each represented by Ra, Rb, Rc, Rd, Re or Rf include, for example, an alkylcarbonyloxy group, an arylcarbonyloxy group and so forth and they are also allowed to have a substituent. They include, typically, an acetyloxy group, an α-chloracetyloxy group, a benzoyloxy group and so forth.

The carbamoyloxy groups each represented by Ra, Rb, Rc, Rd, Re or Rf may also be substituted by an alkyl group, an aryl group or the like. They include, for example, an N-ethylcarbamoyloxy group, an N,N-diethylcarbamoyloxy group, an N-phenylcarbamoyloxy group and so forth.

The amino groups each represented by Ra, Rb, Rc, Rd, Re or Rf may also be substituted by an aryl group including, preferably, a phenyl group or the like. They include, for example, an ethylamino group, an anilino group, a m-chloranilino group, a 3-penta-decyloxycarbonylanilino group, a 2-chloro-5-hexadecanamidoanilino group and so forth.

The acylamino groups each represented by Ra, Rb, Rc, Rd, Re or Rf include, for example, an alkylcarbonylamino group, an arylcarbonylamino group including, preferably, a phenylcarbonylamino group and so forth, and they are further allowed to have a substituent. They typically include, for example, an acetamido group, an α-ethylpropanamido group, an N-phenylacetamido group, a dodecanamido group, a 2,4-di-t-amylphenoxyacetamido group, an α-3-t-butyl-4-hydroxyphenoxybutanamido group and so forth.

The sulfonamido groups each represented by Ra, Rb, Rc, Rd, Re or Rf include, for example, an alkylsulfonylamino group, an arylsulfonylamino group and so forth and, they are allowed to have a substituent. They include, typically, a methylsulfonylamino group, a pentadecylsulfonylamino group, a benzenesulfonamido group, a p-toluenesulfonamido group, a 2-methoxy-5-t-amyl-benzenesulfonamido group and so forth.

The imido groups each represented by Ra, Rb, Rc, Rd, Re or Rf may be of the open-chained or cyclic ones. They include, for example, a succinic imido group, a 3-heptadecylsuccinic imido group, a phthalimido group, a glutarimido group and so forth.

The ureido groups each represented by Ra, Rb, Rc, Rd, Re or Rf may be substituted by an alkyl group, an aryl group including, preferably, a phenyl group or the like. They include, for example, an N-ethylureido group, an N-methyl-N-decylureido group, an N-phenylureido group, an N-p-tolylureido group and so forth.

The sulfamoylamino groups each represented by Ra, Rb, Rc, Rd, Re or Rf may be substituted by an alkyl group, an aryl group including, preferably a phenyl group) and so forth. They include, for example, an N,N-dibutylsulfamoylamino group, an N-methylsulfamoylamino group, an N-phenylsulfamoylamino group and so forth.

The alkoxycarbonylamino groups each represented by Ra, Rb, Rc, Rd, Re or Rf may have a substituent. They include, for example, a methoxycarbonylamino group, a methoxyethoxycarbonylamino group, an octadecyloxycarbonylamino group and so forth.

The aryloxycarbonylamino groups each represented by Ra, Rb, Rc, Rd, Re or Rf may have a substituent. They include, for example, a phenoxycarbonylamino group, a 4-methylphenoxycarbonylamino group and so forth.

The alkoxycarbonylamino groups each represented by Ra, Tb, Tc, Td, Te or Rf may have a substituent. They include, for example, a methoxycarbonyl group, a butyloxycarbonyl group, a dodecyloxycarbonyl group, an octadecyloxycarbonyl group, an ethoxymethoxycarbonyloxy group, a benzyloxycarbonyl group and so forth.

The aryloxycarbonyl groups each represented by Ra, Tb, Tc, Td, Te or Rf may have a substituent. They include, for example, a phenoxycarbonyl group, a p-chlorophenoxycarbonyl group, a m-pentadecyloxyphenoxycarbonyl group and so forth.

The alkylthio groups each represented by Ra, Rb, Rc, Rd, Re or Rf may have a substituent. They include, for example, an ethylthio group, a dodecylthio group, an octadecylthio group, a phenethylthio group and a 3-phenoxypropylthio group.

The arlthio groups each represented by Ra, Rb, Rc, Rd, Te or Rf include, preferably, a phenylthio group and may have a substituent. They include, for example, a phenylthio group, a p-methoxyphenylthio group, a 2-t-octadecylphenylthio group, a 3-octadecylphenylthio group, a 2-carboxyphenylthio group, a p-acetamidophenylthoi group and so forth.

The heterocyclic thio groups each represented by Ra, Rb, Rc, Rd, Re or Rf include, preferably, a 5-membered to 7-membered heterocyclic thio group and may have either a condensed ring or a substituent. They include, for example, a 2-pyridylthio group, a 2-benzothiazolythio group and a 2,4-diphenoxy-1,3,5-triazole-6-thio group.

The substituents which are incapable of splitting off upon reaction of the oxidized products of a color developing agent with the couplers represented by either Rg or Rc having a double bond between a carbon atom represented by $Y_1$ and $Y_2$; such substituents include, for example, an alkyl group, an aryl group, a cycloalkyl group, an alkenyl group, a cycloalkenyl group, an alkinyl group, a heterocyclic group, an acyl group, a sulfonyl group, a sulfinyl group, a phosphonyl group, a carbamoyl group, a sulfamoyl group, a cyano group, a spiro-compound residual group, a bridged hydrocarbon-compound residual group, an alkoxycarbonyl group and an aryloxycarbonyl group.

The typical examples each of the above-mentioned groups include those given to the aforementioned Ra.

The substituents, which are representecd by Xa, Xb and Xc and capable of splitting off upon the reaction thereof with the oxidized products of a color developing agent, include, for example, a halogen atom (such as a chlorine atom, a bromine atom, a fluorine atom and so forth) and, besides, a carbon atom, an oxygen atom, a sulfur atom or a group capable of substituting through a nitrogen atom.

The groups each capable of substituting through a carbon atom may be exemplified as a carboxyl group, a hydroxymethyl group, a triphenylmethyl group and, besides, the groups each represented by the following general formulas, corresponding to Xa, Xb and Xc, respectively:

General formula (a')

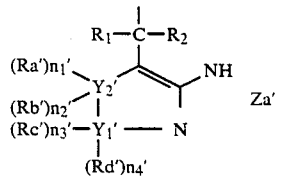

-continued

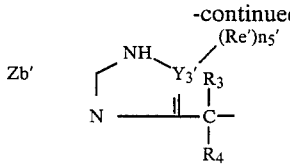

General Formula (b')

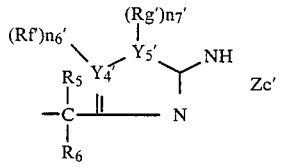

General Formula (c')

wherein Ra' is synonymous with Ra, Rb' with Rb, Rc' with Rc, Rd' with Rd, Re' with Re, Rf' with Rf, Rg' with Rg, $n_1'$ with $n_1$, $n_2'$ with $n_2$, $n_3'$ with $n_3$, $n_4'$ with $n_4$, $n_5'$ with $n_5$, $n_6'$ with $n_6$, $n_7'$ with $n_7$, $Y_1'$ with $Y_1$, $Y_2'$ with $Y_2$, $Y_3'$ with $Y_3$, $Y_4'$ with $Y_4$, $Y_5'$ with $Y_5$, Za' with Za, Zb' with Zb and Zc' with Zc, respectively; and $R_1$ to $R_6$ represent each a hydrogen atom, an aryl group, an alkyl group or a heterocyclic group.

The groups each capable of substituting through an oxygen atom include, for example, an alkoxy group, an aryloxy group, a heterocyclic oxy group, an acyloxy group, a sulfonyloxy group, an alkoxycarbonyloxy group, an aryloxycarbonyloxy group, an alkyloxalyloxy group and an alkoxyoxalyloxy group.

The above-mentioned alkoxy groups are also allowed to have a substituent. They include, for example, an ethoxy group, a 2-phenoxyethoxy group, a 2-cyanoethoxy group, a phenethyloxy group, a p-chlrobenzyloxy group and so forth.

The aryloxy groups include, preferably, a phenoxy group. The aryl groups may also have a substituent. They typically include, for example, a phenoxy group, a 3-methylphenoxy group, a 3-dodecylphenoxy group, a 4-methanesulfonamidophenoxy group, a 4-[α-(3'-pentadecylphenoxy)butanamido]phenoxy group, a hexadecylcarbamoylmethoxy group, a 4-cyanophenoxy group, a 4-methanesulfonylphenoxy group, an 1-naphthyloxy group, a p-methoxyphenoxy group and so forth.

The heterocyclic oxy groups include preferably a 5-membered to 7-membered heterocyclic oxy group and may have either a condensed ring or a substituent. They typically include, for example, an 1-phenyltetrazolyloxy group, a 2-benzothiazolyloxy group and so forth.

The acyloxy groups include, for example, alkylcarbonyloxy groups such as an acetoxy group, a buthylyloxy group and so forth, alkenylcarbonyloxy groups such as a cinnamoyloxy group, and arylcarbonyloxy groups such as a benzoyloxy group.

The sulfonyloxy groups include, for example, a butanesulfonyloxy group and a methanesulfonyloxy group.

The alkoxycarbonyloxy groups include, for example, an ethoxycarbonyloxy group and a benzyloxycarbonyloxy group.

The aryloxycarbonyloxy groups include, for example, a phenoxycarbonyloxy group and so forth.

The alkyloxalyloxy groups include, for example, a methyloxalyloxy group.

The alkoxyoxalyloxy groups include, for example, an ethoxyoxalyloxy group and so forth.

The groups each capable of substituting through a sulfur atom include, for example, an alkylthio group, an arylthio group, a heterocyclic thio group and an alkyloxythiocarbonylthio group.

The alkylthio groups include, for example, a phenylthio group, a 4-methanesulfonamidophenylthio group, a 4-dodecylphenethylthio group, a 4-nonafluoropentanamidophenethylthio group, a 4-carboxyphenylthio group, a 2-ethoxy-5-t-butylphenylthio group and so forth.

The heterocyclic thio groups include, for example, an 1-phenyl-1,2,3,4-tetrazolyl-5-thio group, 2-benzothiazolylthio group and so forth.

The alkyloxythiocarbonylthio groups include, for example, a dodecyloxythiocarbonylthio group and so forth.

The groups each capable of substituting through a nitrogen atom include, for example, those represented by the formula

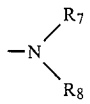

in which $R_7$ and $R_8$ represent each a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group and, $R_7$ and $R_8$ may be bonded each other to complete a heterocyclic ring, provided that $R_7$ and $R_8$ are never hydrogen atoms at the same time.

The alkyl groups may be either straight-chained or branched and they are preferably those each having 1 to 22 carbon atoms. They are also allowed to have such a substituent as an aryl group, an alkoxy group, an aryloxy group, an alkylthio group, an arylthio group, an alkylamino group, an arylamino group, an acylamino group, a sulfonamido group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryloxycarbonylamino group, a hydroxyl group, a carboxyl group, a cyano group and a halogen atom. The typical examples of the alkyl groups include an ethyl group, an actyl group, a 2-ethylhexyl group and 2-chlorethyl group.

The aryl groups each represented by $R_7$ or $R_8$ include, for example, those each having 6 to 32 carbon atoms and, more preferably, a phenyl group and a naphthyl group. The aryl groups are also allowed to have such a substituent as those given to the above-mentioned alkyl groups each represented by $R_7$ or $R_8$ and an alkyl group. The examples of the aryl groups typically include a phenyl group, an 1-naphthyl group and a 4-methylsulfonylphenyl group.

The heterocyclic groups each represented by $R_7$ or $R_8$ preferably include those of the 5- or 6-membered and they are allowed to have a condensed ring or a substituent. The typical examples thereof include a 2-fulyl group, a 2-quinolyl group, a 2-pyrimidyl group, a 2-benzothiazolyl group, a 2-pyridyl group and so forth.

The sulfamoyl groups each represented by $R_7$ or $R_8$ include, for example, an N-alkylsulfamoyl group, an N,N-dialkylsulfamoyl group, an N-arylsulfamoyl group, an N,N-diarylsulfamoyl group and so forth. These alkyl and aryl groups are allowed to have the substituent given to the aforementioned alkyl and aryl groups. The sulfamoyl groups typically include, for example, an N,N-diethylsulfamoyl group, an N-methylsulfamoyl group, an N-dodecylsulfamoyl group, an N-p-tolylsulfamoyl group.

The carbamoyl groups each represented by $R_7$ or $R_8$ include, for example, an N-alkylcarbamoyl group, an N,N-dialkylcarbamoyl group, an N-arylcarbamoyl group, an N,N-diarylcarbamoyl group and so forth. These alkyl and aryl groups may also have the substituents each given to the aforegiven alkyl and aryl groups. The carbamoyl groups include, typically, an N,N-diethylcarbamoyl group, an N-methylcarbamoyl group, an N-dodecylcarbamoyl group, an N-p-cyanophenylcarbamoyl group and an N-p-tolylcarbamoyl group.

The acyl groups each represented by $R_7$ or $R_8$ include, for example, an alkylcarbonyl group, an arylcarbonyl group and a heterocyclic carbonyl group. The alkyl, aryl and heterocyclic groups each may have a substituent. Such acyl groups include, typically, a hexafluorobutanoyl group, a 2,3,4,5,6-pentafluorobenzoyl group, an acetyl group, a benzoyl group, a naphthoyl group, a 2-furylcarbonyl group and so forth.

The sulfonyl groups each represented by $R_7$ or $R_8$ include, for example, an alkylsulfonyl group, an arylsulfonyl group and a heterocyclic sulfonyl group. They are also allowed to have a substituent. They include, typically, an ethanesulfonyl group, a benzenesulfonyl group, an octanesulfonyl group, a naphthalenesulfonyl group, a p-chlorobenzenesulfonyl group and so forth.

The aryloxycarbonyl groups each represented by $R_7$ or $R_8$ are allowed to have the substituents each given to the aforementioned aryl groups. They include, typically, a methoxycarbonyl group, a dodecyloxycarbonyl group, a benzyloxycarbonyl group and so forth.

The heterocyclic rings completed by bonding $R_7$ and $R_8$ each other include, preferably, those each having a 5- or 6-membered ring and they are allowed to be either saturated or unsaturated, either aromatic or non-aromatic, and they may further be condensed rings.

The heterocyclic groups include, for example, an N-phthalimido group, an N-succininido group, a 4-N-urazolyl group, a 1-N-hydantoinyl group, a 3-N-2,4-dioxoxazolidinyl group, a 2-N-1,1-dioxo-3-(2H)-oxo-1,2-benzthiazolyl group, a 1-pyrrolyl group, a 1-pyrrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyridone group, a phthalazinedione group, a 2-oxo-1-piperidinyl group and so forth.

These heterocyclic groups each may be substituted with an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, a ureido group, an alkoxycarbonyl group, an aryloxycarbonyl group, an imido group, a nitro group, a cyano group, a carboxyl group, a halogen atom and so forth.

The nitrogen-containing heterocyclic rings each completed by Za, Zb, Zc, Za', Zb' or Zc' include, for example, a pyrrole ring, a pyrazole ring, an imidazole ring, a triazole ring, a thiazoline ring, an oxazoline ring, a tetrazole ring or the like.

The hetero atoms each represented by $Y_2$ may be exemplified by a nitrogen atom.

The typical examples of the substituents each of which the nitrogen-containing heterocyclic rings completed by Za, Zb, Zc, Za', Zb' or Zc' are allowed to have include, for example, the substituents exemplified for Ra.

For example, in the formulas (a-1) to (a-11), (b-1) to (b-8) and (c-1) to (c-14) which will be given later, when none of the above-mentioned substituents is present in such a position as shown the positions whereto $R_{52}$, $R_{54}$, $R_{58}$, $R_{60}$, $R_{63}$ to $R_{75}$, $R_{77}$, $R_{79}$, $R_{83}$, $R_{85}$ and $R_{88}$ to $R_{90}$ are bonded, the groups each incapable of splitting off upon the reaction thereof with the oxidized products of a color developing agent are substituted to the positions each having a coupling function.

In General Formulas (a) through (c), the substituents each incapable of splitting off upon the reaction thereof with the oxidized products of a color developing agent including, for example, a carbon or nitrogen atom to which either one of Ra to Ri, $R_{11}$ to $R_{42}$ and $R_{51}$ to $R_{88}$ is bonded may have the parts having one of the following formulas:

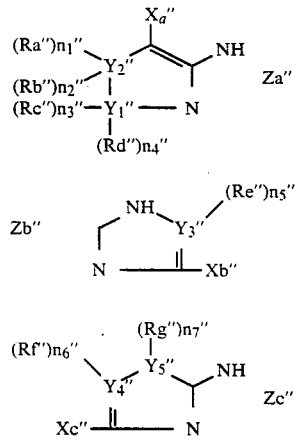

(wherein Ra'' is synonymous with Ra and, similarly, Rb'' with Rb, Rc'' with Rc, Rd'' with Rd, Re'' with Re, Rf'' with Rf, Rg'' with Rg, $n_1''$ with $n_1$, $n_2''$ with $n_2$, $n_3''$ with $n_3$, $n_4''$ with $n_4$, $n_5''$ with $n_5$, $n_6''$ with $n_6$, $n_7''$ with $n_7$, $Y_1''$ with $Y_1$, $Y_2''$ with $Y_2$, $Y_3''$ with $Y_3$, $Y_4''$ with $Y_4$, $Y_5''$ with $Y_5$, Za'' with Za, Zb'' with Zb, and Zc'' with Zc, respectively), and the invention includes the so-called bis-type couplers, as the matter of course.

The polymer couplers each induced from the couplers represented by General Formula (a), (b) or (c) include, for example, thue polymers each independently polymerized with a monomer having a coupler part represented by the formula (a), (b) or (c) and, more preferably, those independently polymerized with a monomer having an ethylene-unsaturated double bond, or the copolymers each copolymerized with other monomers.

The typical couplers each represented by General Formula (a), (b) or (c) may be exemplified below:

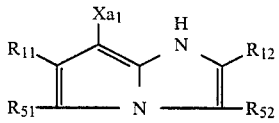
General Formula (a-1)

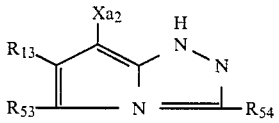
General Formula (a-2)

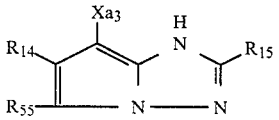
General Formula (a-3)

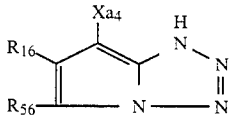
General Formula (a-4)

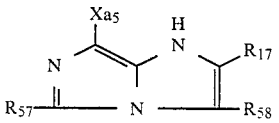
General Formula (a-5)

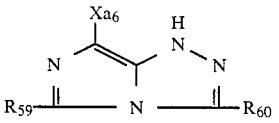
General Formula (a-6)

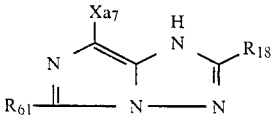
General Formula (a-7)

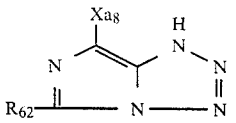
General Formula (a-8)

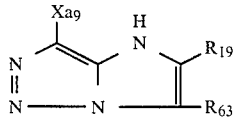
General Formula (a-9)

-continued

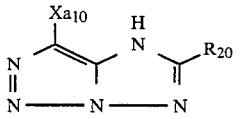
General Formula (a-10)

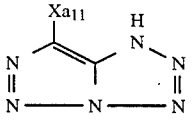
General Formula (a-11)

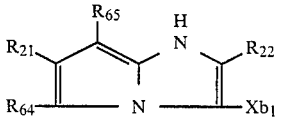
General Formula(b-1)

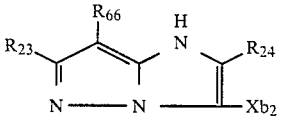
General Formula (b-2)

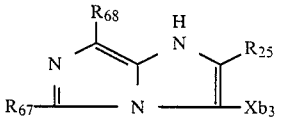
General Formula (b-3)

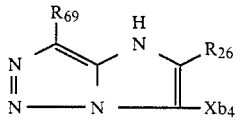
General Formula (b-4)

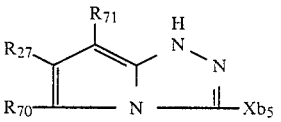
General Formula (b-5)

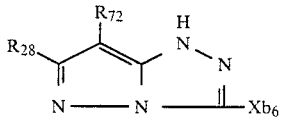
General Formula (b-6)

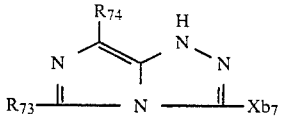
General Formula (b-7)

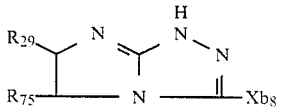
General Formula (b-8)

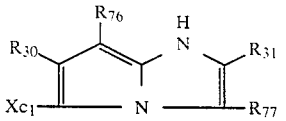
General Formula (c-1)

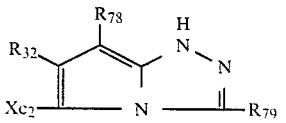
General Formula (c-2)

-continued

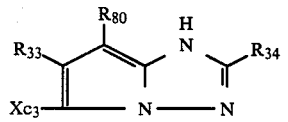

General Formula (c-3)

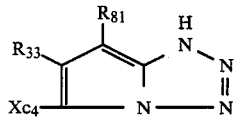

General Formula (c-4)

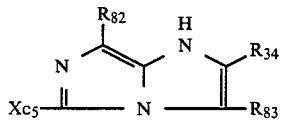

General Formula (c-5)

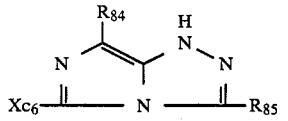

General Formula (c-6)

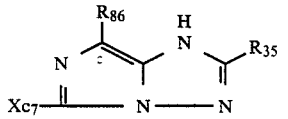

General Formula (c-7)

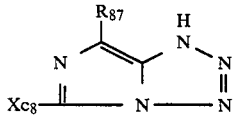

General Formula (c-8)

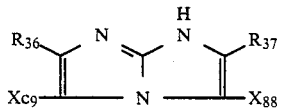

General Formula (c-9)

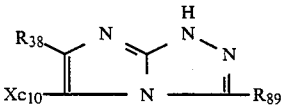

General Formula (c-10)

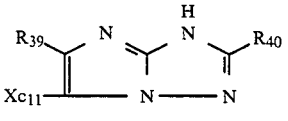

General Formula (c-11)

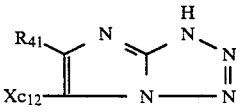

General Formula (c-12)

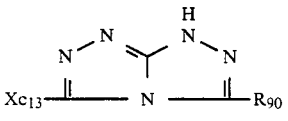

General Formula (c-13)

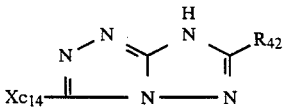

General Formula (c-13)

In the formulas (a-1) through (c-14), $Xa_1$ to $Xa_{11}$ are synonymous with Xa and, similarly, $Xb_1$ to $Xb_8$ with Xb, $Xc_1$ to $Xc_{14}$ with Xc, $R_{11}$ to $R_{20}$ with Ra, $R_{51}$ to $R_{63}$ with Rg, $R_{21}$ to $R_{29}$ with $R_e$, $R_{64}$ to $R_{75}$ with Rg, $R_{30}$ to $R_{42}$ with $R_f$, and $R_{76}$ to $R_{90}$ with Rg, respectively. The same kinds of the couplers may be exemplified.

The compounds represented by each of the formulas and the compounds exemplified later also include the tautomers thereof, respectively. Among the compounds represented by the formulas (a) through (c), the preferably compounds are those represented by the formulas (a-2), (a-3), (a-4), (b-1), (b-3), (b-4), (c-2), (c-3), (c-4), (c-9), (c-10) and (c-12) and, more preferably, those represented by (a-3), (b-1), (c-3), (c-9) and (c-10).

Out of the compounds represented by the above-given formulas, the preferable substituents to heterocyclic rings, such as those represented by Ra to Rg, $R_{11}$ to $R_{42}$, and $R_{51}$ to $R_{90}$ will now be described below:

When the couplers relating to the invention are used for forming positive images, it is preferred that the following requirement 1 may be satisfied by using the substituents of carbon atom which is adjacent to a carbon atom bonded to one of Xa to Xc, $Xa_1$ to $Xa_{11}$, $Xb_1$ to $Xb_8$ and $Xc_1$ to $Xc_{14}$.

It is more preferred that the requirements 1 and 2 may be satisfied thereby.

It is particularly preferred that the requirements 1, 2 and 3 may be satisifed thereby.

Requirement 1: The root atom directly bonded to a heterocyclic ring is to be a carbon atom, Requirement 2: Only one or none of hydrogen atoms is to be bonded to the carbon atom, and Requirement 3: Every bonding between the carbon atom and its adjacent atom is to be a single bond.

The most preferable substituents on the above-mentioned heterocyclic rings are those represented by the following general formula:

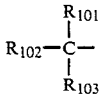

General Formula wherein $R_{101}$, $R_{102}$ and $R_{103}$ represent each a hydrogen atom, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro-compound residual group, a bridged hydrocarbon-compound residual group, an alkoxy group, an aryloxy group, a heterocyclic oxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group, provided however that at least two of the $R_{101}$, $R_{102}$ and $R_{103}$ are not to be hydrogen atoms.

In addition, any two of the above-mentioned $R_{101}$, $R_{102}$ and $R_{103}$, such as $R_{101}$ and $R_{102}$, may be so bonded to each other as to complete a saturated or unsaturated ring such as a cycloalkane, cycloalkene or heterocyclic ring and, further, $R_{103}$ may be so bonded to one of the above-mentioned rings as to complete a bridged hydrocarbon-compound residual group.

The groups each represented by $R_{101}$ through $R_{103}$ are allowed to have a substituent, and the typical groups each represented by $R_{101}$ through $R_{103}$ and the substituents thereof include, for example, the typical examples of the groups each represented by Ra denoted in the aforegiven general formula (a) and the substituents thereof.

The typical rings completed by bonding $R_{101}$ to $R_{102}$ and the typical bridged hydrocarbon-compound residual groups formed by $R_{101}$ through $R_{103}$ and the substituents thereof include, for example, the typical examples of the cycloalkyl, cycloalkenyl, heterocyclic and bridged hydrocarbon-compound residual groups each represented by Ra denoted in the aforegiven general formula (a) and the substituents thereof.

The preferable cases embodied in the aforegiven general formula include, for example, (i) a case that any two of $R_{101}$ through $R_{103}$ are alkyl groups, and (ii) a case that one of $R_{101}$ through $R_{103}$, such as $R_{103}$, is a hydrogen atom, and the rest are so bonded to each other as to complete a cycloalkyl, together with the root atom.

Among the case (i), it is preferable that any two of $R_{101}$ through $R_{103}$ are alkyl groups and the rest is a hydrogen atom or an alkyl group.

The above-mentioned alkyl and cycloalkyl groups each are further allowed to have a substituent, and the typical examples of the alkyl and cycloalkyl groups and the substituents thereof include the typical examples of the alkyl and cycloalkyl groups each represented by Ra denoted in the aforegiven general formula (a) and the substituents thereof.

It is preferable that at least one of the substituents such as Ra to Rg, $R_{11}$ to $R_{42}$ and $R_{51}$ to $R_{90}$ on the heterocyclic rings is represented by the following general formula:

$$-R^1-SO_2-R^2 \qquad \text{General Formula}$$

wherein $R^1$ represents an alkylene group, and $R^2$ represents an alkyl group, a cycloalkyl group or an aryl group, The preferable alkylene groups each represented by $R^1$ have two or more carbon atoms in the straight chained part thereof, and the more preferable ones have 3 to 6 carbon atoms but they are regardless of straight or branched chain. Such alkylene groups each are further allowed to have a substituent.

In the case that Ra in the aforegiven general formula (a) represents an alkyl group, the above-mentioned substituents include, for example, those which the alkyl groups are allowed to have.

The preferable substituents include, for example, a phenyl group.

The preferable examples of the alkylene groups each represented by $R^1$ will be given below:

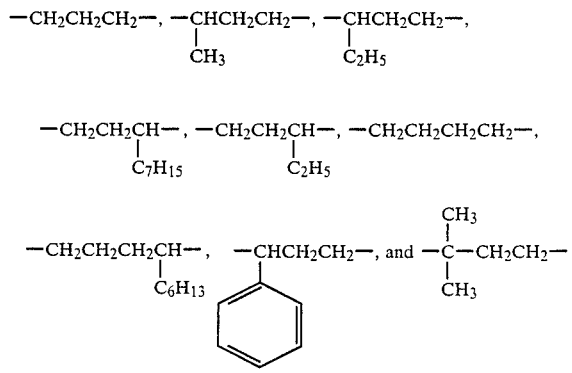

The alkyl groups each represented by $R^2$ may be either straight-chained or branched.

Such alkyl groups include, typically, a methyl group, a propyl group, an iso-propyl group, a butyl group, a 2-ethylhexyl group, an octyl group, a dodecyl group, a tetradecyl group, a hexadecyl group, an octadecyl group, a 2-hexyldecyl group and so forth.

The preferable cycloalkyl groups each represented by $R^2$ are those each having a 5- or 6-membered ring, and they include, for example, a cyclohexyl group.

The alkyl and cycloalkyl groups each represented by $R^2$ are allowed to have a substituent which include, for example, the exemplified substituents to the aforegiven $R^1$.

The aryl groups each represented by $R^2$ include, typically, phenyl and naphthyl groups. Such aryl groups each are allowed to have a substituent. Such substituents include, for example, straight-chained or branched alkyl groups and, besides, the exemplified substituents given as those to the aforegiven $R^1$.

If there are two or more substituents, they may be the same with or the different from each other.

When the couplers relating to the invention are used for forming negative images, it is preferred that the following requirement 1 may be satisfied by using the substituents of carbon atom which is adjacent to a carbon atom bonded to one of Xa to Xc, $X_{a1}$ to $X_{a11}$, $X_{b1}$ to $X_{b8}$ and $X_{c1}$ to $X_{c14}$.

It is more preferred that the requirements 1 and 2 may be satisfied thereby.

Requirement 1: The root atom directly bonded to a heterocyclic ring is to be a carbon atom, Requirement 2: At least two hydrogen atoms are to be bonded to the carbon atom.

The most preferable substituents on the above-mentioned heterocyclic rings are those represented by the following general formula:

$$R_{104}-CH_2- \qquad \text{General Formula}$$

wherein $R_{104}$ represents a hydrogen atom, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro-compound residual group, a bridged hydrocarbon-compound residual group, an alkoxy group, an aryloxy group, a heterocyclic oxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

The groups each represented by $R_{104}$ are allowed to have a substituent, and the typical groups each represented by $R_{104}$ and the substituents thereof include, for example, the typical examples of the groups each represented by Ra denoted in the aforegiven general formula (a) and the substituents thereof.

The preferable ones for $R_{104}$ include, for example, a hydrogen atom or an alkyl group.

The typical examples of the compounds which may be used in the invention will now be given as follows:

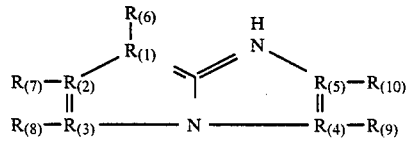

| Compound | $R_{(1)}$ | $R_{(2)}$ | $R_{(3)}$ | $R_{(4)}$ | $R_{(5)}$ | $R_{(6)}$ | $R_{(7)}$ | $R_{(8)}$ | $R_{(9)}$ | $R_{(10)}$ |
|---|---|---|---|---|---|---|---|---|---|---|
| 1 | C | C | C | C | C | H | 1 | 1 | 9 | 1 |
| 2 | C | C | C | C | C | 112 | 5 | 1 | 51 | 1 |
| 3 | C | C | C | C | N | H | 1 | 1 | 22 | — |
| 4 | C | C | C | C | N | 112 | 1 | 1 | 22 | — |
| 5 | C | C | C | N | C | 173 | 1 | 1 | — | 1 |
| 6 | C | C | C | N | C | H | 1 | 1 | — | 72 |
| 7 | C | C | C | N | C | 112 | 5 | 97 | — | 1 |
| 8 | C | C | C | N | C | 112 | 72 | 100 | — | 1 |
| 9 | C | C | C | N | C | 112 | 58 | 98 | — | 51 |
| 10 | C | C | C | N | C | 112 | 73 | 100 | — | 1 |
| 11 | C | C | C | N | C | 112 | 11 | 81 | — | 56 |
| 12 | C | C | C | N | C | 174 | 5 | 97 | — | 1 |
| 13 | C | C | C | N | C | 180 | 5 | 97 | — | 1 |
| 14 | C | C | C | N | C | 183 | 5 | 97 | — | 1 |
| 15 | C | C | C | N | C | 146 | 5 | 97 | — | 1 |
| 16 | C | C | C | N | C | 147 | 5 | 97 | — | 1 |
| 17 | C | C | C | N | C | 156 | 5 | 97 | — | 1 |
| 18 | C | C | C | N | C | 157 | 5 | 97 | — | 1 |
| 19 | C | C | C | N | C | 162 | 5 | 97 | — | 1 |
| 20 | C | C | C | N | C | 148 | 5 | 97 | — | 1 |
| 21 | C | C | C | N | C | 133 | 5 | 97 | — | 1 |
| 22 | C | C | C | N | C | 131 | 5 | 97 | — | 1 |
| 23 | C | C | C | N | C | 122 | 5 | 97 | — | 1 |
| 24 | C | C | C | N | C | 112 | 1 | 72 | — | 1 |
| 25 | C | C | C | N | C | 112 | 51 | 93 | — | 11 |
| 26 | C | C | C | N | C | 112 | 1 | 181 | — | 1 |
| 27 | C | C | C | N | C | 175 | 1 | 1 | — | 121 |
| 28 | C | C | C | N | C | 112 | 126 | 91 | — | 1 |
| 29 | C | C | C | N | C | 112 | 128 | 91 | — | 1 |
| 30 | C | C | C | N | C | 112 | 134 | 91 | — | 1 |
| 31 | C | C | C | N | C | 112 | 129 | 91 | — | 1 |
| 32 | C | C | C | N | C | 112 | 130 | 91 | — | 1 |
| 33 | C | C | C | N | N | H | 62 | 1 | — | — |
| 34 | C | C | C | N | N | 112 | 12 | 51 | — | — |
| 35 | C | N | C | C | C | H | — | 1 | 51 | 51 |
| 36 | C | N | C | C | C | 112 | — | 11 | 1 | 1 |
| 37 | C | N | C | C | N | 112 | — | 1 | 72 | — |
| 38 | C | N | C | C | N | H | — | 1 | 22 | — |
| 39 | C | N | C | N | C | H | — | 1 | — | 67 |
| 40 | C | N | C | N | C | 112 | — | 1 | — | 63 |
| 41 | C | N | C | N | N | H | — | 41 | — | — |
| 42 | C | N | C | N | N | 112 | — | 41 | — | — |
| 43 | C | N | N | C | C | H | — | — | 11 | 141 |
| 44 | C | N | N | C | C | 145 | — | — | 11 | 1 |
| 45 | C | N | N | N | C | H | — | — | — | 8 |
| 46 | C | N | N | N | C | 112 | — | — | — | 11 |
| 47 | C | N | N | N | N | H | — | — | — | — |
| 48 | C | N | N | N | N | 123 | — | — | — | — |
| 49 | C | C | C | C | C | 1 | 1 | 1 | H | 9 |
| 50 | C | C | C | C | C | 1 | 1 | 51 | 112 | 9 |
| 51 | C | C | C | C | C | 100 | H | 93 | H | H |
| 52 | C | C | C | C | C | 100 | H | 93 | 112 | H |
| 53 | C | C | C | C | C | 1 | 64 | 81 | 112 | 1 |
| 54 | C | C | C | C | C | 1 | 64 | 81 | 112 | 5 |
| 55 | C | C | C | C | C | 81 | 68 | 20 | 113 | H |
| 56 | C | C | C | C | C | 72 | 7 | 81 | 150 | 1 |
| 57 | C | C | C | C | C | 72 | 7 | 95 | 183 | 1 |
| 58 | C | C | C | C | C | 95 | 65 | 1 | 112 | 51 |
| 59 | C | C | C | C | C | 51 | 66 | 81 | 112 | 41 |

-continued

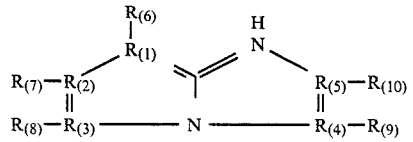

| Compound | $R_{(1)}$ | $R_{(2)}$ | $R_{(3)}$ | $R_{(4)}$ | $R_{(5)}$ | $R_{(6)}$ | $R_{(7)}$ | $R_{(8)}$ | $R_{(9)}$ | $R_{(10)}$ |
|---|---|---|---|---|---|---|---|---|---|---|
| 60 | C | C | C | C | C | 100 | H | 94 | 112 | 1 |
| 61 | C | C | C | C | C | 100 | H | 94 | 113 | 1 |
| 62 | C | C | C | C | C | 100 | H | 94 | 156 | 1 |
| 63 | C | C | C | C | C | 100 | H | 94 | 153 | 1 |
| 64 | C | C | C | C | C | 100 | H | 94 | 176 | 1 |
| 65 | C | C | C | C | C | 100 | H | 94 | 184 | 1 |
| 66 | C | C | C | C | C | 100 | H | 94 | 158 | 1 |
| 67 | C | C | C | C | C | 100 | H | 94 | 155 | 1 |
| 68 | C | C | C | C | C | 100 | H | 94 | 122 | 1 |
| 69 | C | C | C | C | C | 100 | H | 94 | 131 | 1 |
| 70 | C | C | C | C | C | 95 | 36 | 1 | 112 | 1 |
| 71 | C | C | C | C | C | 51 | 24 | 81 | 112 | 1 |
| 72 | C | C | N | C | C | 81 | 5 | — | H | 1 |
| 73 | C | C | C | C | C | 100 | 58 | — | H | 5 |
| 74 | C | C | C | C | C | 81 | H | — | H | 5 |
| 75 | C | C | C | C | C | 95 | H | — | H | 5 |
| 76 | C | C | C | C | C | 100 | H | — | H | 5 |
| 77 | C | C | N | C | C | 100 | 58 | — | 150 | 5 |
| 78 | C | C | N | C | C | 100 | 59 | — | H | 5 |
| 79 | C | C | N | C | C | 100 | 57 | — | 112 | 5 |
| 80 | C | C | N | C | C | 100 | 58 | — | 112 | 5 |
| 81 | C | C | N | C | C | 100 | 58 | — | H | 1 |
| 82 | C | C | N | C | C | 100 | 58 | — | H | 51 |
| 83 | C | C | N | C | C | 100 | 51 | — | H | 58 |
| 84 | C | C | N | C | C | 81 | 69 | — | 150 | 1 |
| 85 | C | C | N | C | C | 81 | 51 | — | 150 | 127 |
| 86 | C | C | N | C | C | 70 | 121 | — | 112 | 121 |
| 87 | C | C | N | C | C | 81 | 65 | — | 124 | 1 |
| 88 | C | N | C | C | C | 1 | — | 11 | H | 1 |
| 89 | C | N | C | C | C | 2 | — | 11 | 112 | 5 |
| 90 | C | N | N | C | C | 72 | — | — | H | 1 |
| 91 | C | N | N | C | C | 22 | — | — | 112 | 5 |
| 92 | C | C | C | C | N | 103 | 1 | 1 | 151 | — |
| 93 | C | C | C | C | N | 101 | 1 | 51 | H | — |
| 94 | C | C | N | C | N | 102 | 5 | — | H | — |
| 95 | C | C | N | C | N | 100 | 11 | — | 112 | — |
| 96 | C | C | N | C | N | 100 | 1 | — | 112 | — |
| 97 | C | C | N | C | N | 100 | 3 | — | H | — |
| 98 | C | N | C | C | N | 1 | — | 61 | H | — |
| 99 | C | N | C | C | N | 32 | — | 1 | 112 | — |
| 100 | N | C | C | C | N | — | 9 | 1 | H | — |
| 101 | N | C | C | C | N | — | 1 | 72 | 112 | — |
| 102 | C | C | C | C | C | 11 | 1 | 112 | 1 | 1 |
| 103 | C | C | C | C | C | 1 | 1 | H | 51 | 51 |
| 104 | C | C | C | C | N | 1 | 1 | H | 25 | — |
| 105 | C | C | C | C | N | 1 | 5 | 112 | 33 | — |
| 106 | C | C | C | N | C | 1 | 1 | H | — | 72 |
| 107 | C | C | C | N | C | 1 | 5 | 112 | — | 61 |
| 108 | C | C | C | N | C | 1 | 1 | 113 | — | 2 |
| 109 | C | C | C | N | C | 99 | 72 | 112 | — | 51 |
| 110 | C | C | C | N | C | 96 | 5 | 112 | — | 51 |
| 111 | C | C | C | N | C | 91 | 72 | 112 | — | 1 |
| 112 | C | C | C | N | C | 91 | 72 | 111 | — | 1 |
| 113 | C | C | C | N | C | 91 | 72 | 179 | — | 1 |
| 114 | C | C | C | N | C | 91 | 72 | 172 | — | 1 |
| 115 | C | C | C | N | C | 91 | 72 | 184 | — | 1 |
| 116 | C | C | C | N | C | 91 | 72 | 149 | — | 1 |
| 117 | C | C | C | N | C | 91 | 72 | 153 | — | 1 |
| 118 | C | C | C | N | C | 91 | 72 | 154 | — | 1 |
| 119 | C | C | C | N | C | 91 | 72 | 125 | — | 1 |
| 120 | C | C | C | N | N | 1 | 126 | H | — | — |
| 121 | C | C | C | N | N | 100 | 11 | 112 | — | — |
| 122 | C | N | C | C | C | 51 | — | H | 1 | 1 |
| 123 | C | N | C | C | C | 51 | — | 112 | 1 | 1 |
| 124 | C | N | C | C | N | 1 | — | H | 12 | — |
| 125 | C | N | C | C | N | 3 | — | 171 | 21 | — |
| 126 | C | N | C | N | C | 8 | — | H | — | 56 |
| 127 | C | N | C | N | C | 8 | — | 112 | — | 56 |
| 128 | C | N | C | N | N | 55 | — | H | — | — |
| 129 | C | N | C | N | N | 55 | — | 172 | — | — |
| 130 | N | C | C | C | C | — | 5 | H | 1 | 1 |
| 131 | N | C | C | C | C | — | 11 | 112 | 1 | 1 |

-continued

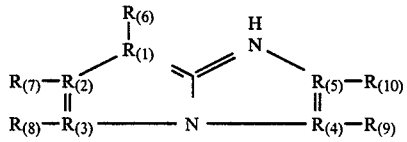

| Compound | R(1) | R(2) | R(3) | R(4) | R(5) | R(6) | R(7) | R(8) | R(9) | R(10) |
|---|---|---|---|---|---|---|---|---|---|---|
| 132 | N | C | C | C | C | — | 51 | H | 51 | 51 |
| 133 | N | C | C | C | C | — | 1 | 112 | 51 | 51 |
| 134 | N | C | C | C | C | — | 71 | 112 | 51 | 51 |
| 135 | N | C | C | C | C | — | 8 | 150 | 51 | 51 |
| 136 | N | C | C | C | C | — | 51 | 112 | 51 | 51 |
| 137 | N | C | C | C | C | — | H | 180 | 51 | 51 |
| 138 | N | C | C | C | C | — | 1 | 112 | 60 | 60 |
| 139 | N | C | C | C | C | — | 72 | 112 | 1 | 1 |
| 140 | N | C | C | C | C | — | 3 | 112 | 51 | 51 |
| 141 | N | C | C | C | C | — | 5 | 112 | 51 | 51 |
| 142 | N | C | C | C | C | — | 5 | 122 | 51 | 51 |
| 143 | N | C | C | C | C | — | 1 | 112 | 51 | 1 |
| 144 | N | C | C | C | C | — | 41 | 112 | 51 | 51 |
| 145 | N | C | C | C | C | — | 53 | 113 | 51 | 51 |
| 146 | N | C | C | C | C | — | 65 | 112 | 1 | 1 |
| 147 | N | C | C | C | C | — | 54 | 112 | 51 | 51 |
| 148 | N | C | C | C | C | — | 4 | 112 | 4 | H |
| 149 | N | C | C | C | C | — | 1 | H | 1 | H |
| 150 | N | C | C | C | C | — | 13 | 112 | 13 | H |
| 151 | N | C | C | C | C | — | 15 | 112 | 15 | H |
| 152 | N | C | C | C | C | — | 8 | 112 | 8 | H |
| 153 | N | C | C | C | C | — | 5 | 182 | 6 | H |
| 154 | N | C | C | C | N | — | 1 | 112 | 92 | — |
| 155 | N | C | C | C | N | — | 5 | H | 36 | — |
| 156 | N | C | C | C | N | — | 5 | 112 | 26 | — |
| 157 | N | C | C | C | N | — | 5 | 112 | 27 | — |
| 158 | N | C | C | C | N | — | 5 | 112 | 36 | — |
| 159 | N | C | C | C | N | — | 51 | H | 31 | — |
| 160 | N | C | C | C | N | — | 5 | 112 | 34 | — |
| 161 | N | C | C | C | N | — | 58 | H | 1 | — |
| 162 | N | C | C | C | N | — | 51 | 112 | 1 | — |
| 163 | N | C | C | C | N | — | 51 | 177 | 1 | — |
| 164 | N | C | C | C | N | — | 5 | H | 12 | — |
| 165 | N | C | C | C | N | — | 5 | 112 | 12 | — |
| 166 | N | C | C | C | N | — | 1 | 112 | 12 | — |
| 167 | N | C | C | C | N | — | 3 | 112 | 27 | — |
| 168 | N | C | C | C | N | — | 41 | 112 | 28 | — |
| 169 | N | C | C | C | N | — | 1 | 173 | 92 | — |
| 170 | N | C | C | C | N | — | 1 | 111 | 4 | — |
| 171 | N | C | C | C | N | — | 5 | 151 | 26 | — |
| 172 | N | C | C | C | N | — | 5 | 122 | 27 | — |
| 173 | N | C | C | C | N | — | 5 | 132 | 36 | — |
| 174 | N | C | C | C | N | — | 5 | H | 30 | — |
| 175 | N | C | C | C | N | — | 5 | 112 | 29 | — |
| 176 | N | C | C | C | N | — | 5 | 112 | 30 | — |
| 177 | N | C | C | C | N | — | 5 | 112 | 19 | — |
| 178 | N | C | C | C | N | — | 5 | 112 | 18 | — |
| 179 | N | C | C | C | N | — | 5 | 112 | 16 | — |
| 180 | N | C | C | C | N | — | 5 | 183 | 29 | — |
| 181 | N | C | C | C | N | — | 5 | 171 | 30 | — |
| 182 | N | C | C | C | N | — | 5 | 160 | 19 | — |
| 183 | N | C | C | C | N | — | 5 | 159 | 18 | — |
| 184 | N | C | C | C | N | — | 5 | 144 | 16 | — |
| 185 | N | C | C | C | N | — | 41 | H | 26 | — |
| 186 | N | C | C | C | N | — | 41 | 112 | 23 | — |
| 187 | N | C | C | C | N | — | 41 | H | 36 | — |
| 188 | N | C | C | C | N | — | 41 | 112 | 35 | — |
| 189 | N | C | C | C | N | — | 41 | 152 | 17 | — |
| 190 | N | C | C | N | C | — | 51 | H | — | 51 |
| 191 | N | C | C | N | C | — | 58 | H | — | 51 |
| 192 | N | C | C | N | N | — | 112 | H | — | — |
| 193 | N | C | C | N | N | — | 11 | 12 | — | — |
| 194 | N | N | C | C | N | — | — | H | 10 | — |
| 195 | N | N | C | C | N | — | — | 142 | 14 | — |
| 196 | N | N | C | N | C | — | — | H | — | 52 |
| 197 | N | N | C | N | C | — | — | 150 | — | 72 |

The numerals appeared in the tables represent the following groups, respectively:

$-CH_3$ 1
$-C_2H_5$ 2
$-(i)C_3H_7$ 3
$-C_4H_9$ 4
$-(t)C_4H_9$ 5
$-(i)C_4H_9$ 6
$-C_5H_{11}$ 7
$-C_8H_{17}$ 8
$-C_{11}H_{23}$ 9
$-C_{12}H_{25}$ 10
$-C_{15}H_{31}$ 11
$-C_{17}H_{35}$ 12
13
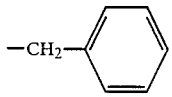
14
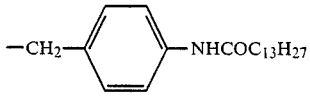
15
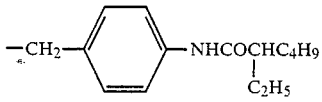
16
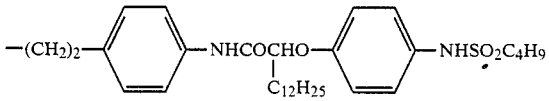
17
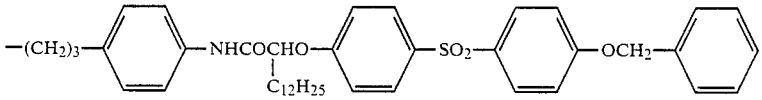
18
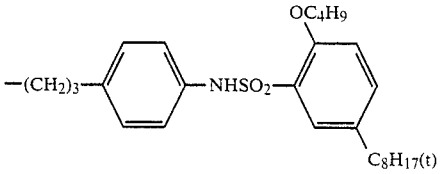
19
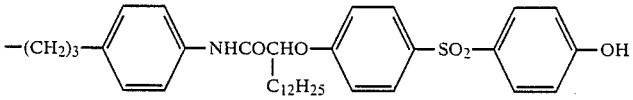
$-CH_2N(C_2H_5)_2$ 20
$-CH_2CH_2NHSO_2C_{16}H_{33}$ 21
22
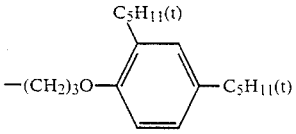
$-CHCH_2SO_2C_{16}H_{33}$ 23
$\quad\;\; |$
$\quad\;\; CH_3$
$-CHCH_2SO_2C_{18}H_{37}$ 24
$\quad\;\; |$
$\quad\;\; CH_3$ -continued
25
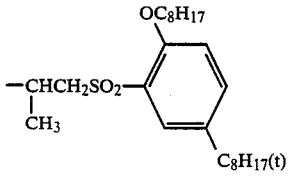
26
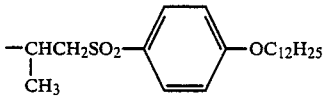
27
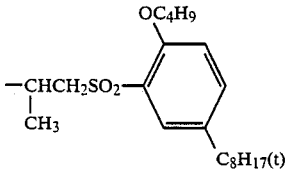
28
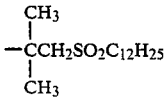
29
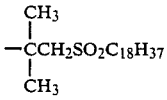
30
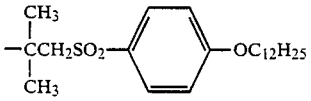
31 $-(CH_2)_3SO_2C_{12}H_{25}(t)$
32 $-(CH_2)_3SO_2C_{12}H_{25}$
33 $-(CH_2)_3SO_2C_{18}H_{37}$
34
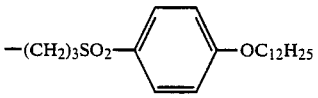
35
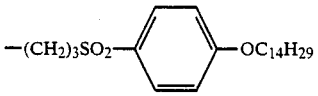
36
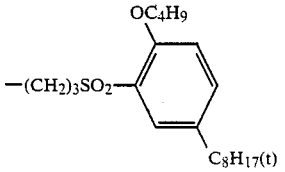
41
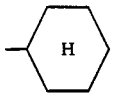
51
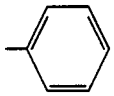

-continued
52
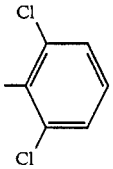
53
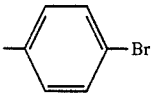
54
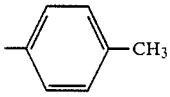
55
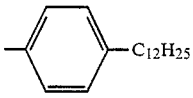
56
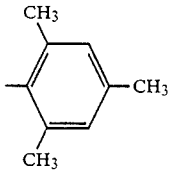
57
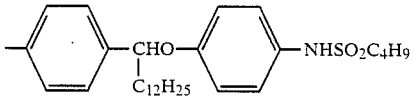
58
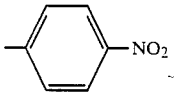
59
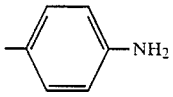
60
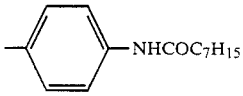
61
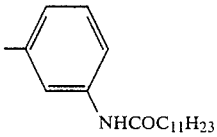
62
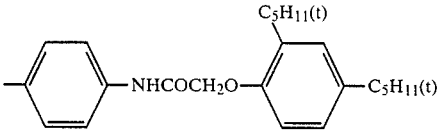

-continued
63
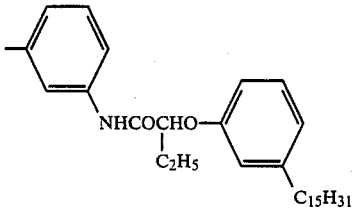
64
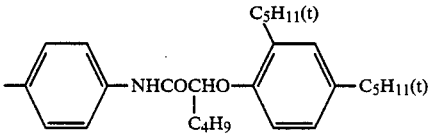
65
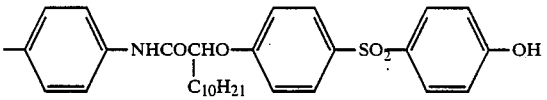
66
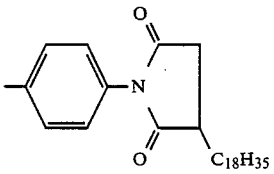
67
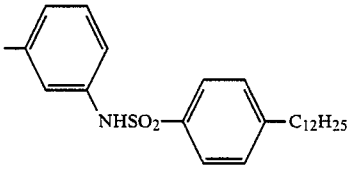
68
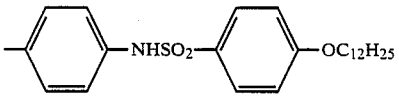
69
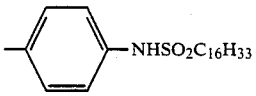
70
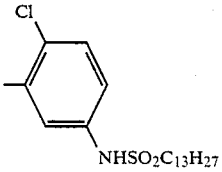
71
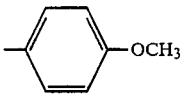
72
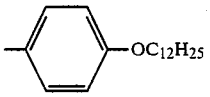

-continued
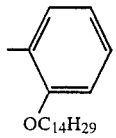
73
—CN 81
—$COCH_3$ 91
—$COC_3H_7$ 92
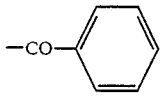
93
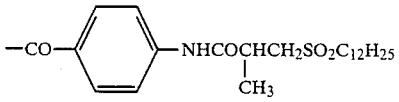
94
—$CONH_2$ 95
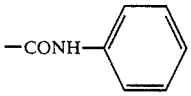
96
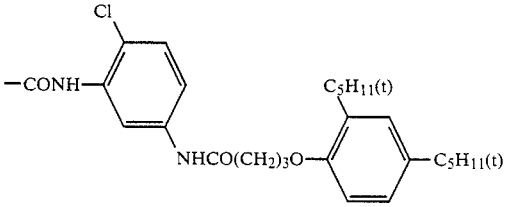
97
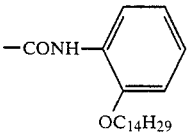
98
—$COOCH_3$ 99
—$COOC_2H_5$ 100
—$COOC_8H_{17}$ 101
—$COOC_{12}H_{25}$ 102
—$COOC_{15}H_{31}$ 103
F 111
Cl 112
Br 113
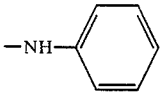
121
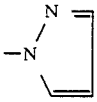
122

-continued
123
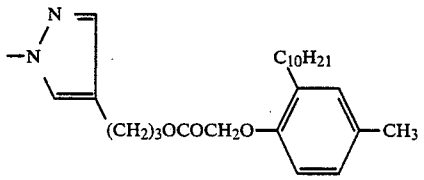
124
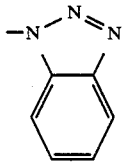
125
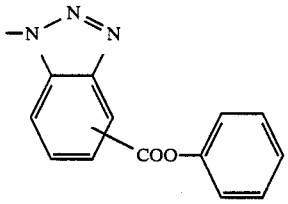
$-NHCOC_{13}H_{27}$ 126
$-NHCOC_{16}H_{33}$ 127
128
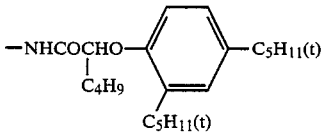
129
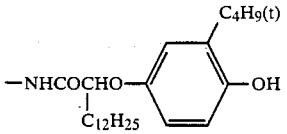
130
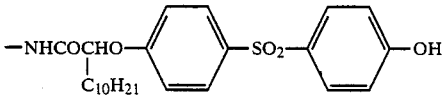
131
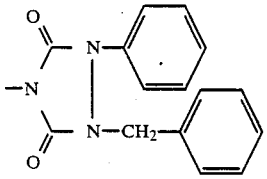
$-NHSO_2CH_3$ 132
133
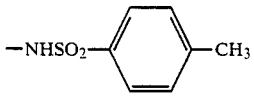
134
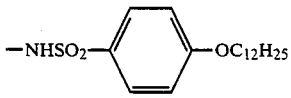
$-OCH_3$ 141
$-OC_2H_5$ 142

-continued
$-OC_{12}H_{25}$ 143
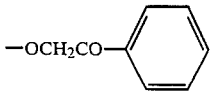
144
$-OCH_2CH_2OCH_3$ 145
$-OCH_2CONHCH_2CH_2OCH_3$ 146
$-OCH_2CH_2SO_2CH_3$ 147
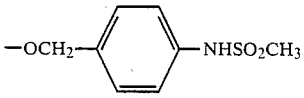
148
$-OCH_2CH_2SCH(C_{12}H_{25})COOH$ 149
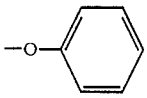
150
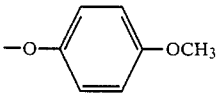
151
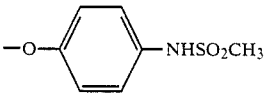
152
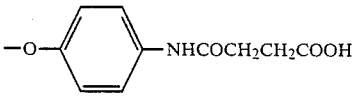
153
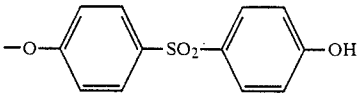
154
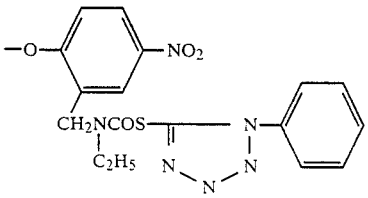
155
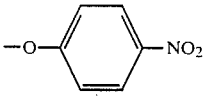
156
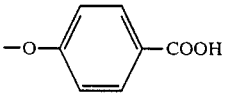
157

-continued
158
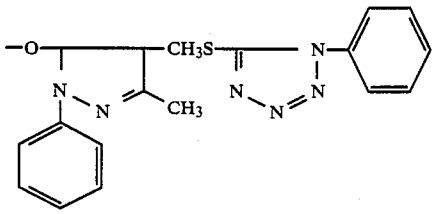
159
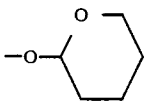
160
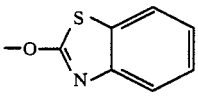
$-OCOC_2H_5$ 161
$-OCOC(CH_3)_3$ 162
171
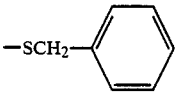
$-SCH_2CH_2OH$ 172
$-SC_{16}H_{33}$ 173
$-SCH_2COOH$ 174
175
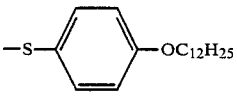
176
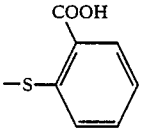
177
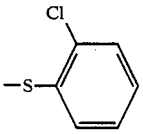
178
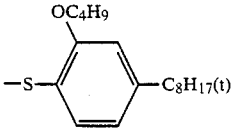
179
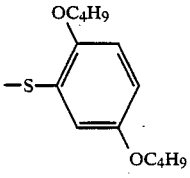

-continued

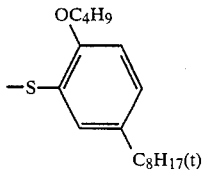

180

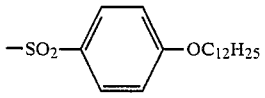

181

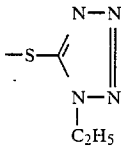

182

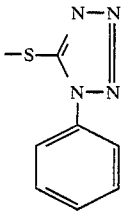

183

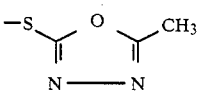

184

The color tone of the dyes formed of the couplers of the invention may be varied according to the conditions such as the arrangements of coupler ring forming atoms, the kinds of substituents, the kinds of color developing agents and so forth, however, the most color forming dyes have a magenta tone and they may be applied to multicolor photography. On the other hand, the color forming dyes having a red tone may also be applied to a monocolor photography and so forth, because they may be able to display excellent light absorption characteristics.

The couplers of the invention may ordinarily be used in an amount within the range between $1\times10^{-3}$ mol and 1 mol and, more preferably, $1\times10^{-2}$ mol and $8\times10^{-1}$ mol, per mol of a silver halide used.

The couplers of the invention may also be used with other kinds of magenta couplers in combination.

Now, silver halide grains, which may be used in the invention and contain silver chloride in an amount of not less than 80 mol %, will be described below.

In the invention, the silver halide grains each having a silver chloride content of not less than 80 mol % (hereinafter called silver halide grains relating to the invention) are preferably used particularly when the silver chloride content thereof is not less than 90 mol %. In this case, most of the remaining silver halide are silver bromide and it is matter of course that all the remaining may be silver bromide. It is also allowed to contain silver iodide therein if required for the purposes of use, however, the silver iodide content therein is to be less than 1 mol %. The silver halide emulsions containing the silver halide grains relating to the invention (hereinafter called a silver halide emulsion relating to the invention) are further allowed to contain any silver halide grains other than the silver halide grains relating to the invention. In this case also, a proportion of the silver halide grains relating to the invention is to be, preferably, not less than 50 mol %, more preferably, not less than 70 mol % and, further preferably, not less than 80 mol % to the whole amount of silver halide being contained in a silver halide emulsion.

The composition of the silver halide grains relating to the invention may be either entirely uniform form the inside thereof upto the outside thereof, or different in the inside and outside from each other. If the composition of the inside is different from that of the outside, such compositions may be varied eitehr regularly or irregularly.

There is no special limitation to the grain sizes of the silver halide grains relating to the invention. However, taking a rapid processability, a light-sensitivity and other photographic characteristics into consideration, the grain sizes are to be within the range of, preferably, from 0.2 to 1.6 μm and, more preferably, from 0.25 to 1.2 μm. The above-mentioned grain sizes may be measured in the various methods generally applied to the technical fields concerned. The typical methods thereof are described in, for example, R. P., Loveland, 'The Methods of Analysing Grain Sizes', A.S.T.M. Symposium on Light Microscopy, 1955, pp. 94–122; and C. E. K. Mees and T. H. James, 'The Theory of the Photographic Process', Chapter 2, 3rd Ed., The Macmillan Co., 1966.

The above-mentioned grain sizes may be measured by making use of the approximate value of the projected area or diameter of a subject grain. When such grain has a substantially uniform configuration, a considerably accurate grain distribution may be expressed in terms of diameters or projected areas.

The grain size distribution of the silver halide grains relating to the invention may be either of the polydisperse type or of the monodisperse type. The preferable grain size distribution of silver halide grains is that of monodisperse type silver halide grains having a variation coefficient of not more than 0.22 and, more preferably, not more than 0.15. The above-mentioned variation coefficient is herein defined as a coefficient expressing a broadness of grain size distribution and it may be determined by the following formulas:

$$\text{Variation coefficient}(S/r) = \frac{\text{Standard deviation of grain size distribution}}{\text{Average grain size}}$$

$$\text{Standard deviation of grain size distribution } (S) = \sqrt{\frac{\Sigma (r - r_i)^2 n_i}{\Sigma n_i}}$$

$$\text{Average grain size } (r) = \frac{\Sigma n_i r_i}{\Sigma n_i}$$

wherein $r_i$ represents the grain size of individual grains, and $n_i$ represents numbers of the grains. 'Grain size' stated herein means the diameter of a silver halide grain when the grain is spherical and the diameter of a circular image area equivalent to the projective image area of the grain.

The silver halide grains relating to the invention may be used in any configurations. One of the preferable examples thereof is a cube having crystal planes of {100}. It is also allowed to use any octahedral, tetradecahedral or dodecahedral grains or other configurational grains each of which may be prepared in such a process as described in, for example, U.S. Pat. Nos. 4,183,756 and 4,225,666; Japanese Patent O.P.I. Publication No. 26589/1980; Japanese Patent Examined Publication No. 42737/1980; The Journal of Photographic Science, Nos. 21 and 39, 1973; and so forth. In addition to the above, any grains having twin-crystal planes may also be used.

The silver halide grains relating to the invention may be used in the form of either a single configuration or the mixture of various configurations.

The silver halide grains relating to the invention may be prepared in any one of an acid process, a neutral process and an ammonia process. Such grains may be grown either at a time or after seed grains were prepared. Both of the processes of preparing and growing such seed grains may be the same with or different from each other.

As for the processes of reacting a soluble silver salt with a soluble halogen salt, it is allowed to use any one of a normal precipitation process, a reverse precipitation process, a simultaneous precipitation process and the combination processes thereof, however, among them, those prepared in such a simultaneous precipitation process are preferred to use. It is further allowed to apply a pAg-controlled double-jet process which is one of the simultaneous precipitation processes such as those described in, for example, Japanese Patent O.P.I. Publication No. 48521/1979 and so forth.

If required, it is also allowed to use such a silver halide solvent as thioether and so forth or such a crystal habit controlling agent as a mercapto group-containing compound.

In the silver halide grains relating to the invention, metal ions may be so added to the inside and/or the surface of the grains, in the course of forming and/or growing the grains, by making use of a cadmium salt, a zinc salt, a lead salt, a thallium salt, and iridium salt or the complex salts thereof, a rhodium salt or the complex salts thereof, or an iron salt or the complex salts thereof. It is also allowed to endow the inside and/or the surface of the grains with each reduction-sensitizing nucleus, by putting the grains in a suitable reducible atmosphere.

Any unnecessary soluble salts may be removed from the silver halide grains relating to the invention after completing the growth of the silver halide grains, or may remain contained therein as they are. If such unnecessary salts are to be removed therefrom, such a removal may be carried out in accordance with the method described in, for example, Research Disclosure No. 17643.

The silver halide grains relating to the invention may be those capable of forming a latent image mainly on the surface thereof or those capable of forming or containing the latent image inside the grains. If such unnecessary salts are to be removed therefrom, such a removal may be carried out in accordance with the method described in, for example, Research Disclosure No. 17643.

The silver halide grains relating to the invention may be chemically sensitized by applying thereto with any ordinary processes including, for example, a sulfur sensitizing process using a compound or an active gelatin each containing sulfur capable of reacting with silver ions, a selenium sensitizing process using a selenium compound, a reduction sensitizing process using a reducible substance, a noble metal sensitizing process using gold or other noble metals, independently or in combination.

The silver halide grains relating to the invention may also be spectrally sensitized in any desired wavelength, by making use of any dyes which have been well-known in the photographic industry as the so-called spectral sensitizers. Such spectral sensitizers may be used either independently or in combination. The emulsions each containing the silver halide grains relating to the invention are also allowed to contain, as well as the spectral sensitizers, a super color sensitizer capable of increasing the sensitizing function of spectral sensitizers, which is a dye not having any spectral sensitizing function in itself or a compound substantially incapable of absorbing any visible rays of light.

With the purposes of preventing fogs and/or keeping photographic characteristics stable in the courses of manufacturing, preserving or processing light-sensitive materials, the compounds which have been well-known in the photographic industry as the so-called antifogging agents or the stabilizers may be added into the emulsions containing the silver halide grains relating to the invention in the course of, at the time of completing and/or after the completion of a chemical ripening step, but before the silver halide emulsion is coated over to the light-sensitive material.

The following general formula represents the particularly preferable spectral sensitizers each used to spectrally sensitize an emulsion having a substantially high silver chloride content which is added into photographic layers each containing the couplers relative to the invention.

General Formula [1]

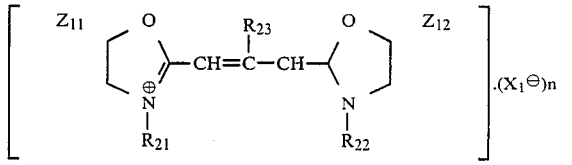

wherein $Z_{11}$ and $Z_{12}$ represent each a group of atoms necessary for completing a benzene ring condensed into an oxazole ring; $R_{21}$ and $R_{22}$ represent each an alkyl group, an alkenyl group or an aryl group; $R_{23}$ represents a hydrogen atom or an alkyl group having 1 to 3 carbon atoms; $X_1^-$ represents an anion; and n is an integer of 0 or 1.

There is no special limitation to the amount of the spectral sensitizers to be used, however, it is preferably from $2\times10^{-6}$ mol to $1\times10^{-3}$ mol and, more preferably, from $5\times10^{-6}$ mol to $5\times10^{-4}$ mol per mol of a silver halide used.

The typical compounds, i.e., the spectral sensitizers, represented by General Formula [1] will be given below:

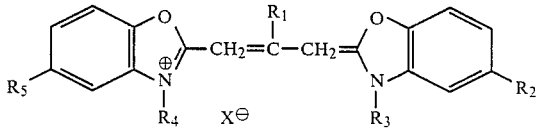

| Exemplified spectral sensitizer No. | $R_1$ | $R_2$ | $R_3$ | $R_4$ | $R_5$ | $X^\ominus$ |
|---|---|---|---|---|---|---|
| 1 | $-C_2H_5$ | $-Cl$ | $-(CH_2)_3SO_3Na$ | $-(CH_2)_3SO_3^\ominus$ | $-Cl$ | — |
| 2 | $-C_2H_5$ | $-OCH_3$ | $-(CH_2)_3SO_3Na$ | $-(CH_2)_3SO_3^\ominus$ | $-OCH_3$ | — |
| 3 | $-C_3H_7$ | $-Br$ | $-(CH_2)_3SO_3Na$ | $-(CH_2)_4SO_3^\ominus$ | $-Br$ | — |
| 4 | $-C_2H_5$ | 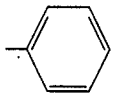 | $-(CH_2)_2SO_3H.N$ 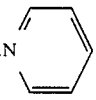 | $-(CH_2)_2SO_3^\ominus$ | 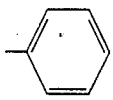 | — |
| 5 | $-C_2H_5$ | 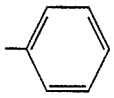 | $-(CH_2)_3SO_3H.N$ 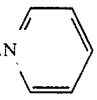 | $-(CH_2)_3SO_3^\ominus$ | 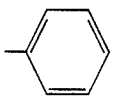 | — |
| 8 | $-C_2H_5$ | $-H$ | $-(CH_2)_3SO_3Na$ | $-(CH_2)_3SO_3^\ominus$ | $-Cl$ | — |
| 10 | $-C_2H_5$ | $-Br$ | $-C_2H_5$ | $-C_2H_5$ | $-Br$ | $I^\ominus$ |
| 11 | $-C_2H_5$ | $-Cl$ | $-(CH_2)_3SO_3H.N$ 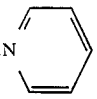 | $-(CH_2)_3SO_3^\ominus$ | 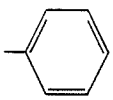 | — |
| 12 | $-CH_3$ | 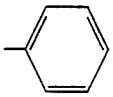 | $-(CH_2)_3SO_3H.N$ 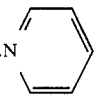 | $-(CH_2)_3SO_3^\ominus$ | 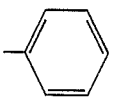 | — |

-continued

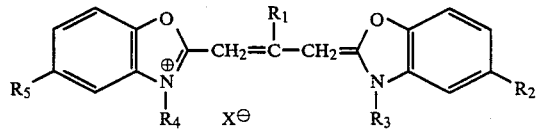

| Exemplified spectral sensitizer No. | $R_1$ | $R_2$ | $R_3$ | $R_4$ | $R_5$ | $X^{\ominus}$ |
|---|---|---|---|---|---|---|
| 13 | —H | 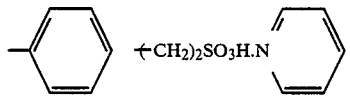 | | —$(CH_2)_2SO_3^{\ominus}$ | —Cl | — |

[6]

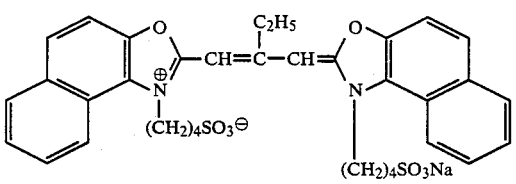

[7]

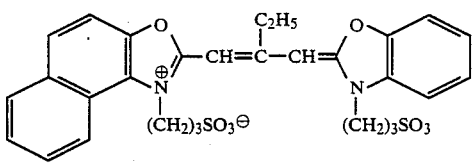

[9]

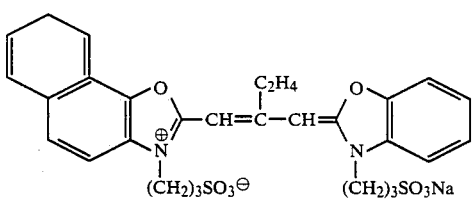

The anti-discoloring agents which may be used in the invention will now be described below.

As for the anti-discoloring agents which may be used in combination with the silver halide grains relating to the invention and the couplers relating to the invention, those having any structures may be used in the invention, as far as they may be able to display an anti-discoloring effect. It is, however, preferable to use the compounds each represented by the following general formulas [A] through [H], [XII] through [XV] and [XVI] through [XVII], respectively:

General Formula [A]

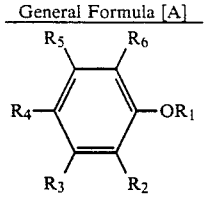

wherein $R^1$ represents a hydrogen atom, an alkyl group, an alkenyl group, an aryl group or a heterocyclic group; $R^2$, $R^3$, $R^5$ and $R^6$ represent each a hydrogen atom, a halogen atom, a hydroxy group, an alkyl group, an alkenyl group, an aryl group, an alkoxy group or an acylamino group; and $R^4$ represents an alkyl group, a hydroxy group, an aryl group or an alkoxy group; and $R^1$ and $R^2$ are allowed to close a ring with each other so as to complete a 5- or 6-membered ring and, in this instance, $R^4$ represents a hydroxy or alkoxy group; and, $R^3$ and $R^4$ are allowed to close a ring so as to complete a 5-membered hydrocarbon ring and, in this instance, $R^1$ represents an alkyl, aryl or heterocyclic group; provided however that it is exceptional when $R^1$ represents a hydrogen atom and $R^4$ represents a hydroxy group at the same time.

General Formula [B]

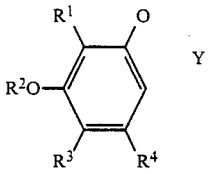

wherein $R^1$ and $R^4$ represent each a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamido group, a cycloalkyl group or an alkoxycarbonyl group; $R^2$ represents a hydrogen atom, an alkyl group, an alkenyl group, an aryl group, an acyl group, a cycloalkyl group or a heterocyclic group; and $R^3$ represents a hydrogen atom, a halogen atom, an alkyl group, an alkenyl group, an aryl group, an aryloxy group, an acyl group, an acyloxy group, a sulfonamido group, a cycloalkyl group or an alkoxycarbonyl group; and Y represents a group of atoms necessary for completing a chroman or coumaran ring.

General Formula [C]

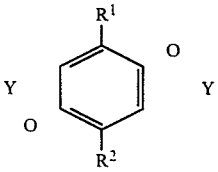

-continued

General Formula [D]

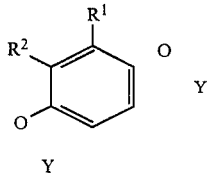

wherein $R^1$ and $R^2$ represent each a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamido group or an alkoxycarbonyl group; and Y represents a group of atoms necessary for completing a dichroman or coumaran ring, together with a benzene ring.

General Formula [E]

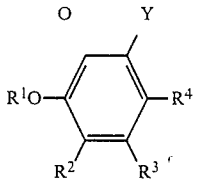

wherein $R^1$ represents a hydrogen atom, an alkyl group, an alkenyl group, an aryl group, an acyl group, a cycloalkyl group or a heterocyclic group; $R^3$ represents a hydrogen atom, a halogen atom, an alkyl group, an alkenyl group, an aryl group, an aryloxy group, an acyl group, an acylamino group, an acylamino group, an acyloxy group, a sulfonamido group, a cycloalkyl group or an alkoxycarbonyl group;

$R^2$ and $R^4$ represent each a hydrogen atom, a halogen atom, an alkyl group, an alkenyl group, an aryl group, an acyl group, an acylamino group, a sulfonamido group, a cycloalkyl group or an alkoxycarbonyl group; and Y represents a group of atoms necessary for completing a chroman or coumaran ring.

General Formula [F]

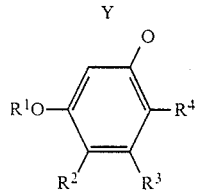

wherein $R^1$ represents a hydrogen atom, an alkyl group, an alkenyl group, an aryl group, an acyl group, a cycloalkyl group or a heterocyclic group; $R^2$ represents a hydrogen atom, a halogen atom, an alkyl group, an alkenyl group, an aryl group, an aryloxy group, an acyl group, an acylamino group, an acyloxy group, a sulfonamido group, a cycloalkyl group or an alkoxycarbonyl group;

$R^3$ represents a hydrogen atom, a halogen atom, an alkyl group, an alkenyl group, an aryl group, an acyl group, an acylamino group, a sulfonamido group, a cycloalkyl group or an alkoxycarbonyl group;

$R^4$ represents a hydrogen atom, a halogen atom, an alkyl group, an alkenyl group, an alkoxy group, an alkenyloxy group, an hydroxy group, an aryl group, an aryloxy group, an acyl group, an acylamino group, an acyloxy group, a sulfonamido group or an alkoxycarbonyl group; and Y represents a group of atoms necessary for completing a chroman or coumaran ring.

General Formula [G]

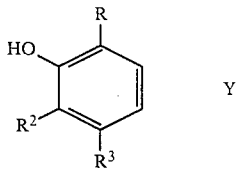

wherein $R^1$ and $R^3$ represent each a hydrogen atom, a halogen atom, an alkyl group, an alkenyl group, an alkoxy group, a hydroxy group, an aryl group, an aryloxy group, an acyl group, an acylamino group, an acyloxy group, a sulfonamido group, a cycloalkyl group or an alkoxycarbonyl group;

$R^2$ represents a hydrogen atom, a halogen atom, an alkyl group, an alkenyl group, a hydroxy group, an aryl group, an acyl group, an acylamino group, an acyloxy group, a sulfonamido group, a cycloalkyl group or an alkoxycarbonyl group; and Y represents a group of atoms necessary for completing an indane ring.

General Formula [H]

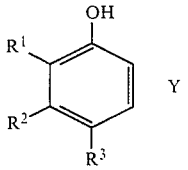

wherein $R^1$ and $R^2$ represent each a hydrogen atom, a halogen atom, an alkyl group, an alkenyl group, an aryl group, an acyl group, an acylamino group, an acyloxy group, a sulfonamido group, a cycloalkyl group or an alkoxycarbonyl group;

$R^3$ represents a hydrogen atom, a halogen atom, an alkyl group, an alkenyl group, an alkoxy group, a hydroxy group, an aryl group, an aryloxy group, an acyl group, an acylamino group, an acyloxy group, a sulfonamido group, a cycloalkyl group or an alkoxycarbonyl group; and Y represents a group of atoms necessary for completing an indane ring, and such an indane ring may be substituted with a substituent capable of substituting the above-mentioned hydrocarbon ring or may also complete a spiro ring.

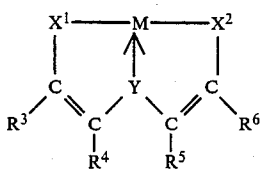

General Formula [XII]

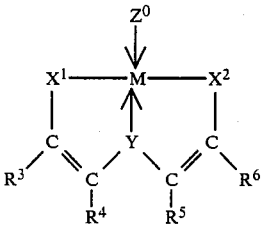

General Formula [XIII]

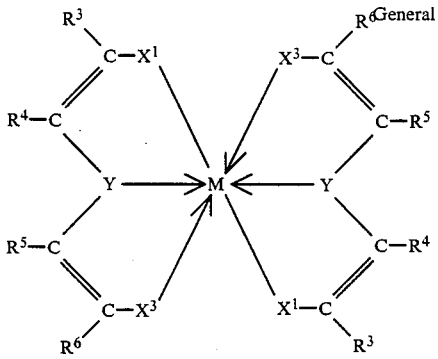

General Formula [XIV]

In General Formulas [XII], [XIII] and [XIV], M represents a metal atom;

$X^1$ and $X^2$ represent each an oxygen atom, a sulfur atom or an $—NR^7—$ (in which $R^7$ represents a hydrogen atom, an alkyl group, an aryl group or a hydroxyl group);

$X^3$ represents a hydroxyl group or a mercapto group;

Y represents an oxygen atom or a sulfur atom;

$R^3$, $R^4$, $R^5$ and $R^6$ represent each a hydrogen atom, a halogen atom, a cyano group or an alkyl, aryl, cycloalkyl or heterocyclic group which is bonded to a carbon atom directly or through a divalent bond group, and at least one of the combinations of $R^3$ with $R^4$ and of $R^5$ with $R^6$ may be so bonded as to complete a 5- or 6-membered ring, together with the carbon atom bonded thereto; and $Z^0$ represents a compound which may be coordinated to M or the residual group thereof.

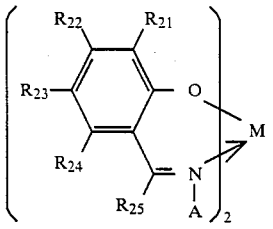

General Formula [XV]

wherein $R_{21}$, $R_{22}$, $R_{23}$ and $R_{24}$ represent each a hydrogen atom, a halogen atom, a hydroxy group, a cyano group or an alkyl, aryl, cycloalkyl or heterocyclic group which is to be bonded to a carbon atom on a benzene ring directly or indirectly through a divalent coupling group, and $R_{21}$ and $R_{22}$, $R_{22}$ and $R_{23}$ or $R_{23}$ and $R_{24}$ may be so bonded to each other as to complete a 6-membered ring;

$R_{25}$ represents a hydrogen atom, an alkyl group or an aryl group;

A represents a hydrogen atom, an alkyl group, an aryl group or a hydroxy group; and M represents a metal atom.

The metal complexes each represented by the above-given General Formulas [XII] through [XIV] may be synthesized in the processes such as described in, for example, British Pat. No. 858,890, West German Patent OLS Publication No. 2,042,652, and so forth.

The metal complexes each represented by the above-given General Formula [XV] may be synthesized in the process described in, for Example, E. G. Cox, F. W. Pinkard, W. Wardlaw and K. C. Webster, Jr., 'Journal of the Chemical Society', No. 459, 1935.

The anti-discoloring agents which may be used in the invention include the compounds each represented by the above-given general formulas [A] through [H] out of which the compounds each having an oxidation potential Eox within the range of $0.95(V) \leqq Eox \leqq 1.50(V)$ may more preferably be used and the compounds each represented by the above-given general formulas [XII] through [XV] out of which the compounds each having a singlet oxygen quenching rate constant of not less than $3 \times 10^7 M^{-1}$.sec may also more preferably be used.

<OXIDATION POTENTIAL EOX>

An oxidation potential Eox may readily be measured by the skilled in the art. How to measure is described in, for example, A. Stanienda, 'Naturwissenschaften', Vol. 47, p. 353 and p. 512, 1960; P. Delahay, 'New Instrumental Methods in Electrochemistry', 1954, Interscience Publishers; L. Meites, 'Polarographic Techniques', 2nd Ed., 1965, Interscience Publishers; and so forth.

A value of the above-mentioned Eox means a potential at which the electrons of a compound are extracted therefrom on an anode in a voltammetry, and such an Eox value primarily relates to a highest occupied electron energy level in the ground state of a compound.

In the invention, a value of Eox is obtained under the undermentioned conditions from the half step potential of a polarograph. To be more concrete, the measurement was made under the conditions that there used, respectively, acetonitrile as the solvent for an anti-discoloring agent, sodium perchlorate (0.1N) as a supporting electrolyte, the anti-discoloring agent having a concentration of $10^{-3}$ to $10^{-4}$ mol per liter, an Ag/AgCl electrode as the reference electrode, a rotary platinum plate electrode for measuring an Eox value and a temperature at 25° C.

<SINGLET OXYGEN QUENCHING RATE CONSTANT>

A singlet oxygen quenching rate constant may be determined in the method of measuring a rubrene photodiscoloration described in, for example, 'Journal of Physical Chemistry', 83, 591, 1979 and so forth.

To be more concrete, both of a chloroform solution of rubrene and a chloroform solution of rubrene mixed with a compound subject to a measure are irradiated with equienergy light.

Thus, a singlet oxygen quenching rate constant (kq) may be determined by the followng formula:

$$kq = \frac{5.3 \times 10^7 ([R]_F^Q - [R]_F^O) + 1.7 \times 10^4 \ln ([R]_F^Q/[R]_F^O)}{[Q] \ln ([R]/[R]_F^Q)}$$

wherein [R] represents the initial concentration of rubrene, [Q] represents a concentration of a compound subject to measure, $[R]_F^O$ represents a rubrene concentration in a single rubrene solution after a test was made, and $[R]_F^Q$ represents a rubrene concentration in a solution of rubrene mixed with a compound subject to measure after a test was made.

Formula [XVI]

wherein $R^1$ represents an aliphatic group, a cycloalkyl group or an aryl group; and Y represents a group of non-metal atoms necessary for completing a 5-membered to 7-membered heterocyclic ring together with the nitrogen atom, provided, however, that Y contains at least one hetero atom which sahll not be adjacent to the nitrogen atom.

Formula [XVII]

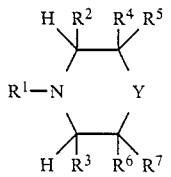

wherein $R^1$ represents an aliphatic group, a cycloalkyl group or an aryl group; Y represents a simple link or a divalent hydrocarbon group each necessary for completing a 5-membered to 7-membered heterocyclic ring together with the nitrogen atom; and $R^2$, $R^3$, $R^4$, $R^5$, $R^6$ and $R^7$ represent each a hydrogen atom, an aliphatic group, a cycloalkyl group or an aryl group, provided, however, that $R^2$ and $R^4$ or $R^3$ and $R^5$ may be bonded together to form a simple link so that an unsaturated 5- to 7-membered heterocyclic ring may be completed together with the nitrogen atom and Y, and that, when Y is a simple link, $R^5$ and $R^7$ may be bonded together to form a simple link so that an unsaturated 5- to 7-membered heterocyclic ring may be completed together with Y, and, further, that, when Y is not a simple link, $R^5$ and Y, $R^7$ and Y, or Y itself may be formed an unsaturated link so that an unsaturated 6- or 7-membered heterocyclic ring may be completed together with the nitrogen atom and Y.

In the above-given Formula [XVI], the aliphatic groups represented by $R^1$ include, for example, an alkyl group allowed to have a substituent and an alkenyl group and the like allowed to have a substituent. Such alkyl groups include, for example, a methyl, ethyl, butyl, octyl, dodecyl, tetradecyl or hexadecyl group and the like groups. Such alkenyl groups include, for example, an ethenyl or propenyl group and the like groups.

The cycloalkyl groups represented by $R^1$ include, for example, a 5- to 7-membered cycloalkyl group allowed to have a substituent such as a cyclopentyl or cyclohexyl group and the like groups.

The aryl groups represented by $R^1$ include, for example, a phenyl or naphthyl group each allowed to have a substituent.

The substituents to the liphatic, cycloalkyl and aryl groups each represented by $R^1$ include, for example, an alkyl, aryl, alkoxy, carbonyl, cabamoyl, acylamino, sulfamoyl, sulfonamido, carbonyloxy, alkylsulfonyl, arylsulfonyl, hydroxy, heterocyclic, alkylthio, arylthio or the like group. Such substituents are allowed to have a further substituent.

In the above-given Formula [XVI], Y represents a group of non-metal atoms necessary for completing a 5- to 7-membered heterocyclic ring provided, however, that Y contains at least one hetero atom which shall not be adjacent to the nitrogen atom. In the heterocyclic rings of the compounds represented by Formula [XVI], it is not preferred that all the hetero atoms are adjacent to each other, because they cannot display any function to serve as a magenta dye image stabilizer.

The above-mentioned 5- to 7-membered heterocyclic rings of the compounds represented by the foregoing Formula [XVI] are allowed each to have such a substituent as an alkyl, aryl, acyl, carbamoyl, alkoxycarbonyl, sulfonyl, sulfamoyl or the like group each also allowed to have a further substituent. Such 5- to 7-membered heterocyclic rings may be of the unsaturated though, the saturated ones may be further preferred. In addition, such heterocyclic rings may also be condensed with a benzene ring or the like and may complete a spiro ring.

Among the compounds represented by the foregoing Formula [XVI], piperazine compounds and homopiperazine compounds are particularly preferred and the compounds represented by the following Formula [XVI-1] or [XVI-2] are still further preferred.

Formula [XVI-1]

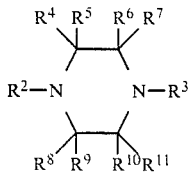

Formula [XVI-2]

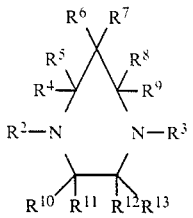

wherein $R^2$ and $R^3$ represent each a hydrogen atom, an alkyl group or an aryl group, provided that $R^2$ and $R^3$ are not hydrogen atoms at the same time; and $R^4$ through $R^{13}$ represent each a hydrogen atom, an alkyl group or an aryl group.

In the above-given Formulas [XVI-1] and [XVI-2], $R^2$ and $R^3$ represent each a hydrogen atom, an alkyl group or an aryl group and the alkyl groups each represented by $R^2$ or $R^3$ include, for example, a methyl, ethyl, butyl, octyl, dodecyl, tetradecyl, hexadecyl, octadecyl or like group and, further, the aryl groups represented by $R^2$ or $R^3$ include, for example, a phenyl group or the like groups.

The alkyl groups and aryl groups each represented by $R^2$ or $R^3$ are allowed to have a substituent including, for example, a halogen atom, an alkyl group, an aryl group, an alkoxy group, an aryloxy group, a heterocyclic group and so forth.

It is preferred that $R^2$ and $R^3$ including substituents each have 6 to 40 carbon atoms in total.

In the aforegoing Formula [XVI-1] or [XVI-2], $R^4$ through $R^{13}$ each represent a hydrogen atom, an alkyl group or an aryl group. Such alkyl groups represented by $R^4$ through $R^{13}$ include, for example, a methyl group, an ethyl group and so forth, and the aryl groups represented by $R^4$ through $R^{13}$ include, for example, a phenyl group and so forth.

The typical examples of the compounds represented by the foregoing Formula [XVI-1] or [XVI-2] are as given in the exemplified piperazine compounds (VXI-1) through (VXI-30) and the exemplified homopiperazine compounds (XVI-51) through (XVI-62).

Referring to Formula [XVII], the apliphatic groups represented by $R^1$ include, for example, a saturated alkyl group allowed to have a substituent and an alkenyl group and the like allowed to have a substituent. Such alkyl groups include, for example, a methyl, ethyl, butyl, octyl, dodecyl, tetradecyl, hexadecyl or like groups and such alkenyl groups include, for example, an ethenyl, propenyl or like groups.

The cycloalkyl groups represented by $R^1$ include, for example, a 5- to 7-membered cycloalkyl group allowed to have a substituent, such as a cyclopentyl, cyclohexyl or like groups.

The aryl groups represented by $R^1$ include, for example, a phenyl or naphthyl group each allowed to have a substituent.

The substituents to the aliphatic, cycloalkyl and aryl groups each represented by $R^1$ include, for example, an alkyl, aryl, alkoxy, carbonyl, carbamoyl, acylamino, sulfamoyl, sulfonamido, carbonyloxy, alkylsulfonyl, arylsulfonyl, hydroxy, heterocyclic, alkylthio, arylthio or like groups, and these substituents are also allowed to have a further substituent.

In the foregoing Formula [XVII], Y represents a simple link or a divalent hydrocarbon group each necessary for completing a 5- to 7-membered heterocyclic ring together with a nitrogen atom. When Y is a simple link, it is allowed that $R^5$ and $R^7$ may be bonded together to form a simple link so that an unsaturated 5-membered heterocyclic ring. When Y is a divalent hydrocarbon group, that is, when Y is a methylene group, it is allowed that $R^5$ and Y or $R^7$ and Y may form an unsaturated bond so that an unsaturated 6-membered heterocyclic ring may be completed. When Y is an ethylene group, it is allowed that $R^5$ and Y, $R^7$ and Y or Y itself may form an unsaturated bond so that an unsaturated 7-membered heterocyclic ring. Further, the divalent hydrocarbon groups represented by Y are allowed to have a substituent including, for example, an alkyl, carbamoyl, alkyloxycarbonyl, acylamino, sulfonamido, sulfamoyl, aryl, heterocyclic or like groups.

In the foregoing Formula [XVII], $R^2$, $R^3$, $R^4$, $R^5$, $R^6$ and $R^7$ each represent a hydrogen atom, an aliphatic group, a cycloalkyl group or an aryl group. Among them, the aliphatic groups represented by $R^2$ through $R^7$ include, for example, an alkyl group allowed to have a substituent and an alkenyl group and the like allowed to have a substituent.

Such alkyl groups include, for example, a methyl, ethyl, butyl, octyl, dodecyl, tetradecyl, hexadecyl or like group, and such unsaturated alkyl groups include, for example, an ethenyl, propenyl or like groups.

Such cycloalkyl groups represented by $R^2$ through $R^7$ include, for example, a 5- to 7-membered cycloalkyl group allowed to have a substituent, such as a cyclopentyl, cyclohexyl or like groups.

Such aryl groups represented by $R^2$ through $R^7$ include, for example, a phenyl, naphthyl or like groups each allowed to have a substituent.

The substituents to such aliphatic groups, cycloalkyl groups and aryl groups each represented by the foregoing $R^2$ through $R^7$ include, for example, an alkyl, aryl, alkoxy, carbonyl, carbamoyl, acylamino, sulfamoyl, sulfonamido, carbonyloxy, alkylsulfonyl, arylsulfonyl, hydroxy, heterocyclic, alkylthio or like groups.

Among the compounds represented by the foregoing Formula [XVII], those having a 5- to 7-membered saturated heterocyclic ring are more preferable than those unsaturated.

The dye-image stabilizers of the invention may be used in a proportion of, preferably, from $5\times10^{-2}$ to 5 mol and, more preferably, from $1\times10^{-1}$ to 3 mol per mol of the aforementioned couplers of the invention.

The typical examples of the compounds relating to the invention represented by the above-given general formulas [A] through [H], [XII] through [XV] and [XVI] through [XVII] will be given below. It is, however, to be understood that the invention shall not be limited thereto.

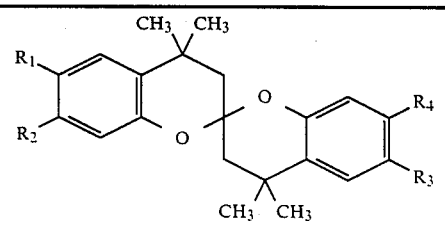

| Exemplified compound No. | $R_1$ | $R_2$ | $R_3$ | $R_4$ |
|---|---|---|---|---|
| AO-1 | —OH | —$CH_3$ | —OH | —$CH_3$ |
| AO-2 | —OH | —$CH_3$ | —$OCH_3$ | —$CH_3$ |
| AO-3 | —$OCH_3$ | —$CH_3$ | —$OCH_3$ | —$CH_3$ |
| AO-4 | —OH | —$CH_3$ | —$OC_5H_{11}$ | —$CH_3$ |
| AO-5 | —$OC_5H_{11}$ | —$CH_3$ | —$OC_5H_{11}$ | —$CH_3$ |
| AO-6 | —$OC_8H_{17}$(n) | —$CH_3$ | —$OC_8H_{17}$(n) | —$CH_3$ |

-continued

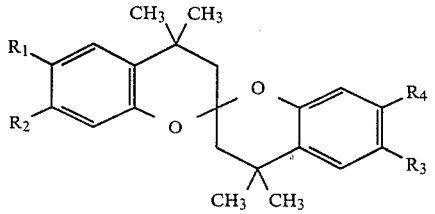

| Exemplified compound No. | $R_1$ | $R_2$ | $R_3$ | $R_4$ |
|---|---|---|---|---|
| AO-7 | $-OCH_2CH(C_2H_5)C_4H_9$ | $-CH_3$ | $-OCH_2CH(C_2H_5)C_4H_9$ | $-CH_3$ |
| AO-8 | $-OC_{12}H_{25}(n)$ | $-CH_3$ | $-OC_{12}H_{25}(n)$ | $-CH_3$ |
| AO-9 | $-OH$ | $-CH_3$ | $-OC_{12}H_{25}(n)$ | $-CH_3$ |
| AO-23 | $-H$ | $-OH$ | $-H$ | $-OH$ |
| AO-24 | $-H$ | $-OCH_3$ | $-H$ | $-OCH_3$ |
| AO-25 | $-H$ | $-OC_3H_7$ | $-H$ | $-OC_3H_7$ |

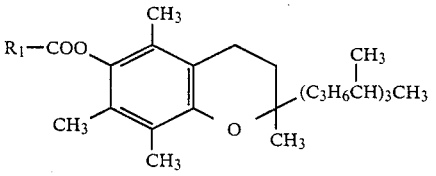

| Exemplified compound No. | $R_1$ |
|---|---|
| AO-10 | $-CH_3$ |
| AO-11 | $-C_2H_5$ |
| AO-12 | $-C_4H_9$ |

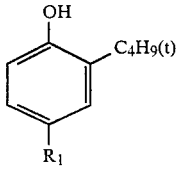

| Exemplified compound No. | $R_1$ |
|---|---|
| AO-13 | $-OCH(C_{12}H_{25})COOC_2H_5$ |
| AO-14 | $-OCH_2COOCH_2CH(C_2H_5)C_4H_9$ |
| AO-15 | $-OCH(C_{12}H_{25})COOCH_2CH(C_2H_5)C_4H_9$ |
| AO-16 | $-OCH_2COOC_8H_{17}(n)$ |
| AO-17 | $-OCH(C_2H_5)COOC_{12}H_{25}$ |

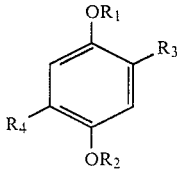

| Exemplified compound No. | $R_1$ | $R_2$ | $R_3$ | $R_4$ |
|---|---|---|---|---|
| AO-18 | $-C_8H_{17}$ | $-C_8H_{17}$ | $-C_4H_9(t)$ | $-C_4H_9(t)$ |
| AO-19 | $-C_{12}H_{25}$ | $-C_{12}H_{25}$ | $-C_4H_9(t)$ | $-C_4H_9(t)$ |
| AO-20 | $-C_{12}H_{25}$ | $-C_{12}H_{25}$ | $-C_4H_9(t)$ | $-CH_3$ |
| AO-21 | $-C_8H_{17}(n)$ | $-C_8H_{17}(n)$ | $-C_5H_{11}(t)$ | $-C_5H_{11}(t)$ |
| AO-22 | $-C_{12}H_{25}$ | $-C_{12}H_{25}$ | $-C_5H_{11}(t)$ | $-C_5H_{11}(t)$ |

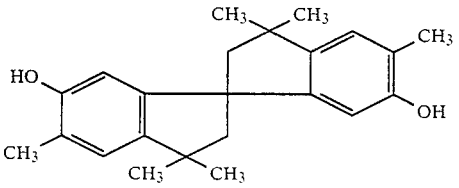

(AO-26)

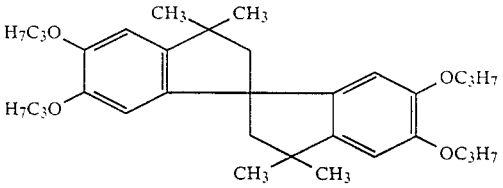

(AO-27)

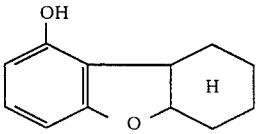

(AO-28)

-continued
(e-1)
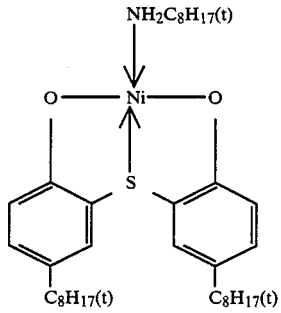
(e-2)
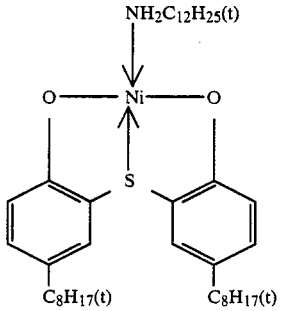
(e-3)
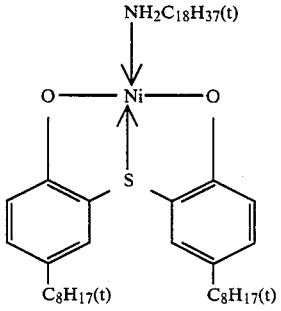
(e-4)
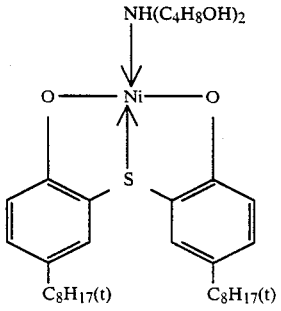
(e-5)
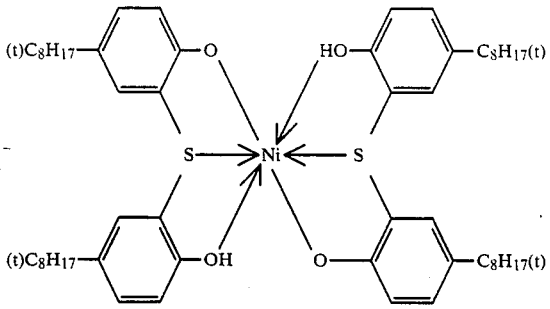

-continued
(e-6)
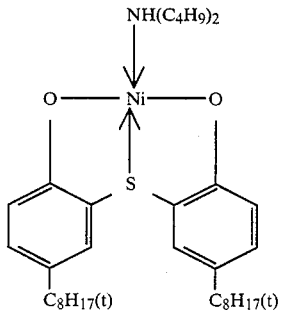
(e-7)
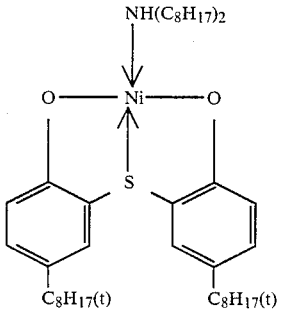
(e-8)
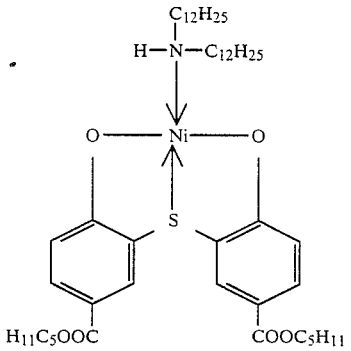
(e-9)
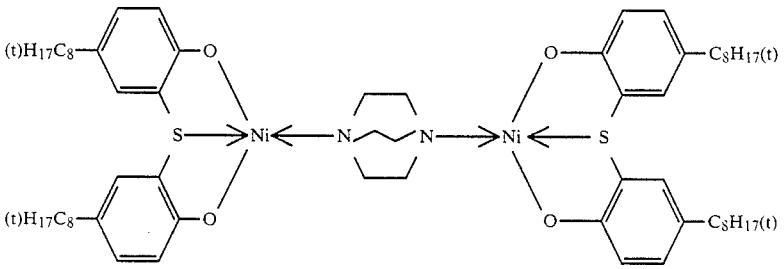
(e-10)
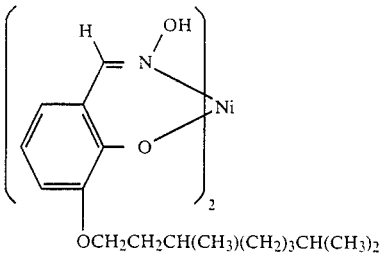

-continued
(e-11)
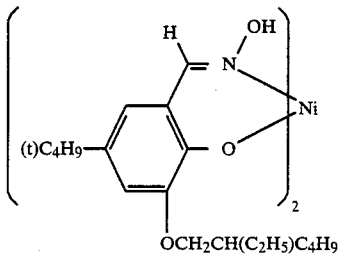
(e-12)
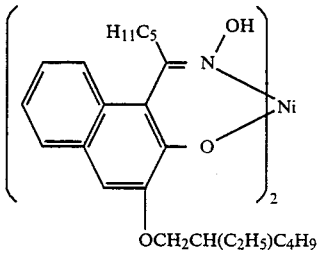
(e-13)
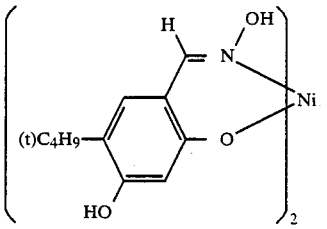
(e-14)
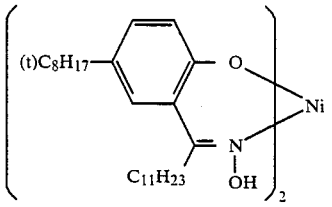
(e-15)
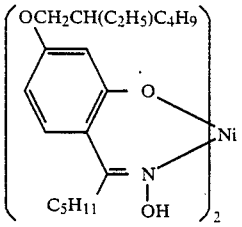
(e-16)
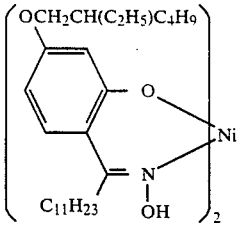

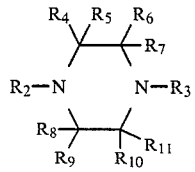

| | $R^2$ | $R^3$ | $R^4$ | $R^5$ | $R^6$ | $R^7$ | $R^8$ | $R^9$ | $R^{10}$ | $R^{11}$ |
|---|---|---|---|---|---|---|---|---|---|---|
| XVI-1 | $C_{12}H_{25}$ | $C_{12}H_{25}$ | H | H | H | H | H | H | H | H |
| XVI-2 | $C_{14}H_{29}$ | $C_{14}H_{29}$ | H | H | H | H | H | H | H | H |
| XVI-3 | $C_{14}H_{29}$ | H | H | H | H | H | H | H | H | H |
| XVI-4 | $C_{14}H_{29}$ | $CH_3CO$ | H | H | H | H | H | H | H | H |
| XVI-5 | $C_{16}H_{33}$ | $C_{16}H_{33}$ | H | H | H | H | H | H | H | H |
| XVI-6 | $C_{14}H_{29}$ | $CH_3$ | H | H | H | H | H | H | H | H |
| XVI-7 | 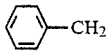 | 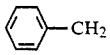 | H | H | H | H | H | H | H | H |
| XVI-8 | 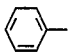 | 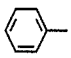 | H | H | H | H | H | H | H | H |
| XVI-11 | $CH_3$ | 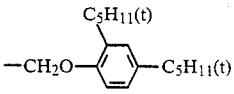 | H | H | H | H | H | H | H | H |
| XVI-13 | $C_{14}H_{29}$ | $C_4H_9NHCO$ | H | H | H | H | H | H | H | H |
| XVI-14 | $(t)C_8H_{17}$ | 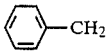 | H | H | H | H | H | H | H | H |
| XVI-15 | $C_{14}H_{29}$ | $CF_3CO$ | H | H | H | H | H | H | H | H |
| XVI-16 | $C_{14}H_{29}$ | $C_2H_5OCO$ | H | H | H | H | H | H | H | H |
| XVI-17 | $CH_3$ | 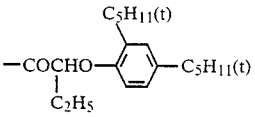 | H | H | H | H | H | H | H | H |
| XVI-18 | $C_{14}H_{29}$ | $C_{14}H_{29}$ | $CH_3$ | H | H | H | H | H | H | H |
| XVI-19 | $C_{14}H_{29}$ | $C_{14}H_{29}$ | $CH_3$ | H | H | H | H | H | $CH_3$ | H |
| XVI-20 | $C_{14}H_{29}$ | $C_{14}H_{29}$ | $CH_3$ | $CH_3$ | $CH_3$ | $CH_3$ | $CH_3$ | $CH_3$ | $CH_3$ | $CH_3$ |
| XVI-21 | $CH_3$ | 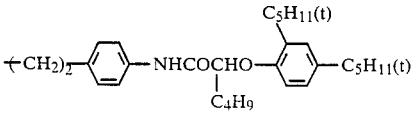 | H | H | H | H | H | H | H | H |
| XVI-22 | $C_{12}H_{25}$ | $CH_3$ | $CH_3$ | H | H | H | $CH_3$ | H | H | H |
| XVI-23 | $C_{12}H_{25}$ | $C_{12}H_{25}$ | $CH_3$ | H | H | H | H | H | $CH_3$ | H |
| XVI-24 | $C_{16}H_{33}$ | $C_{16}H_{33}$ | $CH_3$ | H | H | H | H | H | $CH_3$ | H |
| XVI-25 | $C_6H_5CH{=}CH{-}CH_2$ | $C_{12}H_{25}$ | H | H | H | H | H | H | H | H |
| XVI-26 | $C_{12}H_{25}$ | $C_2H_5$ | $CH_3$ | H | H | H | H | H | H | H |
| XVI-27 | $C_{16}H_{33}$ | H | $C_2H_5$ | H | H | H | H | H | H | H |
| XVI-29 | $C_{14}H_{29}$ | $CH_2BrCH_2$ | H | H | H | H | H | H | H | H |
| XVI-30 | $CH_3O(CH_2)_4$ | $CH_3O(CH_2)_4$ | H | H | H | H | H | H | H | H |

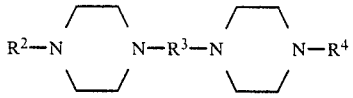

| | $R^2$ | $R^3$ | $R^4$ |
|---|---|---|---|
| XVI-9 | $C_{14}H_{29}$ | $(CH_2)_2$ | $C_{14}H_{29}$ |
| XVI-10 | $(t)C_8H_{17}$ | $(CH_2)_6$ | $(t)C_8H_{17}$ |
| XVI-12 | $C_{14}H_{29}$ | $CH_2$ | $C_{14}H_{29}$ |

-continued

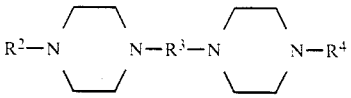

| | $R^2$ | $R^3$ | $R^4$ |
|---|---|---|---|
| XVI-28 | $C_{12}H_{25}$ | 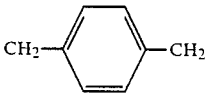 | $C_{12}H_{25}$ |

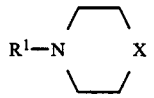
| | X | $R_1$ |
|---|---|---|
| XVI-31 | O | $C_{12}H_{25}$ |
| XVI-32 | O | $C_{14}H_{29}$ |
| XVI-33 | O | $C_6H_5CH{=}CH-$ |
| XVI-34 | O | 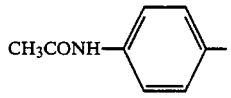 |
| XVI-35 | O | α-naphthyl |
| XVI-36 | O | 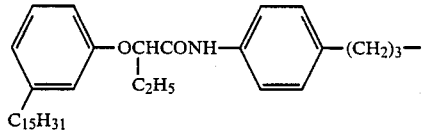 |
| XVI-37 | O | 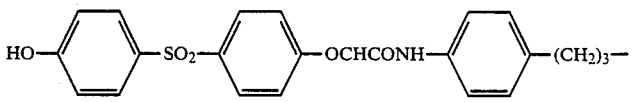 |
| XVI-38 | O | 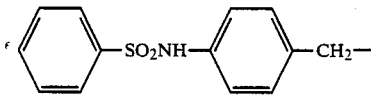 |
| XVI-39 | O | 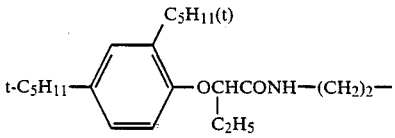 |
| XVI-40 | O | 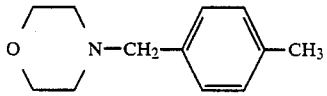 |
| XVI-41 | S | $C_{14}H_{29}$ |
| XVI-42 | S | 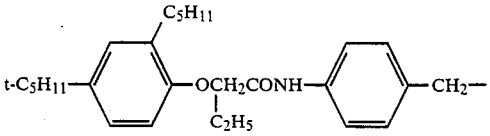 |
| XVI-43 | S | 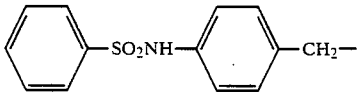 |
| XVI-44 | S | 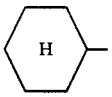 |
| XVI-45 | S | 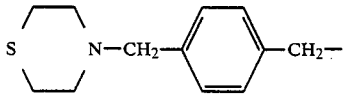 |

| | $R^1$ | $R^2$ |
|---|---|---|
| | 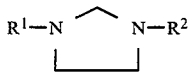 | |
| XVI-46 | $C_{12}H_{25}$ | $C_{12}H_{25}$ |
| XVI-47 | $C_{14}H_{29}$ | $C_{14}H_{29}$ |
| XVI-48 | $C_6H_5CH_2$ | $C_6H_5CH_2$ |
| XVI-49 | $C_{16}H_{33}$ | H |
| XVI-50 | $C_{16}H_{33}$ | $CH_3CO$ |
| | 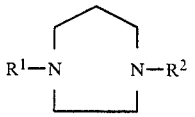 | |
| XVI-51 | $C_{16}H_{33}$ | $C_{16}H_{33}$ |
| XVI-52 | $C_{14}H_{29}$ | $C_{14}H_{29}$ |
| XVI-53 | $C_{12}H_{25}$ | $C_{12}H_{25}$ |
| XVI-54 | $C_{14}H_{25}$ | $CH_3CO$ |
| XVI-55 | $C_{14}H_{29}$ | $CF_3CO$ |
| XVI-56 | $C_2H_5$ | 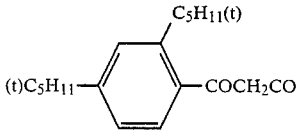 |
| XVI-57 | $C_{14}H_{29}$ | $C_2H_5OCO$ |
| XVI-58 | $C_{14}H_{29}$ | $CH_3NHCO$ |
| XVI-59 | $C_{14}H_{29}$ | $C_4H_9SO_2$ |
| XVI-60 | $C_{14}H_{29}$ | $(CH_3)_2NSO_2$ |
| XVI-61 | $C_{12}H_{25}$ | 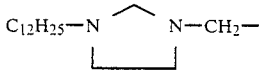 |
| XVI-62 | H | 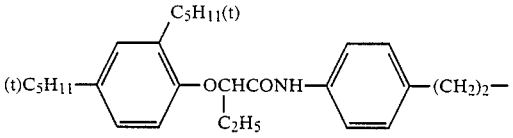 |
-continued
XVI-63
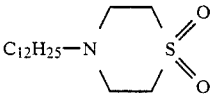
XVI-64
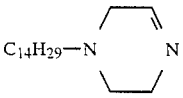
XVI-65
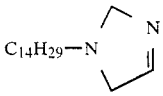
XVI-66
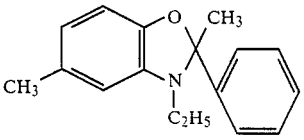
XVI-67
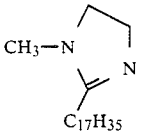
XVI-68
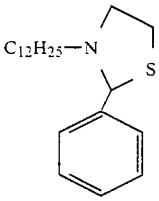
XVI-69
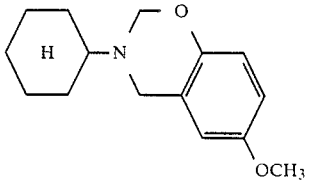

-continued
XVI-70
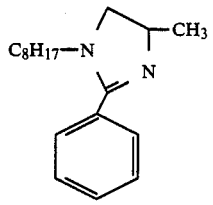
XVI-71
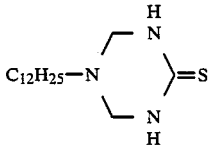
-continued
XVI-72
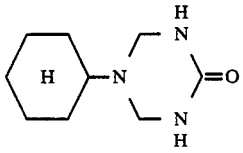
XVI-73
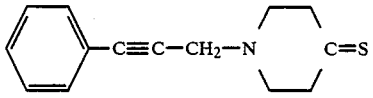
XVI-74
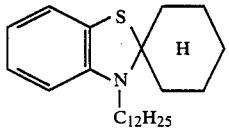
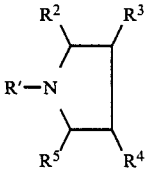
| | $R^1$ | $R^2$ | $R^3$ | $R^4$ | $R^5$ |
|---|---|---|---|---|---|
| XVII-1 | $C_8H_{17}$ | H | H | H | H |
| XVII-2 | 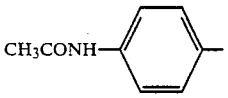 | H | H | H | H |
| XVII-3 | 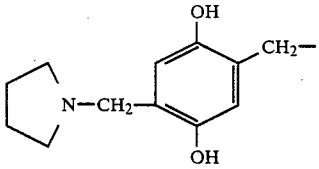 | H | H | H | H |
| XVII-4 | $C_{12}H_{25}$ | H | H | H | H |
| XVII-5 | $C_{14}H_{29}$ | H | H | H | H |
| XVII-6 | $C_{16}H_{33}$ | H | H | H | H |
| XVII-7 | $C_{14}H_{29}$ | H | 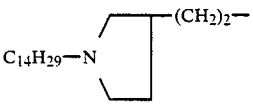 | H | H |
| XVII-8 | 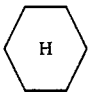 | $CH_3$ | $CH_3$ | H | H |
| XVII-9 | $C_6H_5CH{=}CHCH_2-$ | H | H | H | H |
| XVII-10 | 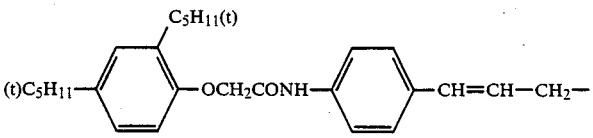 | H | H | H | H |

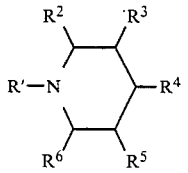
| | $R^1$ | $R^2$ | $R^3$ | $R^4$ | $R^5$ | $R^6$ |
|---|---|---|---|---|---|---|
| XVII-11 | (t)$C_8H_{17}$ | H | H | H | H | H |
| XVII-12 | 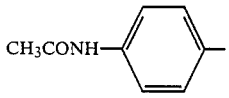 | H | H | H | H | H |
| XVII-13 | $C_{12}H_{25}$ | H | H | H | H | H |
| XVII-14 | $C_{14}H_{29}$ | H | H | H | H | H |
| XVII-15 | $C_{16}H_{33}$ | H | H | H | H | H |
| XVII-16 | $C_{14}H_{29}$ | $CH_3$ | H | H | H | H |
| XVII-17 | 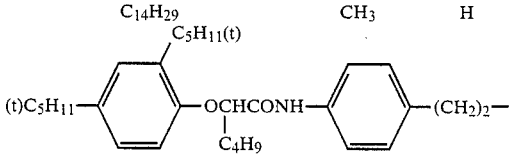 | | | H | H | H |
| XVII-18 | $C_8H_{17}$ | $CH_3$ | $CH_3$ | H | $CH_3$ | $CH_3$ |
| XVII-19 | 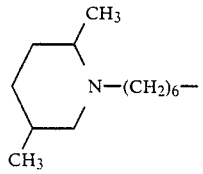 | $CH_3$ | H | H | $CH_3$ | H |
| XVII-20 | $CH_3$ | H | H | $C_{12}H_{25}OCOCH_2$— | H | H |
| XVII-21 | $CH_3$ | $CH_3$ | H | $C_{16}H_{33}OCOCH_2$— | H | $CH_3$ |
| XVII-22 | $CH_3$ | $C_{16}H_{33}$ | H | H | H | H |
| XVII-23 | $C_6H_5$ | H | H | $C_{12}H_{25}OCO$— | H | H |
| XVII-24 | $CH_3$ | $C_6H_5$ | H | H | H | H |
| XVII-25 | 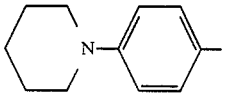 | H | H | H | H | H |
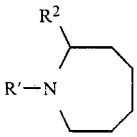
| | $R^1$ | $R^2$ |
|---|---|---|
| XVII-26 | $C_8H_{17}$ | H |
| XVII-27 | 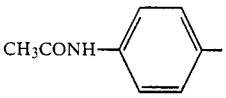 | H |
| XVII-28 | 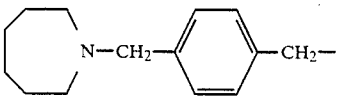 | H |
| XVII-29 | $C_{14}H_{29}$ | H |

-continued
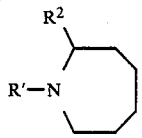
| | $R^1$ | $R^2$ |
|---|---|---|
| XVII-30 | 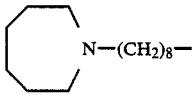 | H |
| XVII-31 | $C_{16}H_{33}$ | $CH_3$ |
| XVII-32 | 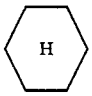 | H |
| XVII-33 | 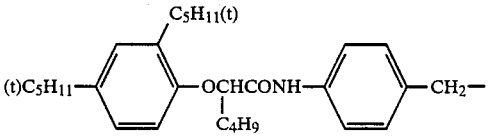 | H |
XVII-34
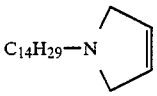
XVII-35
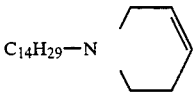
XVII-36
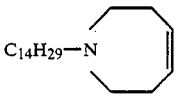
XVII-37
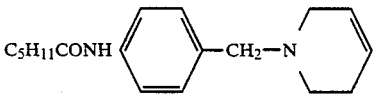
XVII-38
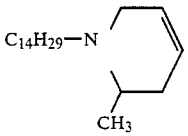
XVII-39
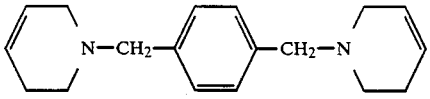
XVII-40
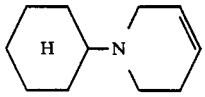

-continued

XVII-41

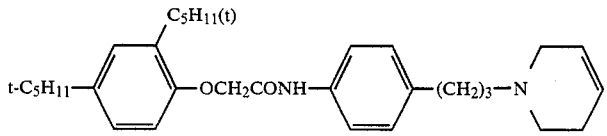

In the silver halide photographic light-sensitive materials relating to the invention, the great improvements have been achieved in both of the fastness against light and color developability of dye images formed with the aforementioned couplers of the invention even under the rapid processing conditions, because each of the silver halide emulsion layers thereof has contained the silver halide grains relating to the invention, the aforementioned couplers and the anti-discoloring agent having been dispersed altogether by making use of a high boiling organic solvent and, further, a proportion by weight (B/A) of a high boiling organic solvent content (B) to a content (A) of the couplers of the invention has been set to not less than 0.6.

As far as the proportion by weight (B/A) of the high boiling organic solvent content to the aforementioned coupler content of the invention is set to not less than 0.6, every effect of the invention can be achieved. The proportion is to be preferably not less than 0.8 and, more preferably, from 1.0 to 3.0, because the effects of the invention can more effectively be enjoyed.

When using the compounds represented by Formulas [XVI] and [XVII] to serve as an anti-discoloring agent, it is preferred that the above-mentioned weight ratio, B/A, is to be not less than 0.9 and that a compound having an oxidation potential, Eox, of $0.95V \leqq Eox \leqq 1.5V$ may be used in combination.

In the invention, the couplers of the invention and the anti-discoloring agent are dissolved in a high boiling organic solvent and the resulted solution is so dispersed in a hydrophilic binder and the resulted emulsion may be added into the silver halide emulsion layers each containing the silver halide grains of the invention.

As for such high boiling organic solvents, such esters as a phthalate, a phosphate and so forth, organic acid amides, ketones, hydrocarbon compounds and so forth, for example, may be preferably used. The more preferable high boiling organic solvents include those each having a dielectric constant of from not higher than 6.0 to not lower than 1.9 and a vapor pressure at 100° C. of not higher than 0.5 mmHg. The most preferable ones among the high boiling organic solvents are a phthalate and a phosphate. In addition, any mixture of two or more kinds thereof may also be able to serve as such a high boiling organic solvent.

The term, dielectric constant, stated in this invention means a dielectric constant obtained at 30° C.

The phthalates each advantageously used in the invention include those represented by the following general formula [IIa]:

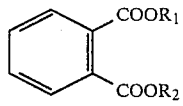

General Formula [IIa]

wherein $R_1$ and $R_2$ represent each an alkyl group, an alkenyl group or an aryl group, provided however that a total number of carbon atoms of the groups each represented by $R_1$ and $R_2$ is from 8 to 32 and, more preferably, from 16 to 24.

In the invention, the alkyl groups each represented by $R_1$ and $R_2$ denoted in the above-given general formula [II] may be straight-chained or branched and include, for example, a butyl group, a pentyl group, a hexyl group, a 2-ethylhexyl group, a 3,5,5-trimethylhexyl group, an octyl group, a nonyl group, a decyl group, a dodecyl group, a tetradecyl group, a hexadecyl group, an octadecyl group and so forth. The aryl groups each represented by $R_1$ and $R_2$ include, for example, a phenyl group, a nephthyl group and so forth. The alkenyl groups include, for example, a hexenyl group, a heptenyl group, an octadecenyl group and so forth. These alkyl, alkenyl and aryl groups include those each having a single substituent or a plurality of substituents. The substituents to such alkyl and alkenyl groups include, for example, a halogen atom, an alkoxy group, an aryl group, an aryloxy group, an alkenyl group, an alkoxycarbonyl group and so forth. The substituents to the aryl groups include, for example, a halogen atom, an alkyl group, an alkoxy group, an aryl group, an aryloxy group, an alkenyl group, an alkoxycarbonyl group and so forth.

Among the above, $R_1$ and $R_2$ preferably represent each an alkyl group such as a 2-ethylhexyl group, a 3,5,5-trimethylhexyl group, an n-octyl group, an n-nonyl group and so forth.

In the invention, the advantageously useful phosphates include those represented by the following general formula [IIIa]:

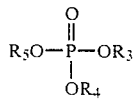

General Formula [IIIa]

wherein $R_3$, $R_4$ and $R_5$ represent each an alkyl group, an alkenyl group or an aryl group, provided however that a total number of carbon atoms of those represented by $R_3$, $R_4$ and $R_5$ each is from 24 to 54.

The alkyl groups represented by $R_3$, $R_4$ and $R_5$ denoted in general formula [III] include, for example, a butyl group, a pentyl group, a hexyl group, a 2-ethylhexyl group, a heptyl group, a nonyl group, a decyl group, a dodecyl group, a tetradecyl group, a hexadecyl group, an octadecyl group, a nonadecyl group and so forth. The aryl groups include, for example, a phenyl group, a naphthyl group and so forth. The alkenyl groups include, for example, a hexenyl group, a heptenyl group, an octadecenyl group and so forth.

These alkyl, alkenyl and aryl groups include those having a single or a plurality of substituents. Preferable ones represented by $R_3$, $R_4$ and $R_5$ include alkyl groups including, for example, a 2-ethylhexyl group, an n-octyl group, a 3,5,5-trimethylhexyl group, an n-nonyl group, an n-decyl group, a sec-decyl group, a sec-dodecyl group, a t-octyl group and so forth.

The typical examples of the high boiling organic solvents which may be used in the invention will be given below. It is, however, to be understood that the invention shall not be limited thereto.

Exemplified high boiling organic solvents:

S-1

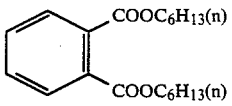

S-2

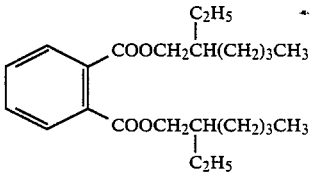

S-3

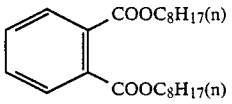

S-4

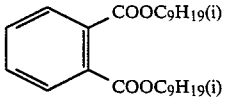

S-5

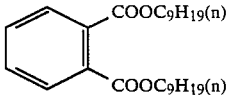

S-6

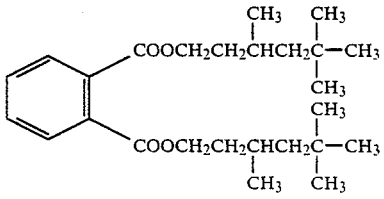

S-7

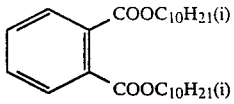

S-8

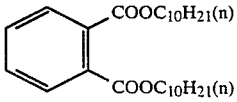

-continued

S-9

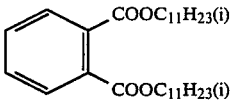

S-10

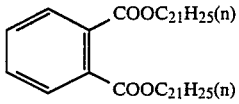

S-11

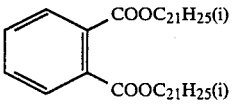

S-12

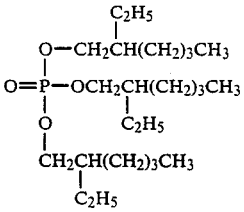

S-13

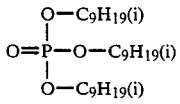

S-14

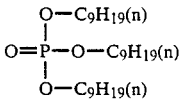

S-15

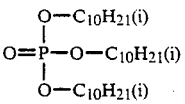

S-16

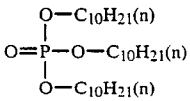

S-17

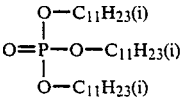

S-18

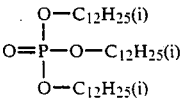

S-19

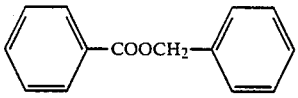

S-20

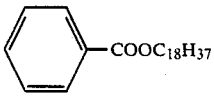

-continued

S-21

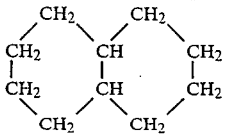

S-22

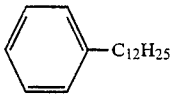

The methods of adding the couplers, anti-discoloring agents and high boiling organic solvents each relating to the invention into silver halide photographic light-sensitive materials include a variety of methods such as a solid dispersion process, a latex dispersion process, an oil drop-in-water type emulsification-dispersion process and so forth, as well as the ordinary methods of adding hydrophobic compounds. A suitable method may be selected therefrom in accordance with the chemical structure of hydrophobic compounds such as couplers and so forth. As for the oil drop-in-water type emulsification-dispersion processes, any of the conventionally well-known processes thereof may be applied, wherein such a hydrophobic compound is dissolved in a high boiling organic solvent and, if required, a low boiling and/or water-soluble organic solvent in combination, and the resulted solution is so dispersed in such a hydrophilic binder as an aqueous gelatin solution as to be emulsified with a surface active agent by making use of such a dispersing means as a stirrer, a homogenizer, a colloid mill, a flow-jet mixer, a supersonic equipment and so forth and, then, the resulted emulsion is to be added to an objective hydrophilic colloidal layer. It is also allowed to insert a step of removing the low boiling organic solvent from the disperse liquid or at the same time when the dispersion is carried out.

In the light-sensitive materials of the invention, the protective layer, interlayers and silver halide emulsion layers thereof each are allowed to contain a UV absorbing agent, with the purpose of stabilizing dye images. The advantageously useful UV absorbing agents include, for example, 2-(2'-hydroxyphenyl)benzotriazole type compounds and, in particular, the compounds each represented by the following general formula [IV]:

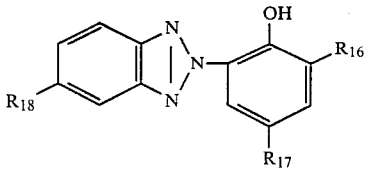

General Formula [IV]

In the above-given general formula [IV], $R_{16}$, $R_{17}$ and $R_{18}$ represent each a hydrogen atom, a halogen atom, an alkyl group, an aryl group, an alkoxy group, an aryloxy group, an alkenyl group, a nitro group or a hydroxyl group.

Out of the compounds each represented by the above-given general formula [IV], the compound being in liquid state at an ordinary temperature may also able to serve as a high boiling organic solvent applicable to such a hydrophobic compound as the couplers relating to the invention and so forth, therefore, they may advantageously be used from the viewpoints of lowering an oil proportion applied in the course of coating a layer and of improving a deposition property.

The expression, a substance in a liquid state at ordinary temperature, means herein that a substance is in a liquid state when it is in the temperature condition applied to the step of containing a compound represented by the general formula [IV] into a silver halide photographic light-sensitive material relating to the invention. Such a substance as mentioned above include preferably a compound having a melting point of not higher than 30° C. and, more preferably a compound having a melting point of not higher than 15° C.

If this is the case and such a substance is in a liquid state, any one of the 2-(2'-hydroxyphenyl)benzotriazole type compounds may be used and they may be a single kind of the compounds or may also be the mixture thereof. Such a mixture as is comprised of a group of structural isomers may preferably be used.

The typical examples of the compounds represented by the above-given general formula [IV] will be given below. It is, however, to be understood that this invention shall not be limited thereto.

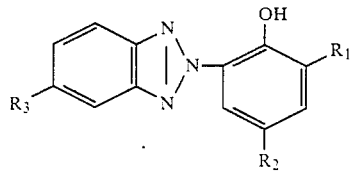

| Exemplified compound No. | $R_1$ | $R_2$ | $R_3$ |
|---|---|---|---|
| UV-1 | —H | —H | —H |
| UV-2 | —H | —$CH_3$ | —H |
| UV-3 | —H | —$C_4H_9$(t) | —H |
| UV-4 | —$C_4H_9$(t) | —$CH_3$ | —H |
| UV-5 | —$C_4H_9$(t) | —$CH_3$ | —Cl |
| UV-6 | —$C_4H_9$(t) | —$C_4H_9$(t) | —H |
| UV-7 | —$C_4H_9$(sec) | —$C_4H_9$(t) | —H |
| UV-8 | —$C_4H_9$(t) | —$C_4H_9$(t) | —Cl |
| UV-9 | —$C_4H_9$(t) | —$C_4H_9$(t) | —$OCH_3$ |

-continued

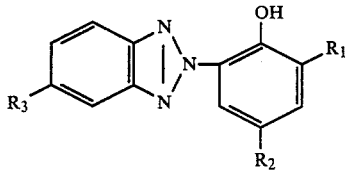

| Exemplified compound No. | $R_1$ | $R_2$ | $R_3$ |
|---|---|---|---|
| UV-10 | $-C_4H_9(t)$ | $-C_4H_9(t)$ | $-C_4H_9(t)$ |
| UV-11 | $-C_4H_9(sec)$ | $-C_4H_9(t)$ | $-C_4H_9(t)$ |
| UV-12 | $-CH_3$ | $-C_4H_9(sec)$ | $-H$ |
| UV-13 | $-C_4H_9(sec)$ | $-C_4H_9(t)$ | $-C_4H_9(n)$ |
| UV-14 | $-C_4H_9(sec)$ | $-C_4H_9(t)$ | $-C_5H_{11}(t)$ |
| UV-15 | $-C_4H_9(sec)$ | $-C_4H_9(t)$ | $-C_5H_{11}(n)$ |
| UV-16 | $-C_5H_{11}(t)$ | $-C_5H_{11}(t)$ | $-H$ |
| UV-17 | $-C_5H_{11}(t)$ | $-C_5H_{11}(t)$ | $-Cl$ |
| UV-18 | $-C_5H_{11}(t)$ | $-C_5H_{11}(t)$ | $-C_4H_9(t)$ |
| UV-19 | $-C_5H_{11}(t)$ | $-C_5H_{11}(t)$ | $-C_4H_9(sec)$ |
| UV-20 | $-C_5H_{11}(t)$ | $-C_5H_{11}(t)$ | $-OCH_3$ |
| UV-21 | $-C_4H_9(t)$ | $-CH_2CH_2COOC_8H_{17}(n)$ | $-Cl$ |
| UV-22 | $-C_4H_9(t)$ | $-CH_2CH_2COOCH_2CH(C_2H_5)-(CH_2)_4H$ | $-Cl$ |
| UV-23 | 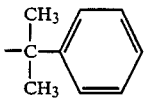 | 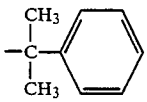 | $-H$ |
| UV-24 | $-H$ | $-OC_8H_{17}(n)$ | $-H$ |

Any amount of these 2-(2'-hydroxyphenyl)benzotriazole type compounds may be added, however, it is, preferably, in an amount of from 1 to 50 mg/dm$^2$ and, more preferably, from 2 to 30 mg/dm$^2$.

To the silver halide photographic light-sensitive materials of the invention, an oil-soluble dyestuff may be added for the purpose of improving a whiteness and so forth.

Such oil-soluble dyestuffs are an organic dyestuff having such a solubility to water at 20° C. [g/100 g of water] as is to be of not more than $1\times10^{-2}$. Such compounds include, typically, an anthraquinone type compound, an azo type compound and so forth.

The oil-soluble dyestuffs relating to the invention is to have a spectral absorption coefficient of, preferably, not less than 5000 and, more preferably, not less than 20000 in a maximum absorption wavelength in wavelengths of not shorter than 400 nm, when using a chloroform solvent.

The oil-soluble dyestuffs relating to the invention are to be coated in an amount of, preferably, from 0.01 mg/m$^2$ to 10 mg/m$^2$ and, more preferably, from 0.05 mg/m$^2$ to 5 mg/m$^2$.

The oil-soluble dyestuffs relating to the invention may be added into any of photographic emulsion layers and, more preferably, into non-light-sensitive layers other than coupler-containing layers.

A particularly preferable application of the oil-soluble dyestuffs relating to the invention is that an oil-soluble dyestuff, which has a spectral absorption coefficient of not less than 20000 in a maximum absorption wavelength in wavelengths of not shorter than 400 nm, are to be added in an amount coated of from 0.05 mg/m$^2$ to 5 mg/m$^2$ into non-light-sensitive layers other than coupler-containing layers.

The oil-soluble dyestuffs preferably used in the invention include, for example, the compounds represented by the following Formula [V] or [VI]:

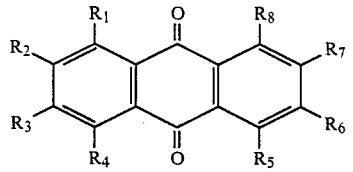

Formula [V]

wherein $R_1$ through $R_8$ represent a hydrogen atom, a hydroxy group, an amino group or a halogen atom, respectively.

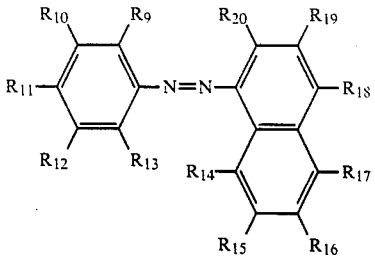

Formula [VI]

wherein $R_9$ through $R_{20}$ represent a hydrogen atom, a halogen atom, a nitro group, a hydroxy group, an alkyl group, an alkoxy group, an aminocarbonyl group, an amino group or an —N=N—R group in which R represents an aryl group, respectively.

The halogen atoms represented by $R_1$ through $R_8$ denoted in Formula [V] include, for example, a chlorine atom, a bromine atom and so forth. The amino groups represented by $R_1$ through $R_8$ each are also allowed to have a substituent. Such substituents include, for example, alkyl group such as a methyl group, a butyl group and so forth, aryl groups such as a phenyl group and so forth, acyl groups such as a methoxy group, a benzoyl group and so forth.

The halogen atoms represented by $R_9$ through $R_{20}$ denoted in Formula [VI] include, for example, a chlorine atom, a bromine atom and so forth. Such alkyl groups include, for example, a methyl group, an ethyl group, a propyl group and so forth. Such alkoxy groups include, for example, a methoxy group, an ethoxy group, a propoxy group and so forth. Such aminocarbonyl groups include, for example, a methylaminocarbonyl group, a phenylaminocarbonyl group and so forth. Further, the amino groups represented by $R_9$ through $R_{20}$ are allowed to have the substituents similar to those given in Formula [V].

The typical examples of the oil-soluble dyestuffs used in the invention will now be given below. It is, however, to be understood that the invention shall not be limited thereto.

Formula [V]

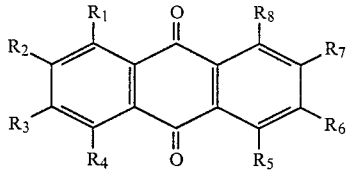

| Compound No. | $R_1$ | $R_2$ | $R_3$ | $R_4$ | $R_5$ | $R_6$ | $R_7$ | $R_8$ |
|---|---|---|---|---|---|---|---|---|
| 1 | H | H | H | H | H | H | H | $-NHCH_3$ |
| 2 | H | H | H | H | $-OH$ | H | H | $-NH-C_6H_4-CH_3$ |
| 3 | H | H | H | H | $-NH_2$ | H | H | $-NH_2$ |
| 4 | H | H | H | H | $-NH_2$ | H | $-Br$ | $-OH$ |
| 5 | H | H | H | H | $-NH-C_6H_4-CH_3$ | H | H | $-NHCH_3$ |
| 6 | H | H | H | H | $-NH-C_6H_4-CH_3$ | H | $-Br$ | $-NH_2$ |
| 7 | H | H | H | H | $-NH-C_6H_5$ | H | H | $-NH-C_6H_5$ |
| 8 | H | H | H | H | $-NH-C_6H_4-CH_3$ | H | H | $-NH-C_6H_4-CH_3$ |
| 9 | H | H | H | H | $-NHC_4H_9(n)$ | H | H | $-NHC_4H_9(n)$ |
| 19 | H | H | H | H | H | H | H | $-NHCO-C_6H_4-OH$ |
| 21 | H | H | H | $-NHCO-C_6H_5$ | H | H | H | $-NHCO-C_6H_5$ |

C-1
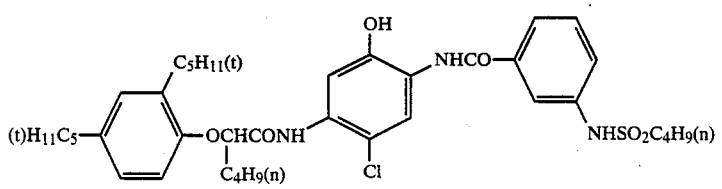
C-2
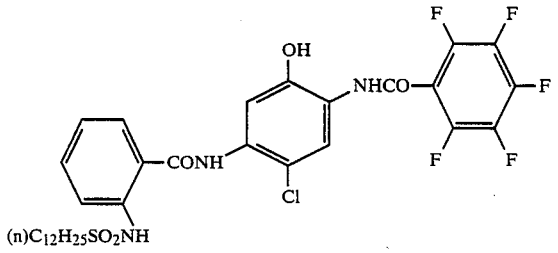
C-3
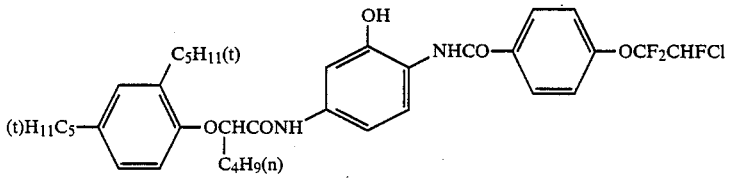
C-4
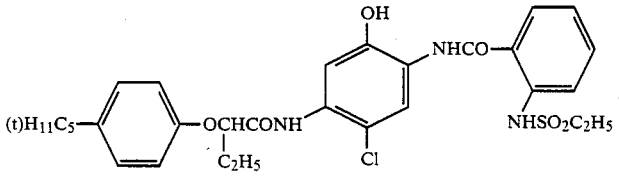
C-5
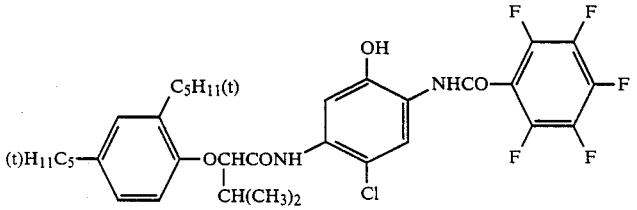
C-6
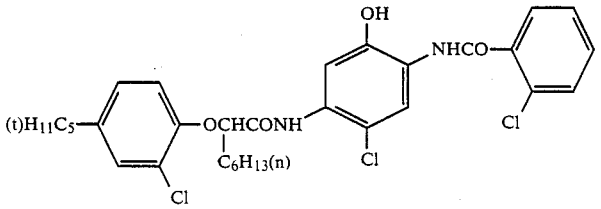
C-7
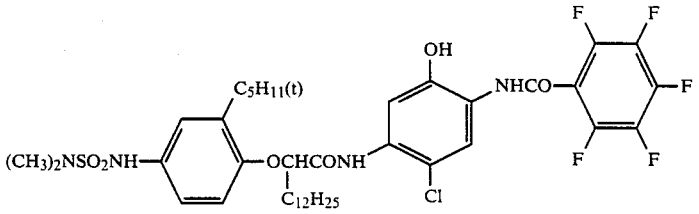

-continued

C-8

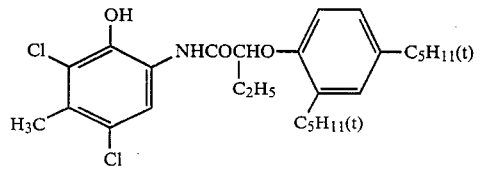

C-9

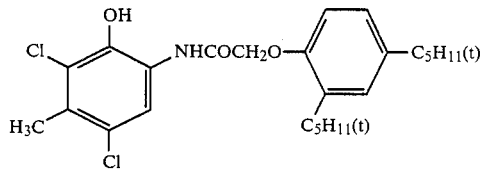

C-10

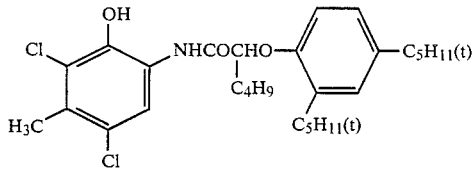

C-11

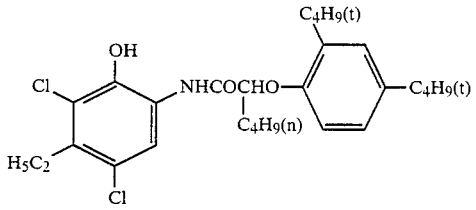

C-12

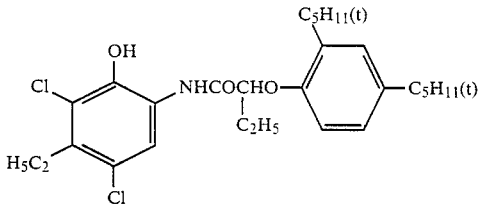

C-13

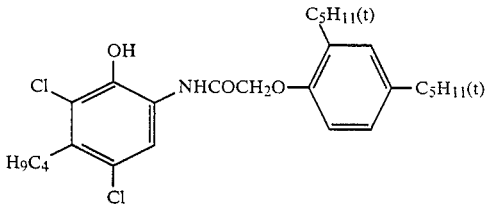

C-14

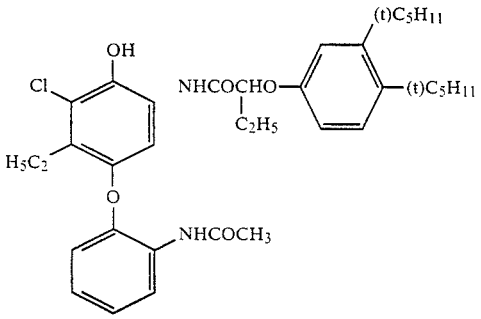

It is preferred that the silver halide light-sensitive materials of the invention are to contain the above-mentioned cyan couplers in such a state that the couplers are dispersed with a high boiling organic solvent having a dielectric constant of not less than 6.0.

The high boiling organic solvents each having a dielectric constant of more than 0.6 include, for example, a dialkyl phthalate or a phosphate represented by the following Formula (IIb) or (IIIb):

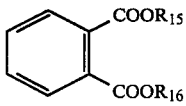

Formula (IIb)

wherein $R_{15}$ and $R_{16}$ represent an alkyl group having 1 to 4 carbon atoms, respectively.

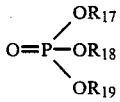

Formula (IIIb)

wherein $R_{17}$, $R_{18}$ and $R_{19}$ represent each an alkyl group or an aryl group, such as a phenyl group, having 1 to 4 carbon atoms.

Each group represented by the above-denoted $R_{15}$, $R_{16}$, $R_{17}$, $R_{18}$ and $R_{19}$ are allowed to have a substituent.

(Exemplified Compound)

(H-1)

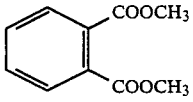

(H-2)

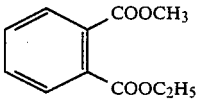

(H-3)

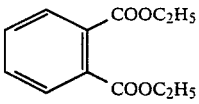

(H-4)

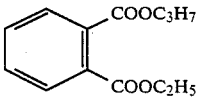

(H-5)

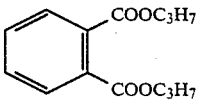

(H-6)

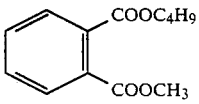

(H-7)

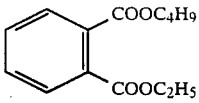

(H-8)

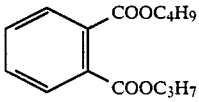

-continued (Exemplified Compound)

(H-9)

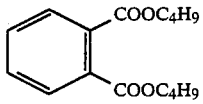

(H-10)

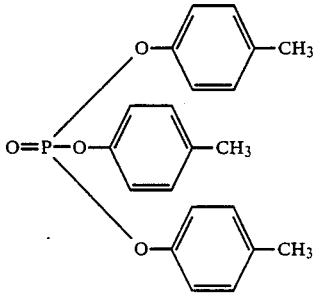

(H-11)

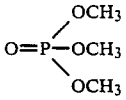

(H-12)

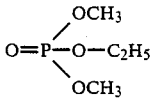

(H-13)

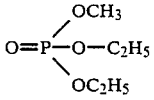

(H-14)

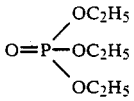

(H-15)

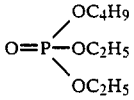

The high boiling organic solvents relating to the invention having a dielectric constant of more than 6.0 include, besides the above-mentioned solvents, a diethyl malonate, a diethyl maleate, a γ-butyrolactone, a methyl benzoate, a benzyl alcohol, a 1-octanol and so forth.

The yellow dye forming couplers preferably used in the invention include, for example, those each represented by the following general formula [Y]:

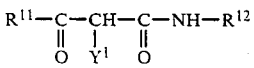

General Formula [Y]

wherein $R^{11}$ represents an alkyl group (such as a methyl group, an ethyl group, a propyl group, an butyl group and so forth) or an aryl group (such as a phenyl group, a p-methoxyphenyl group and so forth); $R^{12}$ represents an aryl group; and $Y^1$ represents a hydrogen atom or a group capable of splitting off in the course of color-developing reaction.

The above-mentioned couplers are described in, for example, U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072 and 3,894,875; West German Patent OLS Publication Nos. 1,547,868, 2,057,941, 2,162,899, 2,163,812, 2,213,461, 2,219,917, 2,261,361 and 2,263,875; Japanese Patent Examined Publication No. 13576/1974; Japanese Patent O.P.I. Publication Nos. 29432/1973, 66834/1973, 10736/1974, 122335/1974, 28834/1975 and 132926/1975; and so forth.
The typical examples of the yellow couplers preferably used in the invention will now be given below and it is, however, to be understood that this invention shall not be limited thereto.
(Y-1)
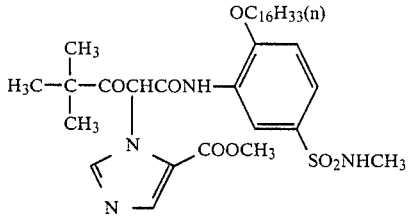
(Y-2)
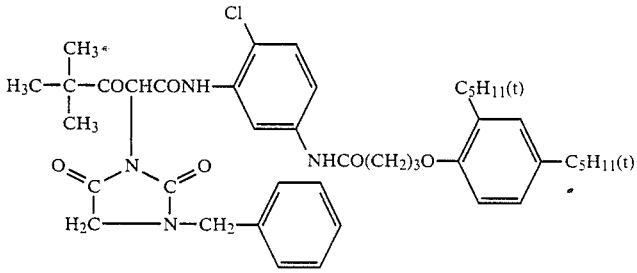
(Y-3)
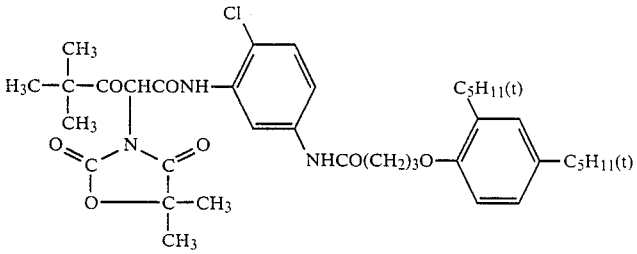
(Y-4)
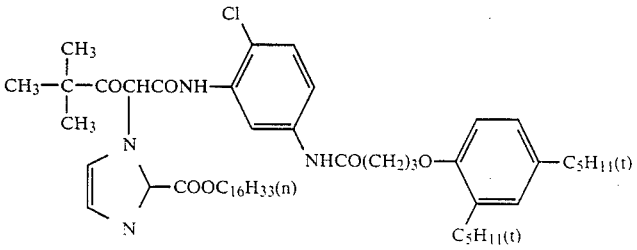
(Y-5)
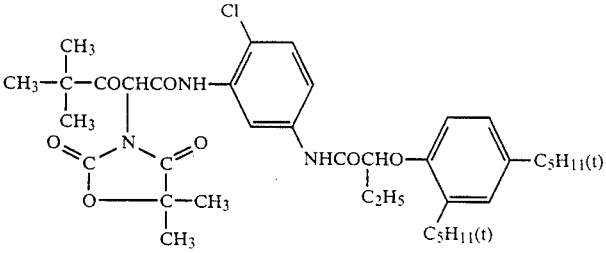

-continued
(Y-6)
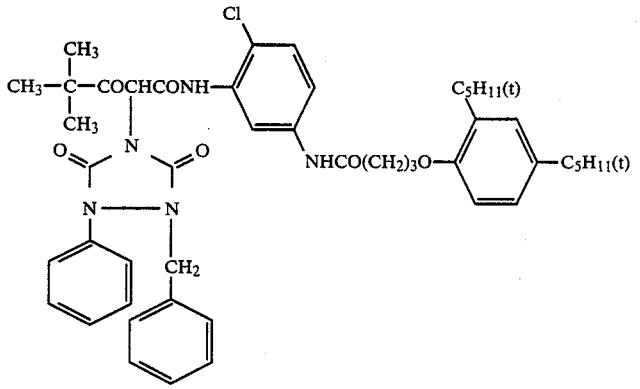
(Y-7)
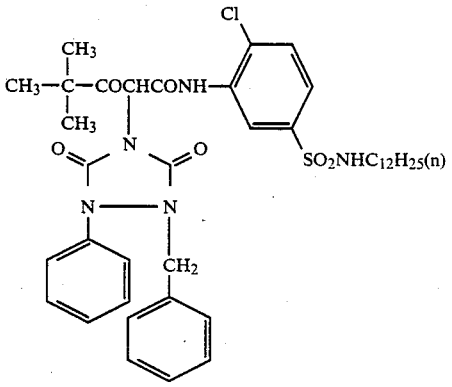
(Y-8)
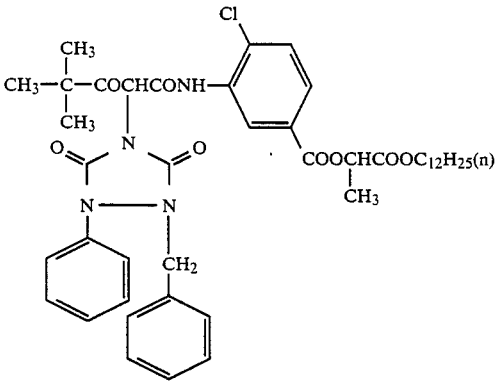
(Y-9)
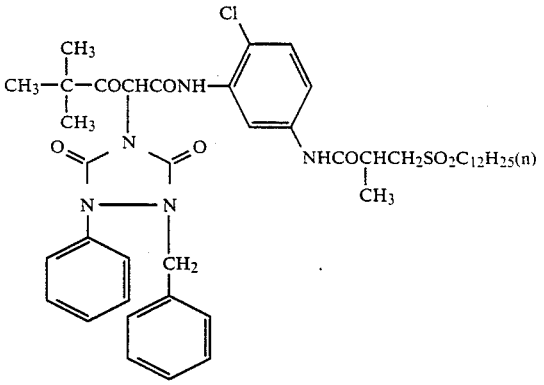

-continued
(Y-10)
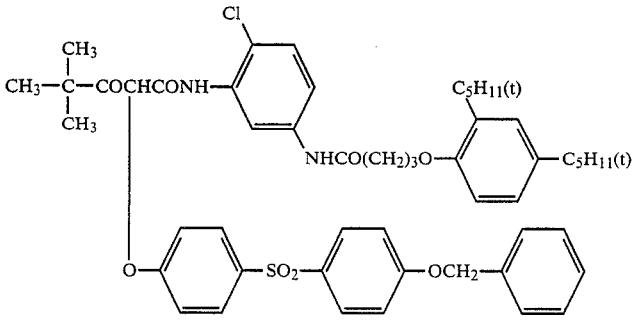
(Y-11)
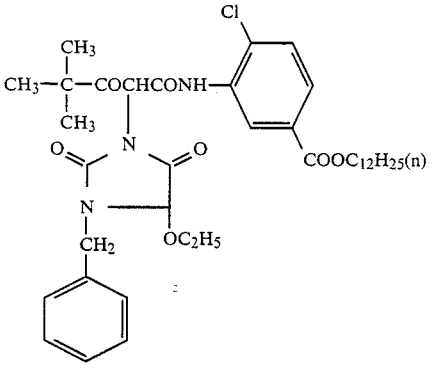
(Y-12)
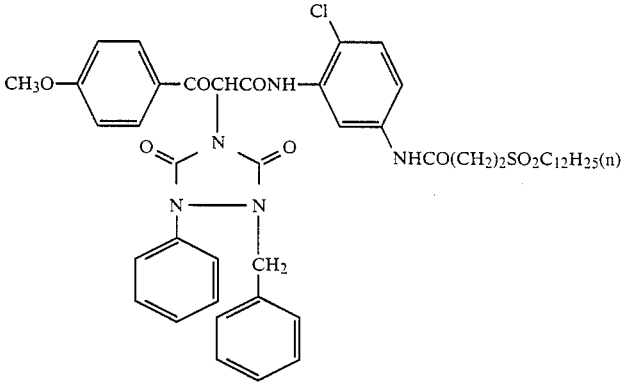
(Y-13)
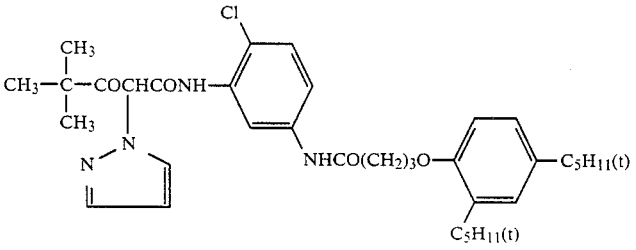
(Y-14)
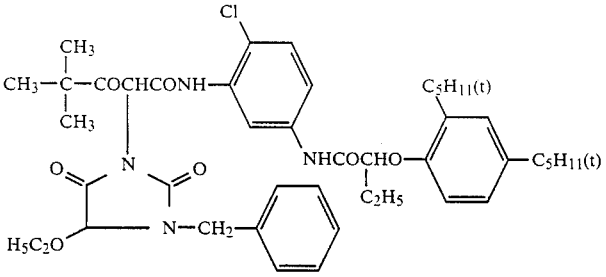
As for the binders (or protective colloids) used in the invention, gelatin is advantageous to be used therein and, besides, hydrophilic colloids including, for example, a gelatin derivative, a graft polymer comprising gelatin and other macromolecules, a protein, a sugar derivative, a cellulose derivative, such a synthetic hydrophilic macromolecular substance as homo- or copolymers may also be used therein.

The photographic emulsion layers and other hydrophilic colloidal layers of the silver halide photographic light-sensitive materials of the invention may be hardened by making use, independently or in combination, of a hardening agent capable of cross-coupling molecules of binders (or of protective colloids) to each other so as to increasing layer strength. It is desirable to add a hardening agent in an amount as much as a light-sensitive material may be hardened but to the extent that none of such hardening agent is required to be added into any processing liquid. Notwithstanding the above, a hardening agent may also be added into a processing liquid.

A plasticizers may also be added with the purpose of softening the silver halide emulsion layers and/or other hydrophilic colloidal layers of the silver halide photographic light-sensitive materials of the invention.

A water-insoluble or hardly soluble synthetic polymer dispersion (i.e., a latex) may be added into the silver halide emulsion layers containing the silver halide emulsions of the invention and/or other hydrophilic colloidal laeyrs of the light-sensitive materials of the invention, with the purposes of improving the dimensional stability and so forth.

To the silver halide photographic light-sensitive materials of the invention, auxiliary layers such as a filter layer, antihalation layer, antiirradiation layer and/or other layers may be provided. These layers and/or the emulsion layers may also contain a dyestuff expelled from or bleached in a color light-sensitive material, in the course of carrying out the development of the light-sensitive material.

A matting agent may also be added into the silver halide emulsion layers and/or other hydrophilic colloidal layers of the silver halide photographic light-sensitive materials of the invention, with the purposes of lowering the gloss of the light-sensitive material, increasing the retouchability thereof,.preventing the adhesion to each other light-sensitive materials.

A lubricant may be added into the silver halide photographic light-sensitive materials of the invention, with the purpose of reducing the sliding friction thereof.

An antistatic agent may be added into the silver halide photographic light-sensitive materials of the invention, with the purpose of an electrostatic prevention. Such an antistatic agent may be applied to an antistatic layer provided to the support side not laminated with any emulsion layer, or to the emulsion layers and/or a protective layer other than the emulsion layers, provided on the support side laminated with the emulsion layers.

A variety of surface active agents may be applied to the photographic emulsion layers and/or other hydrophilic colloidal layers of the silver halide photographic light-sensitive materials of the invention, with the purposes of improving the properties of coating, static prevention, sliding, emulsification-dispersion, adhesion prevention and other photographic properties (such as properties of development acceleration, hardening, sensitizing and so forth).

In the silver halide photographic light-sensitive materials of the invention, the photographic emulsion layers and other layers may be coated over to a flexible reflection type support including, for example, a baryta paper, a paper laminated with α-olefin polymer and so forth, a synthetic paper and so forth; a film comprising a semisynthetic or synthetic high molecules including, for example, those of cellulose acetate, cellulose nitrate, polystyrene, polyvinyl chloride, polyethyleneterephthalate, polycarbonate, polyamide and so forth; and a solid matter including, for example, a member of glass, metal, earthware and so forth.

In the silver halide photographic light-sensitive materials of the invention, the photographic emulsion layers and other layers may be coated over to the support thereof directly or through one or more subbing layers each for improving the support surfaces especially upon the adhesion property, antistatic property, dimensional stability, abrasion resistance, hardness, antihalation property, frictional property and/or others thereof, after applying a corona discharge, uv irradiation, flame treatment and so forth to the surface of the support, if required.

A thickening agent may be used when coating the silver halide photographic light-sensitive materials of the invention, with the purpose of improving the coatability. The particularly useful coating methods are an extrusion coating and curtain coating methods each capable of coating two or more layers simultaneously.

The light-sensitive materials of the invention may be exposed to light by making use of magnetic waves having the spectral region to which the emulsion layers constituting the light-sensitive materials of the invention are sensitive.

Any of the well-known light sources may be used for this purpose, such as natural light (i.e., daylight), a tungsten lamp, a fluorescent lamp, a mercury lamp, a xenon-arc lamp, a carbon-arc lamp, a xenon-flash lamp, a cathode-ray-tube flying-spot, a variety of laser beams, a light emitting diode beam, rays of light emitted from a phosphor excited by an electron beam, x-rays, γ-rays, α-rays and so forth.

An exposure may be made not only for a time from 1 millisecond to 1 second for which normal type cameras usually apply, but also from 100 microseconds to 1 microsecond by making use of a cathode-ray-tube or a xenon-flash lamp and, in addition, a more longer exposure than 1 second may also be made. Such an exposure may be made continuously or intermittently.

With the silver halide photographic light-sensitive materials of the invention, an image may be reproduced by carrying out any color development processes which have so far been well-known in the industry skilled in the art.

In the invention, the color developing agents to be used in color developers include the well-known ones each being popularly used in a variety of color photographic processes. These color developing agents include, for example, an aminophenol type and a p-phenylenediamine type derivative. These compounds are generally used in the form of the salts thereof such as in the form of a hydrochloride or a sulfate, because they are more stable than in a free state.

These compounds are generally used in a concentration of from about 0.1 g to about 30 g per liter of a color developer used and, more preferably, from about 1 g to about 15 g per liter of a color developer used.

The aminophenol type developing agents include, for example, o-aminophenol, p-aminophenol, 5-amino-2-oxytoluene, 2-amino-3-oxytoluene, 2-oxy-30amino-1,4-dimethylbenzene and so forth.

The particularly preferable primary aromatic amine color developing agents include, for example, N,N'-dialkyl-p-phenylenediamine compounds. The alkyl and phenyl groups thereof may be substituted with any substituent. Among the above, the particularly useful compounds include, for example, an N,N'-diethyl-p-phenylenediamine hydrochloride, an N-methyl-p-phenylenediamine hydrochloride, an N,N'-dimethyl-p-phenylenediamine hydrochloride, 2-amino-5-(N-ethyl-N-dodecyl-amino)-toluene, an N-ethyl-N-β-methanesulfonamidoethyl-3-methyl-4-aminoaniline hydrochloride, an N-ethyl-N-β-hydroxyethylaminoaniline, 4-amino-3-methyl-N,N'-diethylaniline, a 4-amino-N-(2-methoxyethyl)-ethyl-3-methylaniline-p-toluenesulfonate and so forth.

Into the color developers used for processing the silver halide photographic light-sensitive materials of the invention, any compounds which have been well-known as the developer components may also be added, in addition to the above-mentioned primary aromatic amine color developing agents. The above-mentioned color developers are allowed to contain, namely, any of such an alkalizing agent as sodium hydroxide, sodium carbonate, potassium carbonate and so forth, an alkali metal sulfite, an alkali metal bisulfite, an alkali metal thiocyanate, an alkali metal halide, a benzyl alcohol, a water softener, a thickener and so forth. The pH values of such color developers are normally not less than 7 and, most popularly, from about 10 to about 13.

The silver halide photographic light-sensitive materials of the invention may be processed in an alkaline activation bath by containing the above-mentioned color developing agents serving as the color developing agent itself or as the precursors thereof in the hydrophilic colloidal layers of the light-sensitive materials. Such color developing agent precursors are the compounds each capable of producing a color developing agent under alkaline conditions. These compounds include, for example, a Schiff base type precursor prepared with an aromatic aldehyde derivative, a polyvalent metal ion complex precursor, a phthalimide derivative precursor, a phosphoric acid amide derivative precursor, a sugaramine reactant precursor and a urethane type precursor. These precursors of aromatic primary amine color developing agents are desacribed in, for example, U.S. Pat. Nos. 3,342,599, 2,507,114, 2,695,234 and 3,719,492; British Pat. No. 803,783; Japanese Patent O.P.I. Publication Nos. 185628/1978 and 79035/1979; and Research Disclosure Nos. 15159, 12146 and 13924.

It is necessary that the above-mentioned aromatic primary amine color developing agents and the precursors thereof are to be added in an amount as much as a satisfactory color may be developed, when an activation treatment is applied. They are added in an amount of, mostly, from 0.1 mol to 5 mol per mol of a silver halide used and, more preferably, from 0.5 mol to 3 mol, though depending considerably upon the kinds of light-sensitive materials to be processed. These color developing agents and the precursors thereof may be used independently or in combination. They may be added into a light-sensitive material in such a manner that they are dissolved in such a suitable solvent as water, methanol, ethanol, acetone and so forth or they are formed into a dispersed emulsion by making use of such a high boiling organic solvent as dibutyl phthalate, dioctyl phthalate, tricresyl phosphate and so forth or, further, they are impregnated into such a latex polymer as described in, for example, Research Disclosure No. 14850.

The silver halide photographic light-sensitive materials of the invention are bleached and fixed after completing a color development. Such bleaching and fixing steps may be carried out at the same time.

As for the useful bleaching agents, a variety of compounds may be used. Among them, a polyvalent metal compounds such as an Iron (III), cobalt (III), copper (II) and so forth may be used. Especially, the complex salts of the cations of the above-mentioned polyvalent metal compounds and an organic acids including, for example, those of aminopolycarboxylic acids such as ethylenediaminetetraacetic acid, nitrilotriacetic acid and N-hydroxyethylethylenediaminediacetic acid; the metal complex salts such as those of malonic acid, tartaric acid, malic acid, diglycolic acid, dithioglycolic acid or the like; ferricyanates, dichromates and so forth. They may be used independently or in combination.

As for the fixers, a soluble complex-forming agent capable of making a silver halide into a complex salt so as to making it be soluble may be used. Such aceifying agents include, for example, sodium thiosulfate, ammonium thiosulfate, potassium thiocyanate, thiourea, thioether and so forth.

A washing step is normally carried out after completing the fixing step. Such washing step may be replaced by a stabilizing step and the both steps may be carried out in combination. The stabilizers each used in the stabilizing step are allowed to contain a pH adjusting agent, a chelating agent, an antimold and so forth. The detailed requirements thereof may be referred to Japanese Patent O.P.I. Publication No. 134636/1983 and so forth.

According to the silver halide photographic light-sensitive materials of the invention, spectral absorption characteristics and rapid processability can excellently be enjoyed and the fastness of magenta images against light can also remarkably be improved.

EXAMPLES

The typical embodiments of the invention will now be described in detail. It is, however, to be understood that the invention shall not be limited thereto.

EXAMPLE 1

Samples No. 1 through No. 26 were prepared in such a manner that the various kinds of coupler dispersions were so prepared as to have the compositions shown in Table 1 in the following preparing method and the resulted dispersions were mixed respectively in 500 g each of green-sensitive silver halide emulsions (in which every average grain size of the silver halide grains thereof was 0.4 μm) prepared by applying thereto the silver chloride contents each shown in Table 1, respectively, and then the resulted mixtures were coated over to the respective polyethylene-laminated supports and dried.

(METHOD OF PREPARING THE COUPLER DISPERSIONS)

The coupler dispersions were prepared, respectively, in such a manner that 40 g of a coupler and an anti-discoloring agent (in a proportion of 50 mol % to the coupler) each shown in Table 1 were dissolved in the mixed solution of 40 g of a high boiling organic solvent and 100 ml of ethyl acetate, and the resulted solution was added into an aqueous 5% gelatin solution containing sodium dodecylbenzenesulfonate and was then dispersed by means of a supersonic homogenizer.

Thus prepared samples were exposed to light in an ordinary method and were then treated in the following processing steps:

The above-mentioned every silver halide emulsion was color-sensitized by making use of Exemplified spectral sensitizer No. 4.

| [Processing steps] | Temperature | Time |
|---|---|---|
| Color developing | 34.7 ± 0.3° C. | 50 sec. |
| Bleach-fixing | 34.7 ± 0.5° C. | 50 sec. |
| Stabilizing | 30 to 34° C. | 90 sec. |
| Drying | 60 to 80° C. | 60 sec. |

| [Color developer] | |
|---|---|
| Pure water | 800 ml |
| Ethylene glycol | 10 ml |
| N,N—diethylhydroxylamine | 10 g |
| Potassium chloride | 2 g |
| N—ethyl-N—β-methanesulfonamidoethyl-3-methyl-4-aminoaniline sulfate | 5 g |
| Sodium tetrapolyphosphate | 2 g |
| Potassium carbonate | 30 g |

-continued

| | |
|---|---|
| Optical brightening agent (a 4,4'-diamino-stilbene disulfonic acid derivative) | 1 g |
| Water to be added to make in total of | 1 liter |
| pH to be adjusted to pH | 10.08 |
| [Bleach-fixer] | |
| Ammonium ethylenediaminetetraacetato-iron (III) complex dihydrate | 60 g |
| Ethylenediaminetetraacetic acid | 3 g |
| Ammonium thiosulfate (a 70% solution) | 100 ml |
| Ammonium sulfite (a 40% solution) | 27.5 ml |
| pH to be adjested by potassium carbonate of glacial acetic acid to pH | 7.1 |
| Water to be added to make in total of | 1 liter |
| [Stabilizer] | |
| 5-chloro-2-methyl-4-isothiazoline-3-one | 1 g |
| 1-hydroxyethilidene-1,1-diphosphate | 2 g |
| Water to be added to make | 1 liter |
| pH to be adjusted by sulfuric acid or potassium hydroxide to | pH 7.0 |

<TEST OF FASTNESS AGAINST LIGHT>

The test results each are expressed by the ratios of the remaining initial densities $D_0=1.0$, obtained when the samples were irradiated by sunlight for 30 days by making use of an under-glass outdoor type exposure table.

($D$ = $A$ density after discolored)

$$\text{Ratio of remaining initial density} = \frac{D}{D_o} \times 100\ (\%)$$

<COLOR DEVELOPABILITY TEST>

A maximum reflection density (Dmax) of each sample processed was measured and the values obtained express the respective characteristics of 'color developability'.

<SUBABSORPTION DENSITY>

With respect to the obtained samples, the spectral reflection spectra were measured by making use of a color analyzer Model 607 (manufactured by Hitachi, Ltd.). Each of the measurements was made by standardizing each maximum density of the absorption spectra in the regions of the visible rays as 1.0. In each sample, the reflection density in 430 nm was regarded as the subabsorption density thereof, so as to serve as an index for color purity.

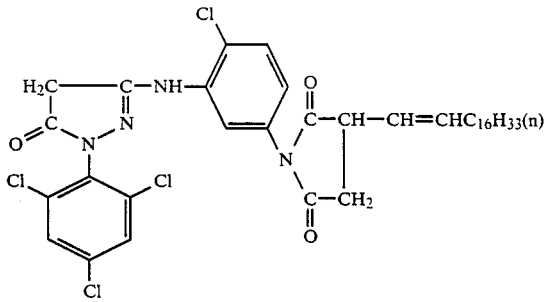

Comparative coupler 1

-continued

Comparative coupler 2

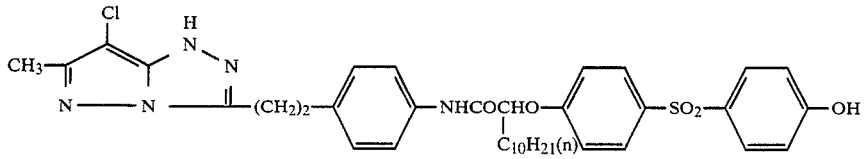

TABLE 1

| | AgCl content in AgX emulsion | Coupler | Anti-discoloring agent | High boiling organic solvent Kind | High boiling organic solvent Proportion to coupler | Color developability (Dmax) | Fastness against light | Subabsorption density |
|---|---|---|---|---|---|---|---|---|
| 1 (Comp.) | 20 | Comp. 1 | — | S-2 | 1.0 | 2.14 | 53 | 0.37 |
| 2 (Comp.) | 20 | Comp. 1 | AO-21 | S-2 | 1.0 | 2.12 | 67 | 0.38 |
| 3 (Comp.) | 20 | Comp. 2 | — | S-12 | 1.0 | 1.86 | 21 | 0.21 |
| 4 (Comp.) | 20 | Comp. 2 | AO-27 | S-12 | 1.0 | 1.80 | 37 | 0.22 |
| 5 (Comp.) | 20 | 79 | — | S-12 | 1.0 | 2.12 | 27 | 0.21 |
| 6 (Comp.) | 20 | 79 | AO-8 | S-12 | 1.0 | 2.18 | 62 | 0.21 |
| 7 (Comp.) | 50 | 79 | AO-8 | S-12 | 1.0 | 2.21 | 63 | 0.21 |
| 8 (Inv.) | 80 | 79 | AO-8 | S-12 | 1.0 | 2.35 | 70 | 0.20 |
| 9 (Inv.) | 90 | 79 | AO-8 | S-12 | 1.0 | 2.36 | 70 | 0.20 |
| 10 (Inv.) | 100 | 79 | AO-8 | S-12 | 1.0 | 2.36 | 70 | 0.20 |
| 11 (Inv.) | 100 | 7 | AO-1 | S-3 | 1.0 | 2.35 | 71 | 0.21 |
| 12 (Inv.) | 100 | 54 | AO-2 | S-3 | 1.0 | 2.35 | 70 | 0.21 |
| 13 (Inv.) | 100 | 131 | AO-6 | S-3 | 1.0 | 2.36 | 71 | 0.21 |
| 14 (Inv.) | 100 | 146 | AO-13 | S-3 | 1.0 | 2.35 | 71 | 0.20 |
| 15 (Inv.) | 100 | 167 | AO-15 | S-13 | 1.0 | 2.34 | 70 | 0.20 |
| 16 (Inv.) | 100 | 175 | e-1 | S-13 | 1.0 | 2.34 | 71 | 0.20 |
| 17 (Inv.) | 100 | 175 | e-7 | S-13 | 1.0 | 2.33 | 71 | 0.20 |
| 18 (Inv.) | 100 | 175 | e-13 | DBP | 1.0 | 2.38 | 67 | 0.20 |
| 19 (Inv.) | 100 | 175 | AO-8 | TCP | 1.0 | 2.36 | 68 | 0.21 |
| 20 (Inv.) | 100 | 175 | AO-8 | S-2 | 1.5 | 2.38 | 71 | 0.20 |
| 21 (Inv.) | 100 | 175 | AO-8 | S-2 | 0.8 | 2.35 | 70 | 0.20 |
| 22 (Inv.) | 100 | 175 | AO-8 | S-2 | 0.6 | 2.34 | 70 | 0.20 |
| 23 (Comp.) | 100 | 175 | AO-8 | S-2 | 0.4 | 2.04 | 62 | 0.20 |
| 24 (Comp.) | 100 | 175 | AO-8 | S-2 | 0.2 | 1.97 | 60 | 0.20 |
| 25 (Comp.) | 100 | 7 | — | S-2 | 1.0 | 2.13 | 29 | 0.20 |
| 26 (Comp.) | 100 | 7 | — | S-2 | 0.4 | 2.03 | 22 | 0.20 |

DBP: Dibutyl phthalate, dielectric constant 6.4
TCP: Tricresyl phosphate, dielectric constant 7.2

It is understood from the results shown in Table 1 that the samples No. 1 through No. 7 each using a silver halide emulsion having a relatively low silver chloride content do not show any satisfactory maximum density and fastness against light even when using the couplers, anti-discoloring agents and high boiling organic solvents each relating to the invention and, particularly, the samples No. 1 through No. 4 each using the comparative couplers No. 1 and No. 2 show a substantially high subabsorption density and a substantially poor fastness against light. In contrast to the above, the samples No. 8 through No. 10 each using a silver halide emulsion having a relatively high silver chloride content excellently result in both maximum density and fastness against light.

From the comparison between the amounts of high boiling organic solvents added, it is found that the color densities are increased in order from Samples No. 23, 22, 21, 10 upto 20 and, in particular, the satisfactory density level can be obtained only when the solvent content is not less than 0.6. It is further amazingly found that, in this density level, a color developability and fastness against light can correlatively be improved.

In the samples No. 25 and No. 26 each not containing any anti-discoloring agent but containing the couplers of the invention do not satisfactorily show not only the fastness against light but also the color developability.

EXAMPLE 2

A silver halide color photographic light-sensitive material for multicolor photographic use was prepared by coating the following layers each over to a support comprising a polyethylene-laminated paper, in order from the support side.

1st layer: A blue-sensitive silver chloride emulsion layer

The coating was so made as to proportionate 8 mg/dm$^2$ of a yellow coupler (i.e., Exemplified coupler No. Y-2), 3 mg/dm$^2$ (in terms of silver used) of a blue-sensitive silver chloride emulsion (i.e., Em. A), 3 mg/dm$^2$ of a high boiling organic solvent (i.e., Exemplified solvent No. S-6) and 16 mg/dm$^2$ of gelatin.

2nd layer: An interlayer

The coating was so made as to proportionate 0.45 mg/dm$^2$ of a hydroquinone derivative (i.e., HQ-1) and 4 mg/dm$^2$ of gelatin.

3rd layer: A green-sensitive silver chloride emulsion layer

The coating was so made as to proportionate 4 mg/dm$^2$ of Comparative coupler No. 3, the anti-discoloring agent shown in Table 2 in a proportion of 50 mol % to the coupler used, 4 mg/dm$^2$ (in terms of silver used) of a green-sensitive silver chloride emulsion (i.e., Em. B), 4 mg/dm$^2$ of a high boiling organic solvent (i.e., Exemplified solvent No. S-13) and 16 mg/dm$^2$ of gelatin.

4th layer: An interlayer

The coating was so made as to proportionate 3 mg/dm$^2$ each of UV absorbing agents (i.e., UV-16 and UV-6), 4 mg/dm$^2$ of a high boiling organic solvent (i.e., Exemplified solvent No. S-2), 0.45 mg/dm$^2$ of a hydroquinone derivative (i.e., HQ-1) and 14 mg/dm$^2$ of gelatin.

5th layer: A red-sensitive silver chloride emulsion layer

The coating was so made as to proportionate 1 mg/dm$^2$ of a cyan coupler (i.e., Exemplified cyan coupler No. C-8), 3 mg/dm$^2$ of a cyan coupler (i.e., Exemplified cyan coupler No. C-5), 2 mg/dm$^2$ of a high boiling organic solvent (i.e., Exemplified solvent No. S-), 3 mg/dm$^2$ (in terms of silver used) of a red-sensitive silver chloride emulsion (i.e., Em. E) and 14 mg/dm$^2$ of gelatin.

6th layer: An interlayer

The coating was so made as to proportionate 2 mg/dm$^2$ of a UV absorbing agent (i.e., UV-16), 2 mg/dm$^2$ of (UV-6), 2 mg/dm$^2$ of a high boiling organic solvent (i.e., Exemplified solvent No. S-2) and 6 mg/dm$^2$ of gelatin.

7th layer: A protective layer

The coat was made so as to be 9 mg/dm$^2$ of gelatin.

The sample prepared is hereby called Sample 1.

Next, Samples No. 2 through No. 7 were prepared in the same manner as in Sample No. 1, respectively, except that the combination of the silver halide emulsion, coupler, anti-discoloring agent, high boiling organic solvent and amount of silver coated each in the 3rd layer of Sample 1 was changed as shown in Table 2, provided however that the amounts each of the coupler and anti-discoloring agent coated were made to be the same mol as those in Sample 1.

The samples thus prepared were exposed to greenlight through an optical wedge by making use of a sensitometer (Model KS-7 manufactured by Konishiroku Photo Ind. Co., Ltd.) and were then processed in the same manner as in Example 1, respectively.

The samples thus processed were tested in the same manner as in Example 1. The results thereof are shown in Table 2.

In addition, the yellow stains produced by light in the samples were checked up in the same blue-light densitometry having been applied to the white areas of the samples in the tests of fastness against light. The results thereof were also shown in Table 2.

The silver halide emulsions each used in the tests indicated in Table 2 are as follows.

| Layer ctd w/emulsion | Emulsion name | Silver chloride content (%) | Grain size (μm) |
|---|---|---|---|
| 1st layer | Em A | 100 | 0.8 |
| 3rd layer | Em B | 100 | 0.4 |
| " | Em C | 20 | 0.4 |
| 5th layer | Em E | 100 | 0.4 |

Comparative coupler-3

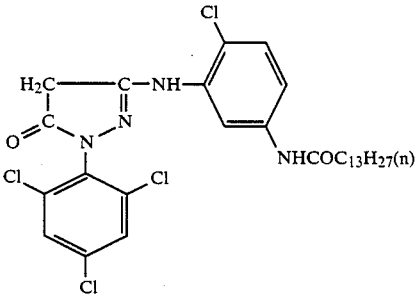

Comparative coupler-4

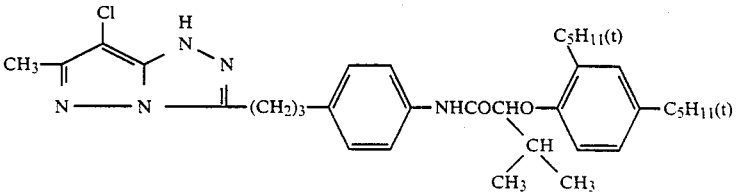

Hydroquinone derivative (HQ-1)

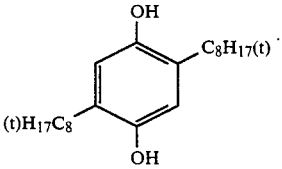

TABLE 2

| 3rd layer composition No. | Silver halide emulsion Kind | Silver ctd. | Coupler | Anti-discoloring agent | High boiling organic solvent Kind | Proportion to coupler content | Color developability (Dmax) | Fastness against light (%) | Yellow stain by light | |
|---|---|---|---|---|---|---|---|---|---|---|
| 1 | C | 4.0 | Comp. coupler[3] | AO-27 | S-13 | 1.0 | 2.13 | 78 | 0.18 | Comp. |
| 2 | C | 2.0 | Comp. coupler[4] | AO-13 | DBP* | 1.0 | 1.82 | 50 | 0.12 | Comp. |
| 3 | B | 2.0 | 7 | AO-6 | S-3 | 1.0 | 2.41 | 81 | 0.10 | Inv. |
| 4 | B | 2.0 | 54 | AO-21 | S-2 | 1.0 | 2.40 | 80 | 0.09 | Inv. |
| 5 | B | 2.0 | 79 | e-7 | S-12 | 1.0 | 2.42 | 82 | 0.10 | Inv. |
| 6 | B | 2.0 | 131 | AO-26 | TCP* | 1.0 | 2.41 | 81 | 0.13 | Inv. |
| 7 | B | 2.0 | 167 | AO-26 | TCP* | 0.4 | 2.05 | 83 | 0.14 | Comp. |

*DBP and TCP each stand for the same as in Table 1.

It may be obvious from the results shown in Table 2 that the same results as in Example 1 may be obtained also in silver halide color photographic light-sensitive materials for multicolor photographic use.

In addition to the above, when the practical prints were visually evaluated on their color reproducibility, the samples No. 3 through No. 7 each relating to the invention displayed more brighter tone and particularly they displayed excellent purple-color reproduction and, on the other hand, the sample No. 2 showed a relatively low maximum density and gave us an impression of a lack of crispness.

In conclusion, the samples No. 3 through No. 6 each relating to the invention have been able to achieve the excellent color reproducibility as well as both of the high color developability and fastness against light.

EXAMPLE 3

A sample was prepared in the same manner as in Sample 3 prepared in the aforementioned Example 2, except that, in the 3rd layer, the compound represented by Formula [XVI] was added to serve as an anti-discoloring agent and the high boiling organic solvent was replaced, as shown in Table 3 below. The prepared sample was processed and then evaluated in the same manner as in Example 1. The results of the tests are also shown in Table 3.

The amounts in mol of the compound [XVI-1] and AO-23 added were made equivalent to that of the couplers contained in each emulsion layer.

TABLE 3

| Sample No. | Compound having Formula [XVI] | Antidis-coloring agent | High boiling organic solvent Dielectric constants are given in paretheses | | B/A | Max. color density | Color fastness against light (%) |
|---|---|---|---|---|---|---|---|
| 1 (Inv.) | XVI-1 | AO-23 | Dioctyl phthalate | (5.2) | 0.63 | 2.33 | 85 |
| 2 (Comp.) | — | — | Dioctyl phthalate | (5.2) | 0.63 | 2.31 | 32 |
| 3 (Inv.) | XVI-1 | AO-23 | Diethyl phthalate | (7.6) | 0.63 | 2.28 | 78 |
| 4 (Inv.) | XVI-1 | AO-23 | Tricresyl phosphate | (6.9) | 0.63 | 2.28 | 81 |
| 5 (Inv.) | XVI-1 | AO-23 | Dibutyl phthalate | (6.4) | 0.63 | 2.34 | 83 |
| 6 (Inv.) | XVI-1 | AO-23 | Dinonyl phthalate | (4.6) | 0.63 | 2.27 | 85 |
| 7 (Inv.) | XVI-1 | AO-23 | Trinonyl phosphate | (4.5) | 0.63 | 2.27 | 85 |
| 8 (Inv.) | XVI-1 | AO-23 | Dioctyl phthalate | (5.2) | 0.80 | 2.34 | 87 |
| 9 (Inv.) | XVI-1 | AO-23 | Dioctyl phthalate | (5.2) | 1.00 | 2.34 | 88 |

As is obvious from Table 3, the sample of the invention was able to render magenta images each having no deterioration in color density and an excellent color fastness against light. It was also found that the less a dielectric constant of a high boiling organic solvent is, the more a color fastness against light is, so that very stable images can be obtained. Further, it is more preferable that the greater a B/A (a ratio by weight of a high boiling organic solvent to a coupler) is.

EXAMPLE 4

The samples were prepared in the same manner as in Sample 3 prepared in Example 2, except that the respective 3rd and 5th layers were prepared as shown in Table 4 below.

Every sample was processed in the same manner as in Example 1 and the characteristics thereof were evaluated.

The tests for the subabsorption density and dark discoloration in cyan color each of the magenta dyes were carried out in the following methods.

Further, the structures of anti-dark-discoloring agent AF-2 used therein are given below.

<SUB-ABSORPTION DENSITY>

The reflection spectra of the magenta color developed samples obtained were measured by making use of a color analyzer, Model 607 manufactured by Hitachi, Ltd., respectively. In the measurements, a maximum density value of the absorption spectra in the visible areas of each sample was regarded as the standard value of 1.0, and the reflection density of each sample in 430 nm was regarded as a sub-absorption density so as to serve as the color purity index.

<DARK DISCOLORATION TEST IN CYAN>

The cyan color developed samples thereby processed were stored in a hydrothermostat for 2 weeks at 85° C. and 60% RH.

The resulted discoloration of each sample was expressed in terms of the ratio of such discoloration to the initial density Do=1.0.

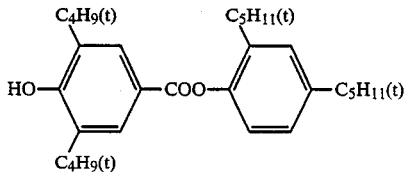

AF-2

TABLE 4

| Sample No. | 3rd layer Coupler | 3rd layer High boiling organic solvent | 3rd layer Proportion boiling organic solvent to coupler | 3rd layer Antidiscoloring agent | 5th layer Coupler | 5th layer High boiling organic solvent | 5th layer Proportion boiling organic solvent to coupler | 5th layer Antidiscoloring agent | Magenta Color developability | Magenta Sub-absorption | Magenta Light yellow stain | Cyan dark-discoloration |
|---|---|---|---|---|---|---|---|---|---|---|---|---|
| 1 | 70 | H-9 | 1.0 | AO-23 | C-6 | S-6 | 0.6 | AF-2 | 2.32 | 0.20 | 0.10 | 91 |
| 2 | 160 | H-9 | 1.0 | AO-23 | C-14 C-5 mol ratio [1:3] | S-13 | 0.6 | UV-16 | 2.30 | 0.20 | 0.09 | 96 |
| 3 | 160 | H-9 | 1.0 | AO-23 | C-14 C-5 mol ratio [1:3]* | S-13 | 0.15 | UV-16 | 2.30 | 0.20 | 0.09 | 92 |

It was confirmed from the results shown in Table 4 that the samples, each of which is comprised of both of a green-sensitive emulsion layer containing the magenta couplers of the invention and a red-sensitive emulsion layer containing cyan couplers dispersed with a high boiling organic solvent having a dielectric constant of not less than 6.0, the samples are excellent silver halide photographic light-sensitive materials, because they displayed satisfactory color developability and substantially less sub-absorption, yellow light-stain and cyan dark-discoloration.

EXAMPLE 5

The samples shown in Table 5 were prepared in the same manner as in Sample 3 prepared in Example 2, except that the respective 3rd layers were prepared as shown in Table 5 below. Into every sample, the anti-discoloring agent AO-21 was added in an amount of 0.1 mol per mol of the couplers contained in the 3rd layer.

Every sample was processed in the same manner as in Example 1 and the characteristics thereof were evaluated. The results thereof are also shown in Table 5.

The color fastness against light of each sample was tested in the following method:

<COLOR FASTNESS AGAINST LIGHT>

Magenta-dye images were exposed to daylight for 20 days by making use of an under-glass type outdoor exposure table and the results thereof were evaluated in the same manner as in Example 1.

Comparative coupler 5

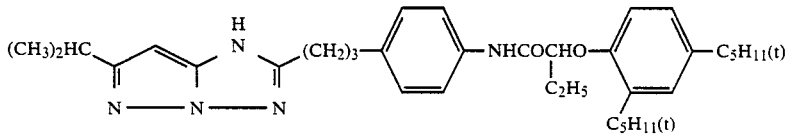

TABLE 5

| Sample No. | Magenta coupler (Exempl. No.) | Composition: Dye-image stabilizer (Exempl. No.) | (B/A) | High boiling organic solvent (Exempl. No.) | Result: Color fastness against light (%) of magenta dye-image | Maximum color density | Side absorption density | Remark |
|---|---|---|---|---|---|---|---|---|
| 1 | Comp. coupler-5 | XVI-1 (0.5) | 1.5 | S-6 | 81 | 1.62 | 0.21 | Comp. |
| 2 | 7 | XVI-1 (0.5) | 1.5 | S-6 | 84 | 2.25 | 0.21 | Inv. |
| 3 | 7 | XVI-1 (0.5) | 1.5 | S-12 | 82 | 2.21 | 0.21 | Inv. |
| 4 | 7 | XVI-1 (0.5) | 1.5 | DBP* | 80 | 2.14 | 0.21 | Inv. |
| 5 | 7 | XVI-1 (0.5) | 1.5 | S-6 | 86 | 2.24 | 0.21 | Inv. |
| 6 | 7 | XVI-1 (0.5) | 2.0 | S-6 | 85 | 2.24 | 0.21 | Inv. |
| 7 | 54 | XVI-1 (0.5) | 1.5 | S-6 | 83 | 2.26 | 0.21 | Inv. |
| 8 | 131 | XVI-1 | 1.5 | S-6 | 84 | 2.23 | 0.21 | Inv. |

TABLE 5-continued

| Sample No. | Magenta coupler (Exempl. No.) | Composition: Dye-image stabilizer (Exempl. No.) | (B/A) | High boiling organic solvent (Exempl. No.) | Result: Color fastness against light (%) of magenta dye-image | Maximum color density | Side absorption density | Remark |
|---|---|---|---|---|---|---|---|---|
| 9 | 146 | (0.5) XVI-1 (0.5) | 1.5 | S-6 | 83 | 2.22 | 0.21 | Inv. |

*DPB: Dibutyl phthalate

As is obvious from Table 5, it can be found that the magenta dye-images obtained of the silver halide photographic light-sensitive materials prepared in accordance with the invention may be endowed with an excellent color reproducibility and may further be improved in color fastness against light and maximum density. It can also be found from more closer observation that the effects of the invention can be further increased as the image stabilizer of the invention is increasingly added. It is further found that the effects of the invention can more effectively be displayed when using a high boiling organic solvent having a relatively lower dielectric constant selected from every kind thereof.

EXAMPLE 6

The samples of the invention each containing the compound e-5 represented by Formula [XIV] and an oil-soluble dyestuff were prepared in the same manner as in Sample 3 prepared in Example 2, except that the composition of the respective 3rd layers were replaced as shown in Table 6.

The color tones and the white background of the obtained images were measured in the following methods:

<TEST FOR SPECTRAL ABSORPTION CHARACTERISTICS>

The spectral reflectance of each magenta color developed sample obtained was measured by making use of a color-analyzer (Model 607 manufactured by Hitachi Ltd.). In the measurements, in the visible areas of each sample, a maximum density of the absorption spectra therein was regarded as a standard value of 1.0.

Next, a maximum absorption wavelength in the visible magenta areas of each sample was read and a maximum absorption wavelength of a separately prepared sample not containing any compound having Formula [XIV] was regarded as a standard. Then the difference in maximum absorption wavelength between the two samples was calculated.

The value calculated was used as a criterion of color tones for estimating a degree of shifting the tones to a longer wavelength side, (hereinafter called an LWS degree).

<MEASUREMENT OF WHITENESS>

The values of a* and b* of the white background, i.e., the unexposed areas, of each sample obtained was measured in conformity to the method of measuring object colors specified in Japanese Industrial Standards, JIS Z8722 and Z8727 by making use of a Hitachi Color Analyzer Model 607.

The results indicated that the more an a* value is, the more a red tone is, while the less a* value is, the more a green tone is; and, on the other hand, the more a b* value is, the more a yellow tone is, while the less a b* value is, the more a blue tone is.

In addition to the above measurements, the visual whiteness of the samples were also judged.

TABLE 6

| Sample No. | Coupler | Compound having Formula [XIV] simplet oxygen quenching constant is given in parenthesis [$M^{1}$ $sec^{1}$] | Oil-soluble dyestuff | Color fastness against light (%) | Whiteness: a* | b* | Visual judgement | Color tone. (An LWS degree), [nm] |
|---|---|---|---|---|---|---|---|---|
| 1 | 7 | e-5 ($2 \times 10^3$) | — | 88 | +0.13 | +0.51 | Green | +2 |
| 2 | 7 | e-5 ($2 \times 10^3$) | 4 (0.1 mg/$m^2$) 9 (0.1 mg/$m^2$) | 87 | +0.21 | −0.56 | White | 0 |
| 3 | 54 | e-5 ($2 \times 10^3$) | 4 (0.1 mg/$m^2$) 9 (0.1 mg/$m^2$) | 88 | +0.22 | −0.57 | White | +1 |
| 4 | 79 | e-5 ($2 \times 10^3$) | 4 (0.1 mg/$m^2$) 9 (0.1 mg/$m^2$) | 84 | +0.20 | −0.55 | White | +1 |
| 5 | 146 | e-5 ($2 \times 10^3$) | 4 (0.1 mg/$m^2$) 9 (0.1 mg/$m^2$) | 88 | +0.23 | −0.53 | White | +1 |
| 6 | 167 | e-5 ($2 \times 10^3$) | 4 (0.1 mg/$m^2$) 9 (0.1 mg/$m^2$) | 89 | +0.22 | −0.63 | White | 0 |
| 7 | 167 | e-5 ($2 \times 10^3$) | 4 (0.1 mg/$m^2$) 9 (0.1 mg/$m^2$) | 92 | +0.22 | −0.63 | White | 0 |

*Compound having Formula [XIV] were added in a proportion of 0.5 mol to mol of the couplers used.
Comparative couplers used herein were equivalent to those used in Example-1.
Into every sample except sample-7, AO-21 was further added in an amount of 0.1 mol and, into Sample 7, the same was added in an amount of one mol per mol of the couplers used, respectively.

It can be found from the results shown in Table 6 that the undesirable phenomena such as the lowering in a white background and the increase in an LWS degree may be taken place when the couplers of the invention contain a compound having Formula [XIV], however, such phenomena can be prevented by using an oil-soluble dyestuff in combination and the invention can result in an excellent color fastness against light and a clear white background as well as no shifting of tones to a long wavelength side.

What is claimed is:

1. A silver halide photographic light-sensitive material comprising a support bearing at least one silver halide emulsion layer thereon, wherein said silver halide emulsion layer contains silver halide grains each containing silver chloride in an amount of not less than 80 mol %, and at least one coupler selected from the group consisting of the couplers represented by the following General Formulas (a), (b) and (c), and an anti-discoloring agent, each dispersed in the emulsion layer by making use of a high boiling organic solvent, provided that a proportion of said high boiling organic solvent to said coupler is not less than 0.6 by weight;

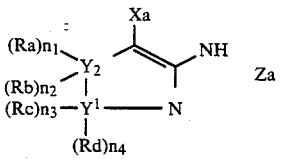

General Formula (a)

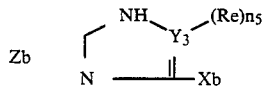

General Formula (b)

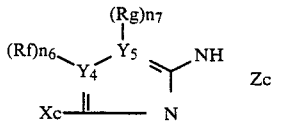

General Formula (c)

wherein Za, Zb, and Zc each represent a group of non-metal atoms necessary to complete a nitrogen-containing heterocyclic ring;

Xa, Xb, and Xc each represent a hydrogen atom or a group capable of being split off upon the reaction thereof with oxidized products of a color developing agent;

Ra, Rb, Rc, Rd, Re, Rf, and Rg each represent a hydrogen atom or a substituent, provided that Rg represents a substituent incapable of being split off upon the reaction of the couplers of General Formula (c) with said oxidized products;

$Y_1$ represents carbon or nitrogen;

$Y_2$ represents carbon or a hetero atom;

means that the bonding between $Y_1$ and $Y_2$ may be either a single bond or a double bond, $Y_3$, $Y_4$, and $Y_5$ each represent carbon or nitrogen;

$n_1$, $n_2$, $n_3$, $n_4$, $n_5$, $n_6$, and $n_7$ each represent an integer 0 or 1; and when $Y_1$ is carbon and the bonding between $Y_1$ and $Y_2$ is a double bond, $n_3$ is 1 and $n_4$ is 0 and Rc is a group incapable of being split off upon the reaction of the couplers of General Formula (a) with the oxidized products of a color developing agent; in the case that $Y_1$ is a carbon atom and the bonding between $Y_1$ and $Y_2$ is a single bond, $n_3$ and $n_4$ are each 1; in the case $Y_1$ is a nitrogen atom and the bonding between $Y_1$ and $Y_2$ is a double bond, $n_3$ and $n_4$ are each 0, $Y_2$ is a hetero atom; and in the case that $Y_1$ is a nitrogen atom and bonding between $Y_1$ and $Y_2$ is a single bond, $n_3$ is 1 and $n_4$ is 0.

2. The silver halide photographic light-sensitive material of claim 1, wherein said coupler is selected from the group consisting of the couplers represented by the following General Formulas (a-1) through (a-11), (b-1) through (b-8) and (c-1) through (c-14), respectively,

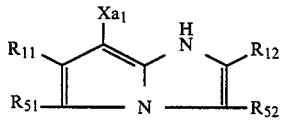

General Formula (a-1)

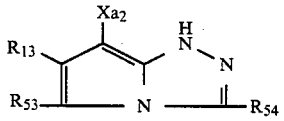

General Formula (a-2)

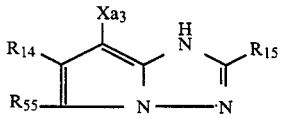

General Formula (a-3)

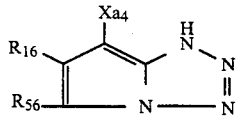

General Formula (a-4)

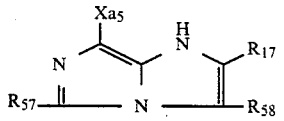

General Formula (a-5)

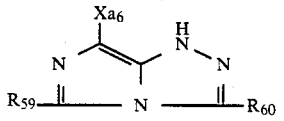

General Formula (a-6)

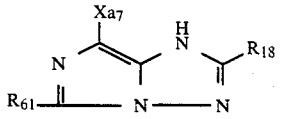

General Formula (a-7)

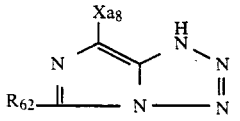

General Formula (a-8)

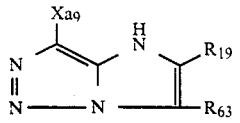

General Formula (a-9)

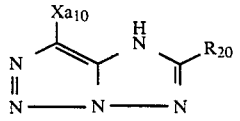

General Formula (a-10)

-continued

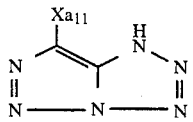

General Formula (a-11)

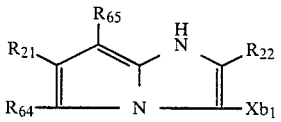

General Formula (b-1)

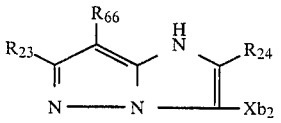

General Formula (b-2)

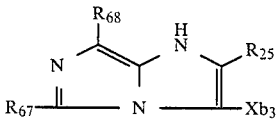

General Formula (b-3)

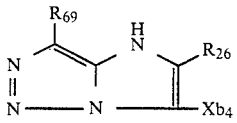

General Formula (b-4)

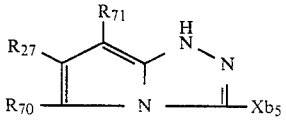

General Formula (b-5)

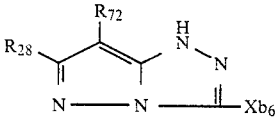

General Formula (b-6)

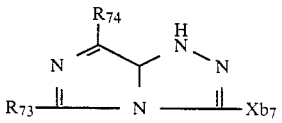

General Formula (b-7)

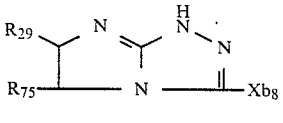

General Formula (b-8)

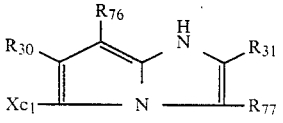

General Formula (c-1)

General Formula (c-2)

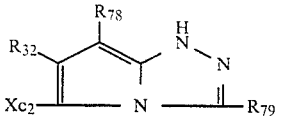

General Formula (c-3)

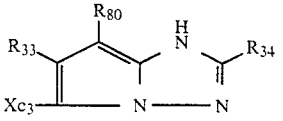

-continued

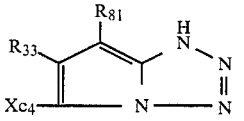

General Formula (c-4)

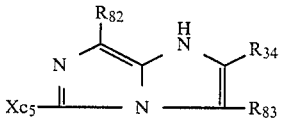

General Formula (c-5)

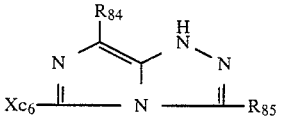

General Formula (c-6)

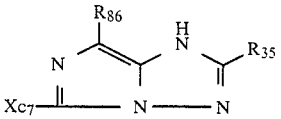

General Formula (c-7)

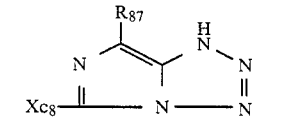

General Formula (c-8)

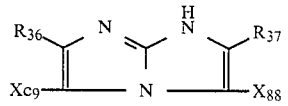

General Formula (c-9)

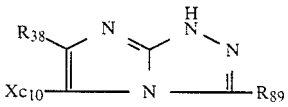

General Formula (c-10)

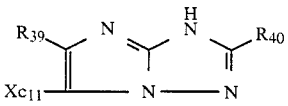

General Formula (c-11)

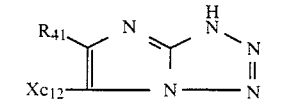

General Formula (c-12)

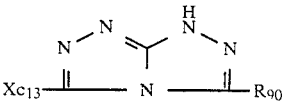

General Formula (c-13)

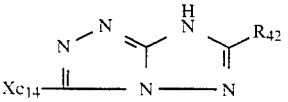

General Formula (c-13)

wherein $Xa_1$ to $Xa_{11}$ are synonymous with Xa and, similarly, $Xb_1$ to $Xb_8$ with Xb, $Xc_1$ to $Xc_{14}$ with Xc, $R_{11}$ to $R_{20}$ with Ra, $R_{51}$ to $R_{63}$ with Rg, $R_{21}$ to $R_{29}$ with Re, $R_{64}$ to $R_{75}$ with Rg, $R_{30}$ to $R_{42}$ with Rf and $R_{76}$ to $R_{90}$ with Rg, respectively.

3. The silver halide photographic light-sensitive material of claim 2, wherein said coupler is selected from the group consisting of the couplers represented by General Formulas (a-2), (a-3), (a-4), (b-1), (b-3), (b-4), (c-2), (c-3), (c-4), (c-9) and (c-10), respectively.

4. The silver halide photographic light-sensitive material of claim 3, wherein said coupler selected from the group of the couplers represented by General Formulas (a-3), (b-1), (c-3), (c-9) and (c-10), respectively.

5. The silver halide photographic light-sensitive material of claim 1, wherein said anti-discoloring agent is selected from the group consisting of the compounds represented by the following General Formulas [A] through [H], [XII] through [XVI] and [XVII], respectively, General Formula [A]

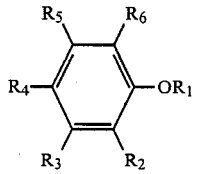

wherein $R^1$ represents a hydrogen atom, an alkyl group, an alkenyl group, an aryl group or a heterocyclic group; $R^2$, $R^3$, $R^5$ and $R^6$ represent each a hydrogen atom, a halogen atom, a hdyroxy group, an alkyl group, an alkenyl group, an aryl group, an alkoxy group or an acylamino group; and $R^4$ represents an alkyl group, a hydroxy group, an aryl group or an alkoxy group; and $R^1$ and $R^2$ are allowed to close a ring with each other so as to complete a 5- or 6-membered ring, provided that, $R^4$ represents a hydroxy or alkoxy group; and, $R^3$ and $R^4$ are allowed to complete a 5-membered hydrocarbon ring provided that, $R^1$ represents an alkyl, aryl or heterocyclic group; provided however that it is exceptional when $R^1$ represents a hydrogen atom and $R^4$ represents a hydroxy group at the same time;

General Formual [B]

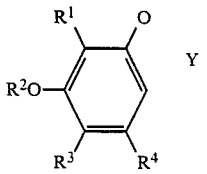

wherein $R^1$ and $R^4$ represent each a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamido group, a cycloalkyl group or an alkoxycarbonyl group; $R^2$ represents a hydrogen atom, an alkyl group, an alkenyl group, an aryl group, an acyl group, a cycloalkyl group or a heterocyclic group; and $R^3$ represents a hydrogen atom, a halogen atom, an alkyl group, an alkenyl group, an aryl group, an aryloxy group, an acyl group, an acyloxy group, a sulfonamido group, a cycloalkyl group or an alkoxycarbonyl group; and Y represents a group of atoms necessary for completing a chroman or coumaran ring;

General Formula [C]

-continued

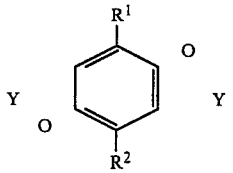

General Formual [D]

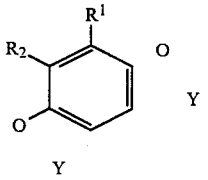

wherein $R^1$ and $R^2$ represent each a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamido group or an alkoxycarbonyl group; and Y represents a group of atoms necessary for completing a dichroman or coumaran ring, together with a benzene ring;

General Formula [E]

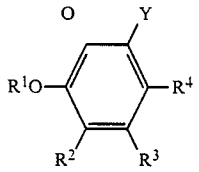

wherein $R^1$ represents a hydrogen atom, an alkyl group, an alkenyl group, an aryl group, an acyl group, a cycloalkyl group or a heterocyclic group; $R^3$ represents a hydrogen atom, a halogen atom, an alkyl group, an alkenyl group, an aryl group, an aryloxy group, an acyl group, an acylamino group, an acylamino group, an acyloxy group, a sulfonamido group, a cycloalkyl group or an alkoxycarbonyl group;

$R^2$ and $R^4$ represent each a hydrogen atom, a halogen atom, an alkyl group, an alkenyl group, an aryl group, an acyl group, an acylamino group, a sulfonamido group, a cycloalkyl group or an alkoxycarbonyl group; and Y represents a group of atoms necessary for completing a chroman or coumaran ring;

General Formula [F]

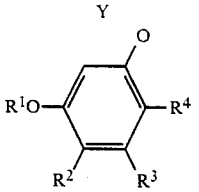

wherein $R^1$ represents a hydrogen atom, an alkyl group, an alkenyl group, an aryl group, an acyl group, a cycloalkyl group or a heterocyclic group;

$R^2$ represents a hydrogen atom, a halogen atom, an alkyl group, an alkenyl group, an aryl group, an aryloxy group, an acyl group, an acylamino group, an acyloxy group, a sulfonamido group, a cycloalkyl group or an alkoxycarbonyl group;

$R^3$ represents a hydrogen atom, a halogen atom, an alkyl group, an alkenyl group, an aryl group, an acyl group, an acylamino group, a sulfonamido group, a cycloalkyl group or an alkoxycarbonyl group;

$R^4$ represents a hydrogen atom, a halogen atom, an alkyl group, an alkenyl group, an alkoxy group, an alkenyloxy group, an hydroxy group, an aryl group, an aryloxy group, an acyl group, an acylamino group, an acyloxy group, a sulfonamido group or an alkoxycarbonyl group; and Y represents a group of atoms necessary for completing a chroman or coumaran ring;

General Formula [G]

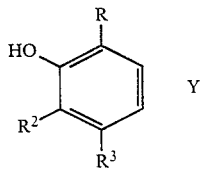

wherein $R^1$ and $R^3$ represent each a hydrogen atom, a halogen atom, an alkyl group, an alkenyl group, an alkoxy group, a hydroxy group, an aryl group, an aryloxy group, an acyl group, an acylamino group, an acyloxy group, a sulfonamido group, a cycloalkyl group or an alkoxycarbonyl group;

$R^2$ represents a hydrogen atom, a halogen atom, an alkyl group, an alkenyl group, a hydroxy group, an aryl group, an acyl group, an acylamino group, an acyloxy group, a sulfonamido group, a cycloalkyl group or an alkoxycarbonyl group; and Y represents a group of atoms necessary for completing an indane ring;

General Formula [H]

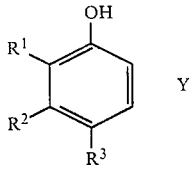

wherein $R^1$ and $R^2$ represent each a hydrogen atom, a halogen atom, an alkyl group, an alkenyl group, an aryl group, an acyl group, an acylamino group, an acyloxy group, a sulfonamido group, a cycloalkyl group or an alkoxycarbonyl group;

$R^3$ represents a hydrogen atom, a halogen atom, an alkyl group, an alkenyl group, an alkoxy group, a hydroxy group, an aryl group, an aryloxy group, an acyl group, an acylamino group, an acyloxy group, a sulfonamido group, a cycloalkyl group or an alkoxycarbonyl group; and Y represents a group of atoms necessary for completing an indane ring, and such an indane ring may have a substituent, or may also complete a spiro ring;

General Formula [XII]

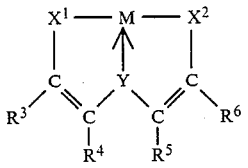

General Formula [XIII]

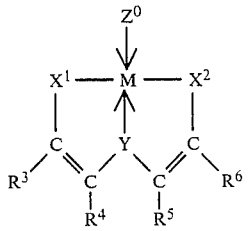

General Formula [XIV]

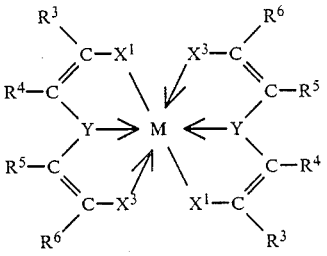

wherein, M represents a metal atom;

$X^1$ and $X^2$ represent each an oxygen atom, a sulfur atom or an —$NR^7$— in which $R^7$ represents a hydrogen atom, an alkyl group, an aryl group or a hydroxyl group;

$X^3$ represents a hydroxyl group or a mercapto group;

Y represents an oxygen atom or a sulfur atom;

$R^3$, $R^4$, $R^5$ and $R^6$ represent each a hydrogen atom, a halogen atom, a cyano group or, an alkyl, aryl, cycloalkyl and heterocyclic group each of which is bonded to a carbon atom directly or through a divalent bonding group, and at least one of the combinations of $R^3$ with $R^4$ and of $R^5$ with $R^6$ may be so bonded as to complete a 5- or 6-membered ring, together with the carbon atom bonded thereto; and $Z^0$ represents a compound which may be coordinated to M or the residual group thereof;

General Formula [XV]

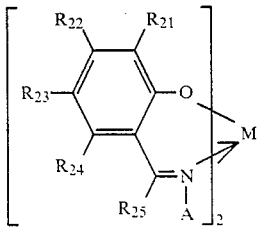

wherein $R_{21}$, $R_{22}$, $R_{23}$ and $R_{24}$ represent each a hydrogen atom, a halogen atom, a hydroxy group, a cyano group or an alkyl, aryl, cycloalkyl or heterocyclic group which is to be bonded to a carbon atom on a benzene ring directly or indirectly through a divalent coupling group, and $R_{21}$ and $R_{22}$, $R_{22}$ and $R_{23}$ or $R_{23}$ and $R_{24}$ may be so bonded to each other as to complete a 6-membered ring;

$R_{25}$ represents a hydrogen atom, an alkyl group or an aryl group;

A represents a hydrogen atom, an alkyl group, an aryl group or a hydroxy group; and M represents a metal atom;

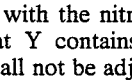

Formula [XVI]

wherein $R^1$ represents an aliphatic group, a cycloalkyl group or an aryl group; and Y represents a group of non-metal atoms necessary for completing a 5-membered to 7-membered heterocyclic ring together with the nitrogen atom, provided, however, that Y contains at least one hetero atom which shall not be adjacent to the nitrogen atom;

Formula [XVII]

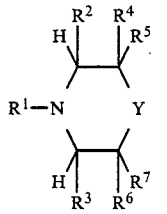

wherein $R^1$ represents an aliphatic group, a cycloalkyl group or an aryl group; Y represents a simple link or a divalent hydrocarbon group each necessary for completing a 5-membered to 7-membered heterocyclic ring together with the nitrogen atom; and $R^2$, $R^3$, $R^4$, $R^5$, $R^6$ and $R^7$ represent each a hydrogen atom, an aliphatic group, a cycloalkyl group or an aryl group, provided, however, that $R^2$ and $R^4$ or $R^3$ and $R^5$ may be bonded together to form a simple link so that an unsaturated 5- to 7-membered heterocyclic ring may be completed together with the nitrogen atom and Y, and that, when Y is a simple link, $R^5$ and $R^7$ may be bonded together to form a simple link so that an unsaturated 5- to 7-membered heterocyclic ring may be completed together with Y, and, further, that, when Y is not a simple link, $R^5$ and Y, $R^7$ and Y, or Y itself may be formed an unsaturated link so that an unsaturated 6- or 7-membered heterocyclic ring may be completed together with the nitrogen atom and Y.

6. The silver halide photographic light-sensitive material of claim 5, wherein said anti-discoloring agent represented by from General Formula [A] through [H], has an oxidation potential of from 0.95 to 1.50 V.

7. The silver halide photographic light-sensitive material of claim 5, wherein said anti-discoloring agent represented by General Formula [XII] through [XV] has a singlet oxygen quenching rate of not less than $3\times10^7 M^{-1}\cdot sec$.

8. The silver halide photographic light-sensitive material of claim 1, wherein said high boiling organic solvent has a dielectric constant within the range of from 1.9 to 6.0.

9. The silver halide photographic light-sensitive material of claim 8, wherein said high boiling organic solvent is selected from the group consisting of the organic solvents represented by the following General Formula [IIa] and [IIIa] respectively,

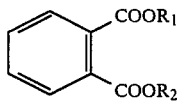

General Formula [IIa]

wherein $R_1$ and $R_2$ represent each an alkyl group, an alkenyl group or an aryl group, provided that the total number of carbon atoms contained in the group represented by $R_1$ and $R_2$ is from 8 to 32;

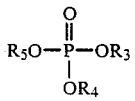

General Formula [IIIa]

wherein $R_3$, $R_4$ and $R_5$ represent each an alkyl group, an alkenyl group or an aryl group, provided that the total number of carbon atoms contained in the group represented by $R_3$, $R_4$ and $R_5$ is from 24 to 54.

10. The silver halide photographic light-sensitive material of claim 1, wherein said proportion of said high boiling organic solvent to said coupler is not less than 0.8.

11. The silver halide photographic light-sensitive material of claim 10, wherein said proportion of said high boiling organic solvent to said coupler is within the range of from 1.0 to 3.0.

* * * * *